US005255489A

United States Patent [19]

Matsumoto et al.

[11] Patent Number: 5,255,489

[45] Date of Patent: Oct. 26, 1993

[54] CONSTRUCTION APPARATUS FOR BUILDINGS AND CONSTRUCTING METHOD THEREWITH

[75] Inventors: Takeji Matsumoto; Hiroki Muramoto; Mitoku Mukaidani; Yasuyuki Hashimoto; Motoetsu Ishii, all of Hiroshima; Hiroshi Kondoh, Tokyo; Nobuhiro Okuyama, Tokyo; Yoshio Abe, Tokyo; Junichiro Maeda, Tokyo; Yoichi Seki, Tokyo; Tadashi Okano, Tokyo; Michio Hakiri, Tokyo; Yoji Moroi, Tokyo; Masaaki Nakanishi, Tokyo; Katuhiro Inada, Tokyo, all of Japan

[73] Assignees: Mitsubishi Jukogyo Kabushiki Kaisha; Shimizu Construction Co., Ltd., both of Tokyo, Japan

[21] Appl. No.: 743,229

[22] Filed: Aug. 9, 1991

[30] Foreign Application Priority Data

| | | | |
|---|---|---|---|
| Aug. 9, 1990 | [JP] | Japan | 2-212310 |
| Aug. 31, 1990 | [JP] | Japan | 2-230147 |
| Sep. 7, 1990 | [JP] | Japan | 2-237745 |
| Oct. 11, 1990 | [JP] | Japan | 2-272729 |
| Oct. 19, 1990 | [JP] | Japan | 2-281599 |
| Oct. 19, 1990 | [JP] | Japan | 2-281600 |
| Oct. 19, 1990 | [JP] | Japan | 2-281601 |
| Apr. 19, 1991 | [JP] | Japan | 3-115520 |
| Jul. 1, 1991 | [JP] | Japan | 3-186898 |

[51] Int. Cl.[5] ..... E04B 1/19

[52] U.S. Cl. ..... 52/745.17; 52/741.1; 52/749

[58] Field of Search ..... 52/741, 745, 749, 123.1, 52/125.2, 122.1, 745.17, 741.1

[56] References Cited

U.S. PATENT DOCUMENTS

| | | | |
|---|---|---|---|
| 3,998,029 | 12/1976 | James et al. | 52/123.1 |
| 5,022,199 | 6/1991 | Horii et al. | 52/123.1 |
| 5,088,263 | 2/1992 | Horii et al. | 52/745 |

FOREIGN PATENT DOCUMENTS

| | | | |
|---|---|---|---|
| 0358433 | 3/1990 | European Pat. Off. | 52/749 |
| 1418448 | 8/1988 | U.S.S.R. | 52/749 |
| 0322099 | 11/1929 | United Kingdom | 52/125.2 |
| 971660 | 7/1962 | United Kingdom . | |
| 1443200 | 9/1973 | United Kingdom . | |

*Primary Examiner*—Carl D. Friedman
*Assistant Examiner*—Christopher Todd Kent
*Attorney, Agent, or Firm*—Finnegan, Henderson, Farabow, Garrett & Dunner

[57] ABSTRACT

An apparatus for constructing a building (K) is disclosed. The building (K) includes a framework constituted of permanent columns (10) and permanent beams (11). The apparatus (S) is provided with a temporary framework (13) which is constructed and located above the building (K) under construction. Lifting mechanisms (14) for lifting the temporary framework (13) are provided at and supported by the permanent columns (10) of the building (K). Each of the lifting mechanisms (14) is able to lift the lifting mechanism (14) itself along the permanent column (10) of the building (K). A crane (12, 413, 511) is provided at the temporary framework (13) for hoisting and conveying structural elements (U) of the building (K), for example, the permanent columns (10) and beams (11). Alternatively, movable hoists (131, 607) are provided so as to transfer at least under the temporary framework (13).

16 Claims, 50 Drawing Sheets

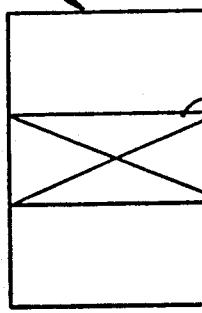
FIG. 25(a)
FIG. 25(b)
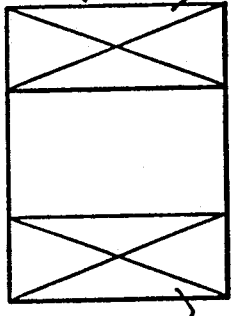
FIG. 25(c)
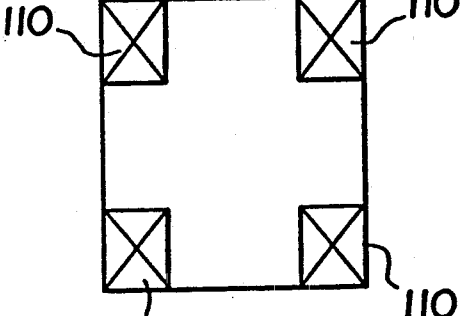
FIG. 25(d)

CONSTRUCTION APPARATUS FOR BUILDINGS AND CONSTRUCTING METHOD THEREWITH

BACKGROUND OF THE INVENTION

The present invention relates to apparatuses for constructing buildings and methods for constructing buildings. More specifically, the present invention applies to construction of various multistory buildings.

One example of a conventional methods for constructing buildings was proposed in JP-A-2-70844. As illustrated in FIG. 1, according to this conventional method, a beam-framework (temporary roof) 1 is assembled on the top of a building 4 which has been already constructed. A plurality of actuators 2 are mounted on the temporary roof 1, so as to extend vertically and downwardly from the temporary roof 1. Extendable rods 3 of the actuators 2, which can extend and retract, are disposed downward from the actuators 2. As shown in the right part of FIG. 1, the distal ends (lower ends) of the rods 3 are temporarily fixed to upper ends of permanent columns 5 of the building 4 by means of nuts and bolts, so that the actuators 2 can become temporary columns for supporting the temporary roof 1.

The temporary roof 1 is then lifted maintaining the horizontal arrangement thereof by means of actuating of the actuators 2 in synchrony. Accordingly, a work space 6, coincident with the space to be occupied by a single story is provided between the building 4 and the temporary roof 1.

Next, as shown in the left part of FIG. 1, one of the lower ends of the rods 3 is released from the corresponding permanent column 5, and the rod 3 is so retracted that a gap is formed between the upper end of the permanent column 5 and the lower end of the rod 3. A new permanent column 8 is erected in the gap by means of a crane apparatus 7, which lifts the new permanent column 8, and by means of a robot 9, which adjusts the attitude of the permanent column 8. The lower end of the new permanent column 8 is affixed to the upper end of the lower permanent column 5, and the lower end of the rod 3 is temporarily fixed to the upper end of the new permanent column 8. This process is repeated for the remaining rods 3 one by one, so that a plurality of new permanent columns 8 for the new story 6 are erected on the upper ends of the lower permanent columns 5, respectively. In addition, the rods 3 of the actuators 2 are supported by the new permanent columns 8. In this state, flooring and mounting of permanent beams are accomplished for the story 6.

Then, the temporary roof 1 is lifted again maintaining the horizontal arrangement thereof by means of actuating of the actuators 2 in synchrony. After that, the above-described process is repeated, whereby another upper story can be constructed.

However, the above-described method presents the following drawbacks.

That is, it is necessary to provide the large actuators 2 with a very long stroke which is greater than the height of one story of the building. In addition, the number of the actuators 2 used as temporary columns must equal that of the permanent columns 5.

It is troublesome to retract the rods 3 of the actuators 2 one by one and to erect the new permanent columns 8 one by one. In addition, in this case, the working personnel must move from one column to another column. Furthermore, every actuator 3 needs auxiliary equipment, for example, a fastening robot for the nuts and bolts to fix the rods 3 of the actuators 2 to the permanent columns 5 and 8, a releasing robot to release the rods 3 from the permanent columns 5 and 8, and a welding robot for welding the permanent columns 5 and 8. Hence, the amount of equipment is inevitably large, and thus, the costs for the system are high. In addition, since it is necessary to fasten and release the rods 3 of the actuators 2 to and from the columns 5 and 8, the operation is complicated and thus, the constructing costs are high.

SUMMARY OF THE INVENTION

It is therefore an object of the present invention to provide apparatuses for constructing buildings and methods for constructing buildings, in which the number of the components and thus the costs for the components can be reduced, and the operational efficiency can be enhanced.

According to the present invention, an apparatus for constructing a building, the building including a framework constituted of permanent columns and permanent beams, the apparatus comprises:

a temporary framework which is constructed and located above the building under construction;

at least one lifting means for lifting the temporary framework, the lifting means capable of being supported by the building and being able to lift the lifting means itself along a column located in the building; and at least one hoisting means for hoisting structural elements of the building, including the permanent columns and the permanent beams, the hoisting means conveying the structural elements to desired positions in one story of the building under construction, the hoisting means being provided at the temporary framework.

Preferably, the apparatus comprises a plurality of said lifting means, each of the lifting means comprises a pair of guides detachably attached to the permanent column of the building; a column fixed to the guides so as to be parallel to the permanent column; a screw rod having a longitudinal axis disposed parallel to the permanent column rotatably about the longitudinal axis; and a climbing device attached to the temporary framework, the climbing device having a jack for lifting the temporary framework, thereby lifting the temporary framework when the guides are attached to the permanent column, the climbing device being able to be raised and lowered with the screw rod, whereby the lifting means is lifted when the guides are detached from the permanent column.

In one aspect, the hoisting means is a crane.

In one aspect, the temporary framework is provided with a roof.

In another aspect, the apparatus further comprises at least one vertical transferring means for vertically transferring the hoisting means, and a horizontal transferring means, which is provided under the temporary framework, for horizontally transferring the hoisting means to desired positions in one story of the building under construction, the hoisting means being able to move to and from the vertical transferring means and the horizontal transferring means.

Preferably, the vertical transferring means comprises a cable suspended from the temporary framework for transferring the hoisting means, and a winch for winding the cable.

In one aspect, the vertical transferring means comprises a gate unit, a cable suspended from the gate unit for transferring the hoisting means, and a winch for winding the cable.

In one aspect, the gate unit of the vertical transferring means is disposed at the side of the building under construction.

Preferably, the horizontal transferring means comprises a plurality of rails disposed under the temporary framework longitudinally and transversely, the rails being so arranged that the hoisting means can move from one of the rails to another.

More preferably, the horizontal transferring means further comprises rotation rails located at intersections of the rails, each of the rotation rails being able to rotate in a plan parallel to the temporary framework so that the hoisting means can move from one of the rails to another through the rotation rail.

In another aspect, the horizontal transferring means comprises a plurality of rails disposed parallel to one another under the temporary framework, a plurality of shift rails disposed under the temporary framework perpendicular to the rails, and auxiliary rails suspended from the shift rails movably along longitudinal axes of the shift rails, whereby the hoisting means can move from one of the rails to another rail through one of the auxiliary rails.

In another aspect, the horizontal transferring means comprises a plurality of shift rails disposed parallel to one another under the temporary framework, and auxiliary rails suspended from the shift rails movable along longitudinal axes of the shift rails, whereby the hoisting means can move from one of the auxiliary rails to another auxiliary rail.

In another aspect of the present invention, the lifting means comprises a temporary column erected above a permanent beam of the building; upper and lower lifting frames which are detachably attached to the temporary column, the upper and lower lifting frames being able to be supported by the permanent beams of the building; climbing means existing between the upper and lower lifting frames, for climbing the upper and lower lifting frames along the temporary column; and locking means provided at the upper and lower lifting frames, for locking the upper and lower lifting frames to the temporary column.

According to the present invention, a method for constructing a building comprises the steps of:

assembling a construction apparatus including a temporary framework located above the building under construction; at least one lifting means for lifting the temporary framework, the lifting means capable of being supported by the building, the lifting means being able to lift the lifting means itself along a column located in the building; and at least one hoisting means at the temporary framework for hoisting structural elements of the building, including the permanent columns and the permanent beams;

transferring the structural elements to desired positions in one story of the building under construction by means of the hoisting means;

additionally incorporating the transferred structural elements into the building;

lifting the temporary framework by means of the lifting means supported by the building; and lifting the lifting means by means of the lifting means itself.

In one aspect, the structural elements are structural units assembled on the ground.

In one aspect, the building comprises a core portion and a peripheral portion, the core portion being taller than the peripheral portion, the construction apparatus being constructed and located above the core portion, wherein after additional constructing of the peripheral portion, the core portion is construction, and then the temporary framework is lifted by means of the lifting means supported by the core portion.

Preferably, the method further comprises the steps of:

preparing at least one vertical transferring means for vertically transferring the hoisting means, and a horizontal transferring means under the temporary framework for horizontally transferring the hoisting means;

transferring the hoisting means with the structural elements by means of the vertical transferring means and the horizontal transferring means to desired positions in one story of the building under construction.

In another aspect, the building comprises a core portion and a peripheral portion, the core portion being taller than the peripheral portion, a first construction apparatus being constructed and located above the core portion, a second construction apparatus being constructed and located above the peripheral portion, wherein after additional constructing of the peripheral portion by means of the second construction apparatus, the core portion is additionally constructed by means of the first construction apparatus, maintaining that the core portion is taller than the peripheral portion, and then the construction apparatuses are lifted by means of the lifting means.

In another aspect, the building comprises a core portion and a peripheral portion, the core portion being taller than the peripheral portion before the step of the assembling of the construction apparatus. The method comprises the steps of:

constructing an uppermost story portion above the peripheral portion of the building under construction, the uppermost story portion being able to elevate in relation to the core portion, the uppermost story portion being provided with a hoisting means, the construction apparatus being assembled above the uppermost story portion;

additionally constructing the core portion by means of the construction apparatus; and additionally constructing the peripheral portion by means of the hoisting means of the uppermost story portion, wherein the lifting of the temporary framework is achieved by lifting the uppermost story portion.

BRIEF DESCRIPTION OF THE DRAWINGS

FIG. 11(*b*) is a front view of the apparatus shown in FIG. 8, showing structural elements which are transferred to and incorporated into the building

FIGS. 25(*a*) to 25(*d*) are plan views of examples of arrangements of the building shown in FIG. 16;

DETAILED DESCRIPTION OF THE PREFERRED EMBODIMENTS

With reference to the accompanying drawings, various preferred embodiments of the present invention will be described in detail.

FIGS. 2 through 7 depict a construction apparatus according to an embodiment of the present invention.

Figure 2:
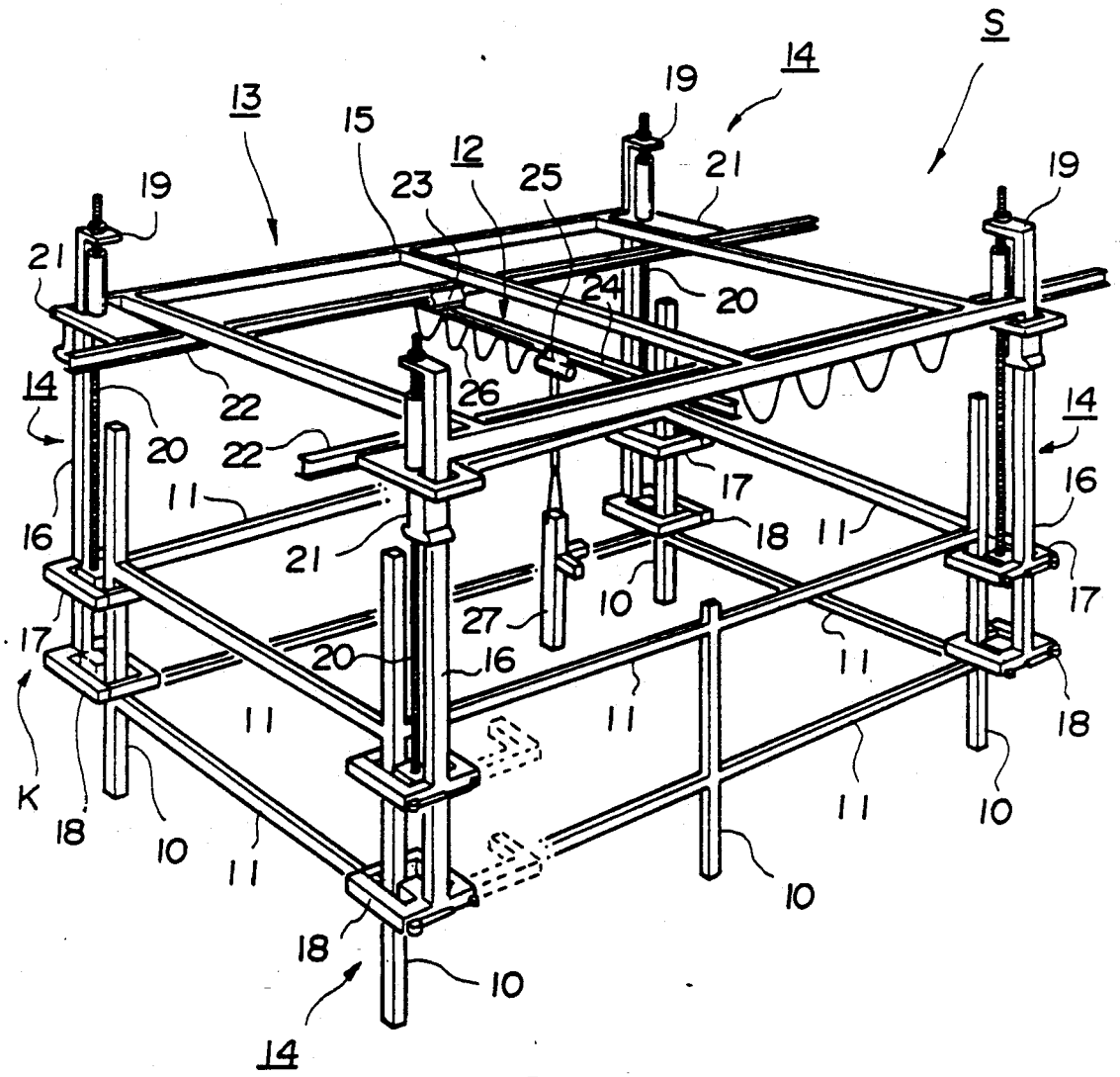
FIG. 2 is a perspective view of a construction apparatus according to a first embodiment of the present invention.

In FIG. 2, reference numeral 10 designates permanent columns. These permanent columns 10 are vertically erected at the four corners of a rectangular shape when viewed from above. Between the permanent columns 10, a plurality of permanent beams 11 are coupled and disposed horizontally. The permanent columns 10 and the permanent beams 11 compose a framework of a building K which is being constructed. Each of the permanent columns 10 and the permanent beams 11 is of a square cross section.

The construction apparatus S according to the present invention comprises a temporary framework 13 disposed above the framework of the building K; four lifting mechanisms 14 for supporting and lifting the temporary framework 13; and a crane apparatus 12 supported by the temporary framework 13.

The temporary framework 13 comprises a beam-framework 15 of a generally rectangular shape in a plane view, and four columns 16 supporting four corners of the beam-framework 15 The beam-framework 15 has a width slightly larger than that of the framework of the building K. Each of the columns 16 is disposed outside of the framework of the building K in the direction of the width of the framework of the building K, and is supported by one of the permanent columns 10. The columns 16 are spaced apart from the permanent columns 10 at a regular interval. Each of the columns 16 is also of a square cross section.

Each of the lifting mechanisms 14 comprises upper and lower guides 17 and 18 detachably attached to the lower portion of the respective column 16. At each of the upper ends of the column 16, a bracket 19 is provided so as to project inwardly. A screw rod 20 is provided between the bracket 19 and the upper detachable guide 17 attached to each column 16 so as to be parallel to the column 16. Climbing devices 21 for supporting the corners of the temporary framework 13, thereby raising and lowering the temporary framework 13, are screwed to the screw rods 20, respectively.

The crane apparatus 12 comprises a pair of I-beam rails 22 disposed parallel to each other and mounted on the lower surfaces of the beam-framework 15; a crane rail 24 spanning between the rails 22; and a winch 25. The flanges of the I-beam rails 22 are disposed horizontally. The crane rail 24 is slidably attached to the rails 22 through travelling bogies 23 so as to be able to travel along the longitudinal direction of the rails 22. The winch 25 is suspended from the crane rail 24 so as to be able to travel along the longitudinal axis of the crane rail 24. An electric power cable 26 is provided for supplying power to the winch 25 and the crane rail 24.

With the above-described construction apparatus S, the temporary framework 13 is supported on the permanent beams 11 which are in the lowermost story of the building K in such a manner that lower detachable guides 18 for the four columns 16 of the temporary framework 13 are disposed on the upper surfaces of the permanent beams 11. In this condition, the winch 25 of the crane beam 24 raises structural elements 27 from the ground, thereby constructing the building K.

Figure 3:
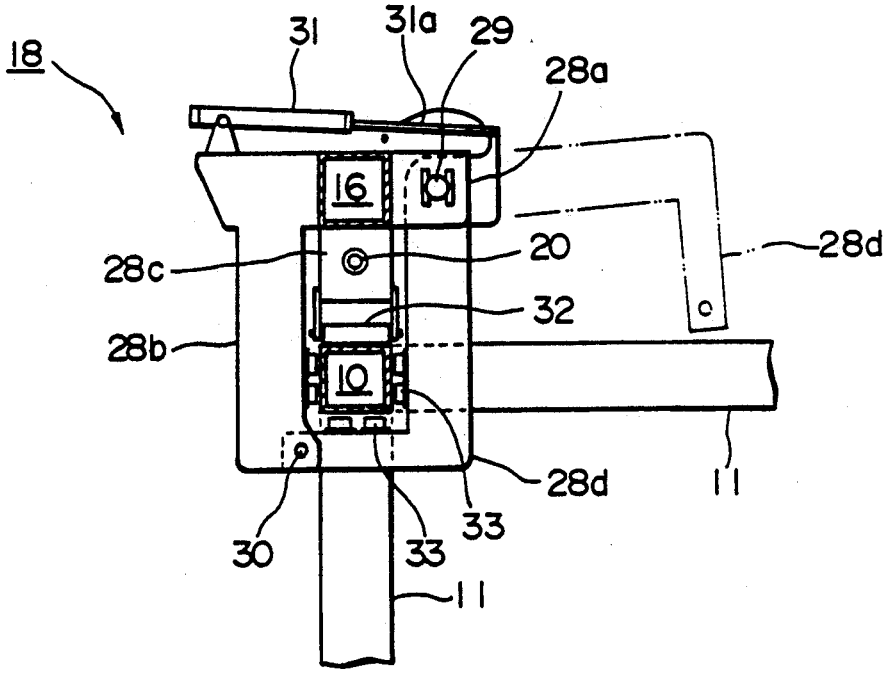
FIG. 3 is a plan view of a detachable guide used in the apparatus shown in FIG. 2.
Figure 4:
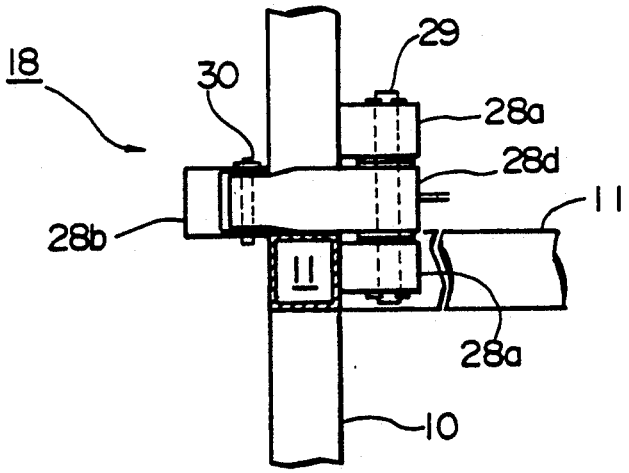
FIG. 4 is a side view of the detachable guide shown in FIG. 3.

FIGS. 3 and 4 depict the lower detachable guide 18 in greater detail. Although the upper detachable guide 17 is not shown, the structure of the upper detachable guide 17 is similar to that of the lower detachable guide 18.

As shown in the drawings, each of the detachable guides 18 comprise upper and lower fixed guide members 28*a*, a fixed guide member 28*b*, a fixed guide member 28*c*, and a movable guide member 28*d*.

The upper and lower fixed guide members 28*a* are fixed to the same side of the square column 16. The fixed guide member 28*c* is fixed to another side of the column 16 which is perpendicular to the side to which the guide members 28*a* are fixed. The fixed guide member 28*b* is fixed to the side opposite to the side to which the guide members 28*a* are fixed. The fixed guide member 28*b* extends more than the fixed guide member 28*c* as shown in FIG. 3. The movable guide portion 28*d* of an L-shape is rotatably connected to the upper and lower guide members 28*a* via a shaft 29 which is provided between the upper and lower fixed guide members 28*a* The distal portion of the movable guide member 28*d* may be connected to one distal end of the fixed guide member 28*b* by a detachable stopper pin 30. Accordingly, the movable guide member 28*d*, the fixed guide members 28*b* and 28*c* cooperate to surround the periphery of the permanent column 10.

In addition, at the outer surface of the base portion of the fixed guide member 28*b*, a proximal portion of a hydraulic actuator 31 is connected. The distal rod 31*a* of the hydraulic actuator 31 is connected to the distal end of the movable guide member 28*d*. Therefore, if the stopper pin 30 is removed, the hydraulic actuator 31 can rotate the movable guide member 28*d*.

Furthermore, at the distal end of the fixed guide member 28*c*, a guide roller 32 is pivotally attached, so that the guide roller 32 slides on the permanent column 10. Guide shoes 33 are attached to the inner surfaces of the fixed guide member 28*b* and the movable guide member 28*d*, so as to be contact with the periphery of the permanent column 10.

Figure 1:
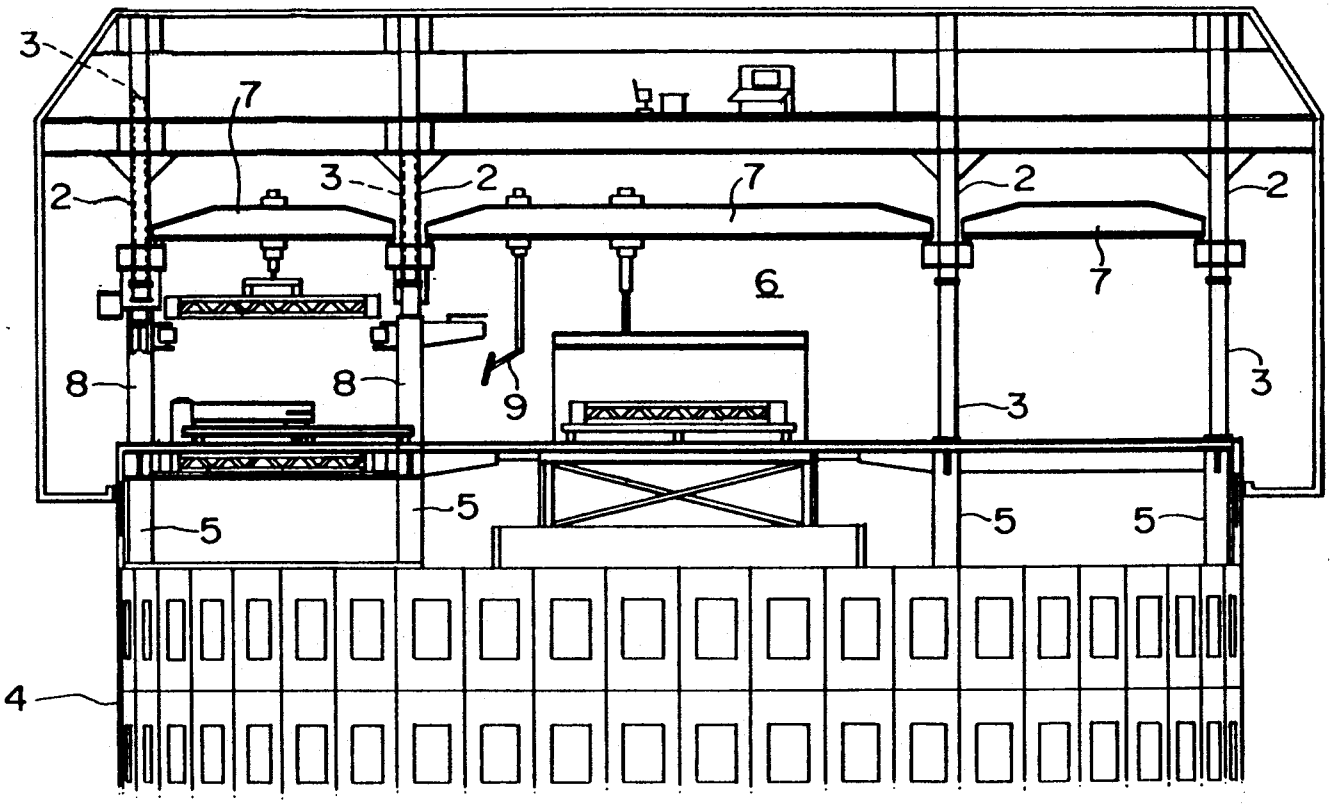
FIG. 1 (PRIOR ART)
FIG. 1 is a side view of a construction apparatus according to the prior art which is located on a building under construction.

In accordance with the detachable guide 18, when the movable guide member 28*d* is closed to the fixed guide member 28*b* and the stopper pin 30 couples the movable guide member 28*d* and the fixed guide member 28*b*, the L-shaped movable guide member 28*d* is located on the corner formed by the permanent beams 11. Accordingly, the load of the temporary framework 13 is supported by the permanent beams 11, whereby the temporary framework 13 is located above the building K under construction as shown in FIG. 1.

In addition, if necessary, the detachable guides 17 and 18 can climb along the permanent column 10 in such a manner that the guide roller 32 and the guide shoes 33 slide on the outer surfaces of the permanent column 10.

Furthermore, the movable guide member 28*d* can be rotated about the shaft 29 and can be opened by retracting the hydraulic actuator 31 as shown by the dotted lines in FIG. 3. Therefore, the detachable guides 17 and 18 can move upwardly or downwardly avoiding the interference by the permanent beams 11.

Figure 5:
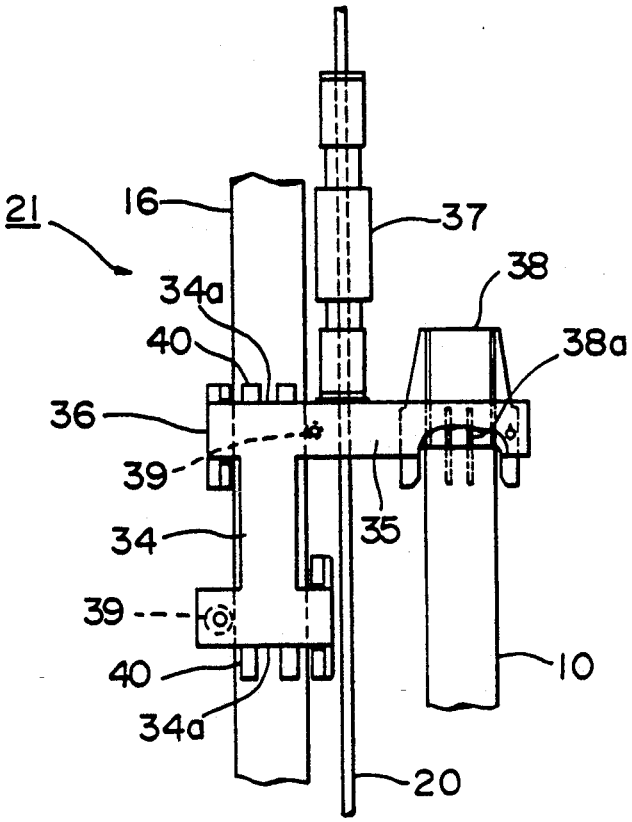
FIG. 5 is a front view of a climbing device used in the apparatus shown in FIG. 2.
Figure 6:
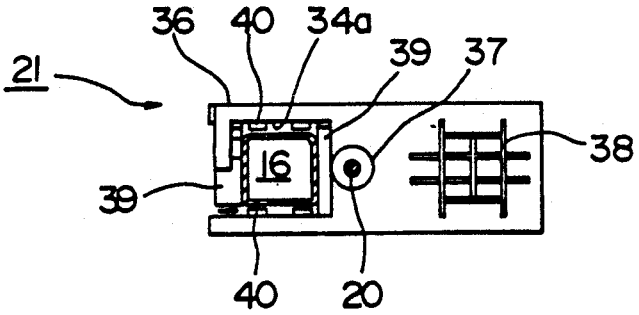
FIG. 6 is a top view of the climbing device shown in FIG. 5.

FIGS. 5 and 6 depict the aforementioned climbing device 21 in greater detail. Each of the climbing devices 21 comprises a generally L-shaped body 36 holding the column 16; a jack 37 screwed with the screw rod 20; and a connecting portion 38 located on the top of the permanent column 10.

The L-shaped body 36 includes a vertical portion 34 having upper and lower openings 34*a* through which the column 16 is inserted. Guide rollers 39 and guide shoes 40 are disposed within each of the openings 34*a* formed at the vertical portion 34 of the body 36. The L-shaped body 36 further includes a horizontal portion 35 extending horizontally from the upper end of the vertical portion 34. The jack 37 is provided with the upper surface of the horizontal portion 35 of the body 36. The connecting portion 38 is provided with the distal end of the horizontal portion 35. The connecting portion 38 fits with the top of the permanent column 10 and is fixed to the top of the permanent column 10 by means of pins 38*a*. The construction apparatus S constructed above is remote-controlled by an operator watching a remote monitor.

Next, the construction method used with the construction apparatus S will be described with reference to FIGS. 7(*a*) through 7(*f*).

First, the first and second stories of a building, having permanent columns 10, permanent beams 11, and floorings, is built on a foundation slab 50 in a conventional manner.

Figure 7:
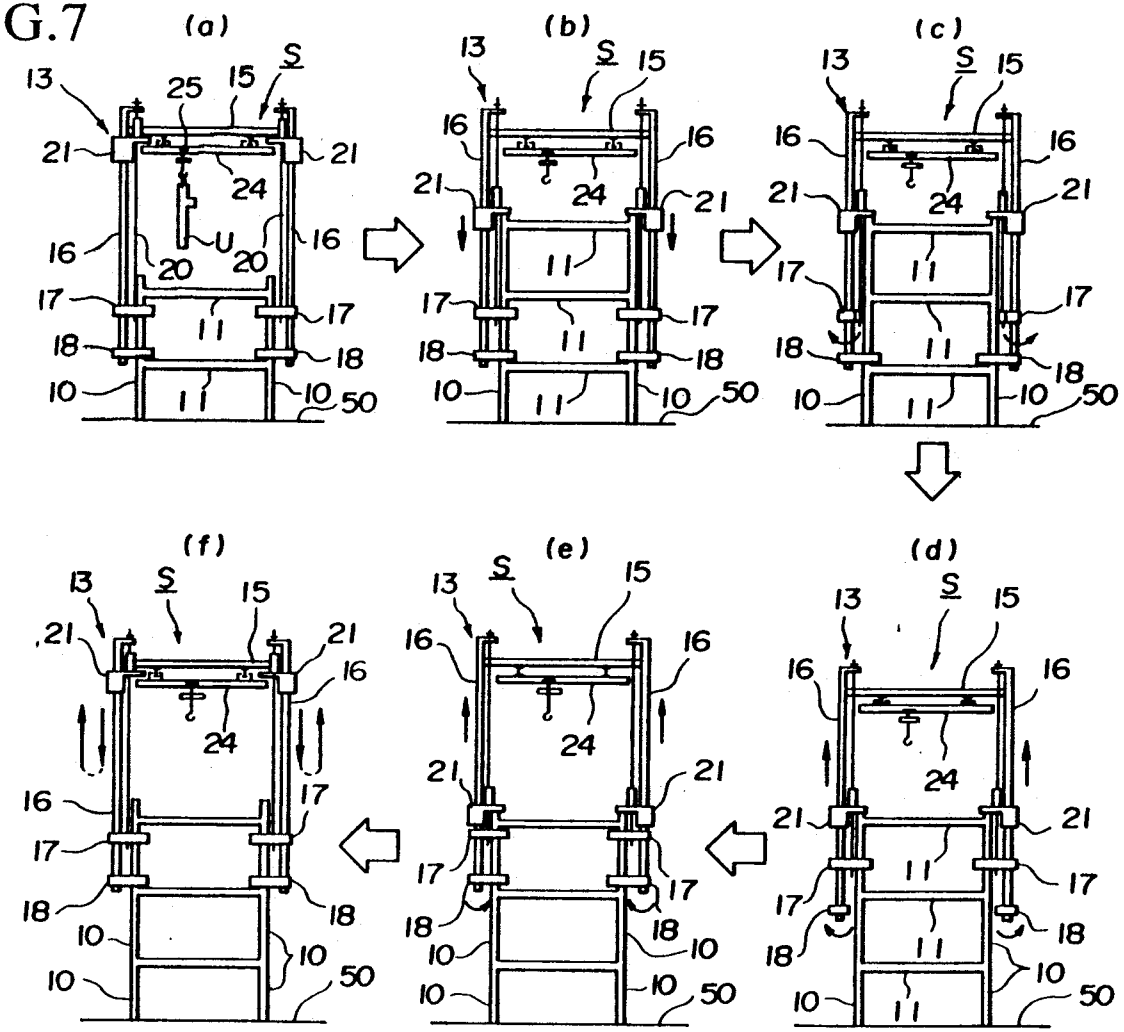
FIGS. 7(*a*) to 7(*f*) are side views showing the elevating method and method of use of the apparatus shown in FIG. 2.
Figure 8:
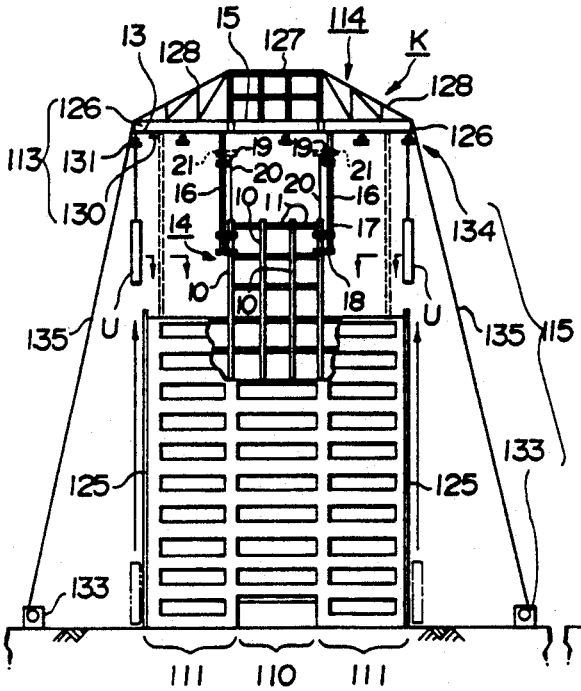
FIG. 8 is a front view of a construction apparatus according to a second embodiment of the present invention which is located on a building under construction.
Figure 9:
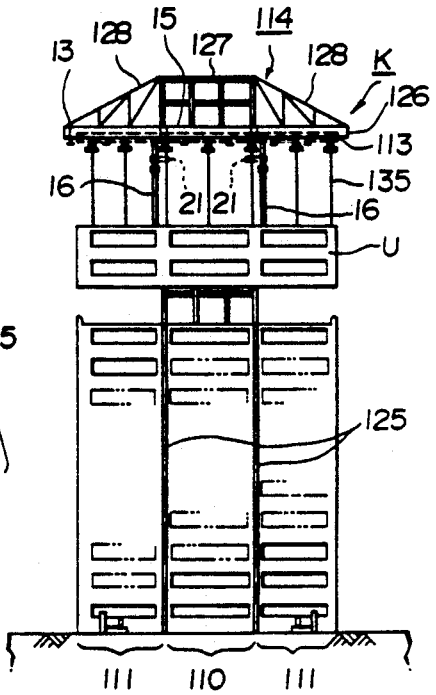
FIG. 9 is a side view of the apparatus shown in FIG. 8.

Next, as shown in FIG. 7(*a*), the construction apparatus S is assembled above the second story of the building. That is, the upper and lower detachable guides 17 and 18 provided with the columns 16 are attached to the permanent columns 10 of the second story. At the same time, the lower detachable guides 18 are supported on the permanent beams 11 of the first story. Accordingly, the load of the temporary framework 13 is supported by the permanent beams 11 of the first story, whereby the temporary framework 13 is located above the second story of the building. Under the temporary framework 13, a work space for building the third story of the building is formed.

Then, the third story of the building is constructed. That is, new structural elements U, for example, columns, beams, floorings, and the like are lifted up from the ground by the winch 25 of the crane apparatus 24. New permanent columns 10 are fixed to the upper ends of the columns of the second story. New permanent beams 11 are fixed between the new permanent columns 10 of the third story. Flooring is arranged on the permanent beams 11 of the second story 6. In this case, since the temporary framework 13 is supported by the permanent beams 11 of the first story, the new permanent columns 10 can be directly connected to the upper ,ends of the permanent columns 10 of the second story. After erecting the new permanent columns 10, the climbing devices 21 are moved to the upper ends of the columns 16, so that the movement of the crane 24 is not interfered with.

Then, the construction apparatus S is moved up as shown in FIG. 7(*f*). That is, as shown in FIG. 7(*b*), the climbing devices 21 are moved downwardly so that the connecting portions 38 of the bodies 36 of the climbing devices 21 come into contact with the tops of the permanent columns 10 of the third story. Next, the upper detachable guides 17 are opened and the climbing devices 21 are additionally driven to move downwardly. Then, the temporary framework 13 is relatively raised, so that the upper detachable guides 17 can be released from the permanent columns 11 of the second story as shown in FIG. 7(*c*).

During the raising of the temporary framework 13, the opened upper detachable guides 17 close to hold the permanent columns 10 of the third story after passing the height of the permanent beams 11 of the second story as shown in FIG. 7(*d*). The lower detachable guides 18 then open to release the permanent columns 11 of the second story. As shown in FIG. 7(*e*), the opened lower detachable guides 18 close to hold the permanent columns 11 of the third story after passing the height of the permanent beams 11 of the second story. Then, the driving of the climbing devices 21 is stopped, thereby stopping the raising of the temporary framework 13.

Then, the climbing devices 21 are driven to move upwardly, so that the temporary framework 13 is once moved downwardly, whereby the lower detachable guides 18 are supported on the permanent beams 11 of the second story. Therefore, the supporting of the temporary framework 13 is changed from the tops of the permanent columns 10 of the third story to the permanent beams 11 of the second story as shown in FIG. 7(*f*). Once enough space for constructing the fourth story is formed between the third story and the temporary framework 13, the raising of the climbing devices 21 are stopped.

The above process is repeated, so that a plurality of stores are constructed from the second story of the building. Finally, by means of the crane apparatus, the permanent columns 10, permanent beams 11, and the floorings for the top story are lifted, and then are assembled to the top story. After finishing the top story, the construction apparatus S is disassembled and removed.

In this embodiment, when connecting the columns and the beams of the upper story to the columns of the lower story, the temporary framework 13 is supported on the beams of the lower story, not on the upper ends of the columns of the upper story. Consequently, wide work space without any interference can be provided above the lower story. Accordingly, raising operation and transverse moving operation by means of the crane apparatus can be quickly achieved without any limitations.

In addition, the upper ends of the temporary columns 10, and the end portions of the permanent beams 11 are disclosed so that structural elements lifted by the crane apparatus 12 can be directly connected to the upper ends of the temporary columns 10, and the end portions of the permanent beams 11. In addition, the connecting operations can be accomplished simultaneously.

In addition, according to this embodiment, the number of the columns 16 of the temporary framework 13 can be selected regardless of the number of permanent columns 10. That is, the permanent columns 10 which are selected for the connection of the columns 16 may be freely selected. The structural elements of the construction apparatus can be minimized. In addition, the lifting mechanism 14 including the detachable guides 17 and 18, the screw rod 20, the climbing device 21 may be minimized in number.

Furthermore, by virtue of the remote control of the detachable guides 17 and 18, and the climbing devices 21 according to a predetermined program, the climbing of the temporary framework 13 can be smoothly and readily achieved. This may be facilitated by automation of the climbing operation.

Next, with reference to FIGS. 8 to 15, a second embodiment according to the present invention will be described.

In FIGS. 8 to 11, reference numeral 110 designates a core portion of a building. Around the core portion 110, peripheral portions 111 are built so as to connect with the core portion 110. Thus, the core portion 110 and the peripheral portions 111 constitute a framework of the building K. The core portion 110 is taller than the peripheral portions 111 by a height of one or more stories.

A construction apparatus S according to the second embodiment is located above the framework of the building K. The construction apparatus S comprises a temporary framework 13, a roof 114 for the temporary framework 13 disposed above the temporary framework 13, a vertical transferring device 115 having a lifting pivot at the periphery of the roof 114, and a horizontal transferring device 113 disposed under the temporary framework 13. The construction apparatus S further comprises lifting mechanisms 14 for lifting the temporary framework 13. The basic construction of the construction apparatus S is the same as that of the first embodiment. Therefore, the same symbols designate like structural elements, and the description of those elements may be omitted.

The core portion 110 is located at the center of the building which is of a square shape in plane view. The core portion 110 is constituted of a plurality of permanent columns 10 and a plurality of permanent beams 11. The core portion 110 is also of a square shape, in which the length of a side is three times the interval between the permanent columns 10.

The temporary framework 13 comprises a beam-framework 15 of a generally square shape in plan view, and four columns 16 supporting four corners of the beam-framework 15. The beam-framework 15 has a width slightly larger than that of the framework of the core portion 110. Each of the columns 16 is disposed outside of the framework of the core portion 110, and is supported by one of the permanent columns 10. The column 16 are spaced apart from the permanent columns 10 at a regular interval. Each of the columns 16 is also of a square cross section.

Each of the lifting mechanisms 14 comprises upper and lower guides 17 and 18 detachably attached to the lower portion of the respective column 16. At each of the upper ends of the column 16, a bracket 19 is provided so as to project inwardly. A screw rod 20 is provided between the bracket 19 and the upper detachable guide 17 attached to each column 16 so as to be parallel to the column 16. Climbing devices 21 for supporting the corners of the beam-framework 15, thereby raising and lowering the temporary framework 13.

Figure 10:
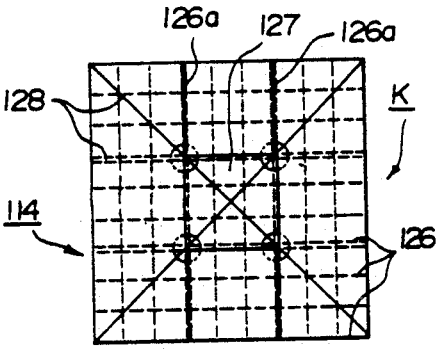
FIG. 10 is a top view of the apparatus shown in FIG. 10.

The roof 114 is constructed of girders 126, a penthouse 127 located on the girders 126, and reinforcing trusses 128 disposed radially between the corners of the penthouse 127 and the periphery of the roof 114. As can be seen in FIG. 10, among the girders 126, four girders **126*a* passing through the columns of the penthouse 127 reinforce the entire structure of the roof 114**.

The horizontal transferring device 113 comprises a large number of I-beam rails 130 and a hoist 131 slidably suspended from the rails 130.

Figure 11A:
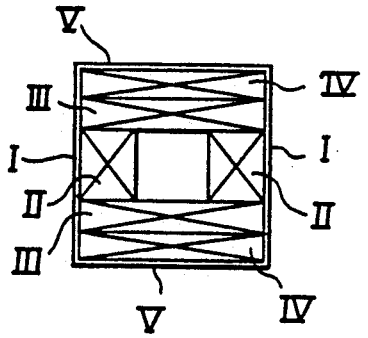
FIG. 11(*a*) is a top view showing the service of construction of the building shown in FIG. 8.
Figure 11B:
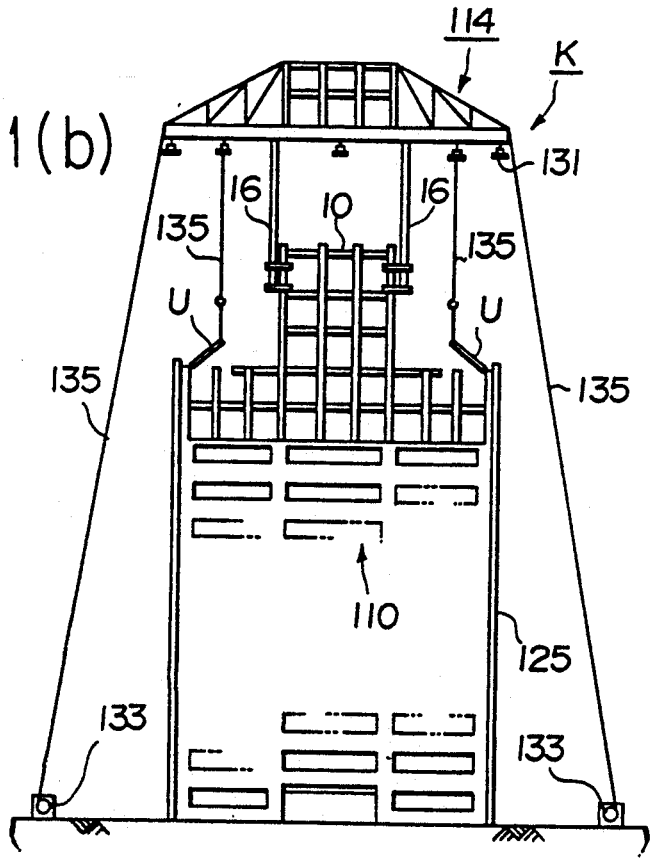

The vertical transferring device 115 comprises a winch 133 disposed on the ground, a hoisting beam 134 for hoisting structural units U, a cable 135 wound around the winch 133 and supporting the hoisting beam 134. The girder 126 may function as a pulley for the cable 135. In addition, at the side face of the building K, vertical rails 125 are disposed for auxiliary support of the structural unit U when conveying the structural unit U vertically. By means of the vertical transferring device 115, as shown in FIGS. 11(*a*) and 11(*b*), the structural unit U may be assembled and transferred. In this case, as illustrated in FIG. 11(*a*), after constructing the core portion 110, the building is constructed in the order designated by symbols I, II, III, and IV.

Figure 12:
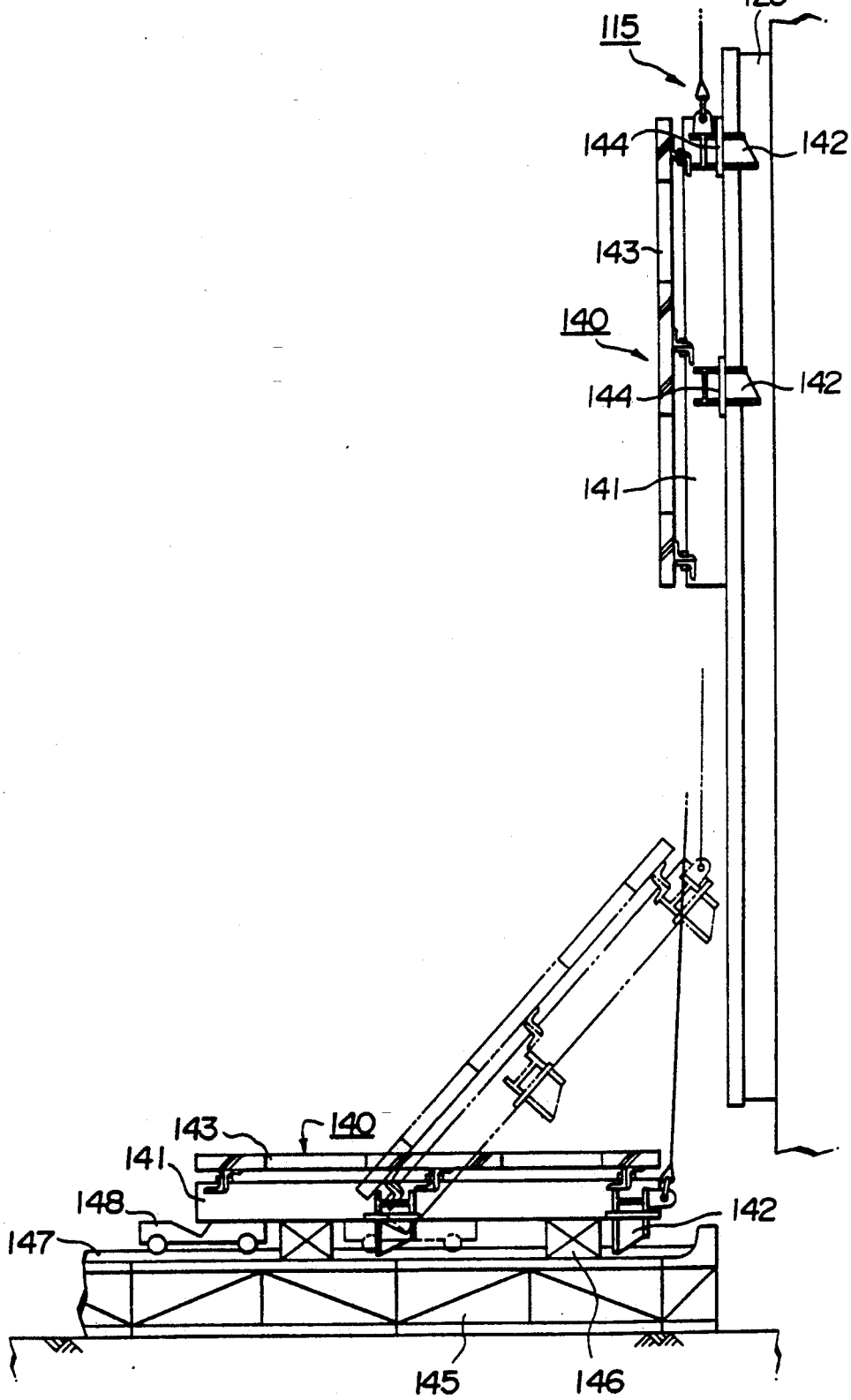
FIG. 12 is a side view of a vertical rail used in the apparatus in FIG. 8.

FIG. 12 is a side view of the vertical rail 125 located at the wall of the building. In the drawing, reference numeral 140 designates a wall block (structural unit). The wall block 140 is constituted of a plurality of columns 141, a plurality of beams 142, and a wall element 143. The wall block 140 is hoisted and transferred upwardly in such a manner that engagement members 144 attached to the side faces of the beams 42 are engaged with the vertical rail 125.

In addition, below the vertical rail 125, an assembly stage 145, cross ties 146, a horizontal rail 147 for orienting the wall block 140 vertically, and an orienting cab 148 are disposed. By virtue of the above arrangement, the wall block 140 is hoisted along the vertical rail 125 from the state shown by solid line to dotted line in FIG. 12.

Figure 13:
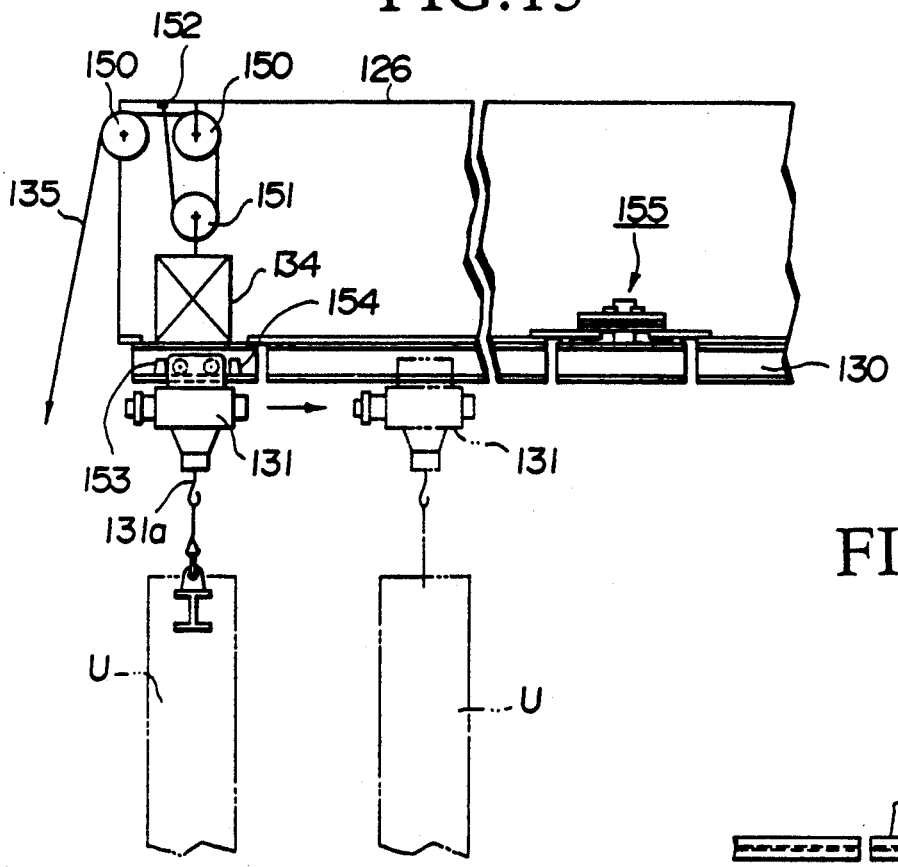
FIG. 13 is a side view of a connection between a vertical transferring device and a horizontal transferring device used in the apparatus shown in FIG. 8.

FIG. 13 shows the detailed structure in the vicinity of the girder 126 and the vertical transferring device 115. The cable 135 passes fixed sheave 150, sheave 151 mounted on the hoisting beam 134. The end of the cable 135 is fixed to the fixing point 152 of the girder 126. Auxiliary I-beam rails 153 are fixed to the hoisting beam 134 at a regular interval so as to coincide with the I-beam rails 130. Each of the auxiliary rails 153 is similar in structure to the rail 130, but is slightly shorter than the rail 130. Hoists 131 are suspended from the auxiliary rails 153, respectively. Each of the hoists 131 is held at rest by a stopper provided at the auxiliary rail 153. The structural unit U is suspended from a hook 131*a* of the hoist 131.

As shown in FIG. 13, after positioning of the hoisting beam 134, the stopper 154 is released so that the hoist 131 is transferred toward one of the rails 130 of the horizontal transferring device 113.

Then, to the empty auxiliary rail 153 of the hoisting beam 134, another empty hoist 131 is transferred to be prepared to suspend another structural unit U.

Figure 14:
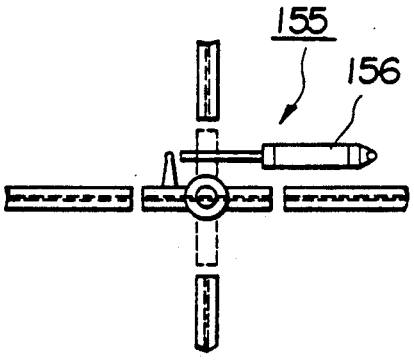
FIG. 14 is a plan view of a rotation rail used in the apparatus shown in FIG. 8.

In FIGS. 13 and 14, reference numeral 155 designates a rotation rail disposed at the intermediate portion of the rail 130. The rotation rail 155 is driven by an actuator 156. The rotation rail 155 is in the shape of a cross formed by a pair of I-beams perpendicular to each other. By virtue of the rotation rail 155, the transferring direction of the hoist 131 can be changed.

Figure 15:
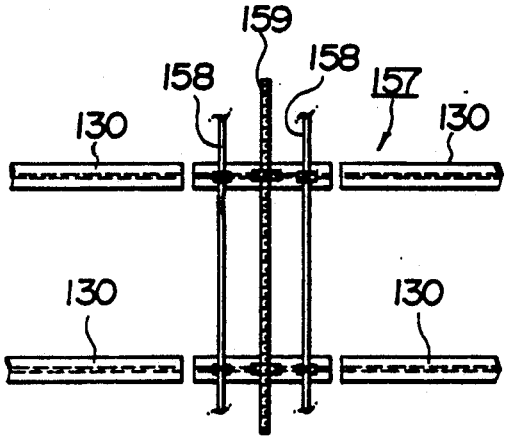
FIG. 15 is a plan view of shift rails used in the apparatus shown in FIG. 8.

In FIG. 15, reference numeral 157 designates shift rails disposed at the intermediate portions of the rails 130. Each of the shift rails 157 is engaged with a pair of guide rails 158 and a drive screw 159 which can rotate about the axis thereof. By means of the rotation of the drive screw 159, the hoist 131 may be transferred from one of the rails 130 to the other via the shift rail 157.

Accordingly, the hoist 131 can be optionally transferred to a desired construction position by the combination of the rails 130, the rotation rails 155, and the shift rails 157.

The above construction apparatus S is located above the core portion 110 of the building K. The supporting condition of the construction apparatus S is similar to that of the first embodiment. In addition, the elevating method of the construction apparatus S is similar to that of the first embodiment described with reference to FIGS. 7(*a*) to 7(*f*).

The construction apparatus S according to the second embodiment can achieve the same advantages as that of the first embodiment. Furthermore, it allows assembling operation of the structural elements, for example, the wall block on the ground. In addition, the transfer of the structural elements from the ground to the story under construction can be carried out continuously at a desired rate. The time required for the transfer, and thus, the time required for construction may be shortened.

In addition, in the second embodiment, the construction apparatus S is supported on the core portion 110 which is taller than the peripheral portions 111 by a height of one or more stories. Structural elements for the peripheral portions 111 can be smoothly transferred.

Next, with reference to FIGS. 16 through 25, a third embodiment of the present invention will be described.

Figure 16:
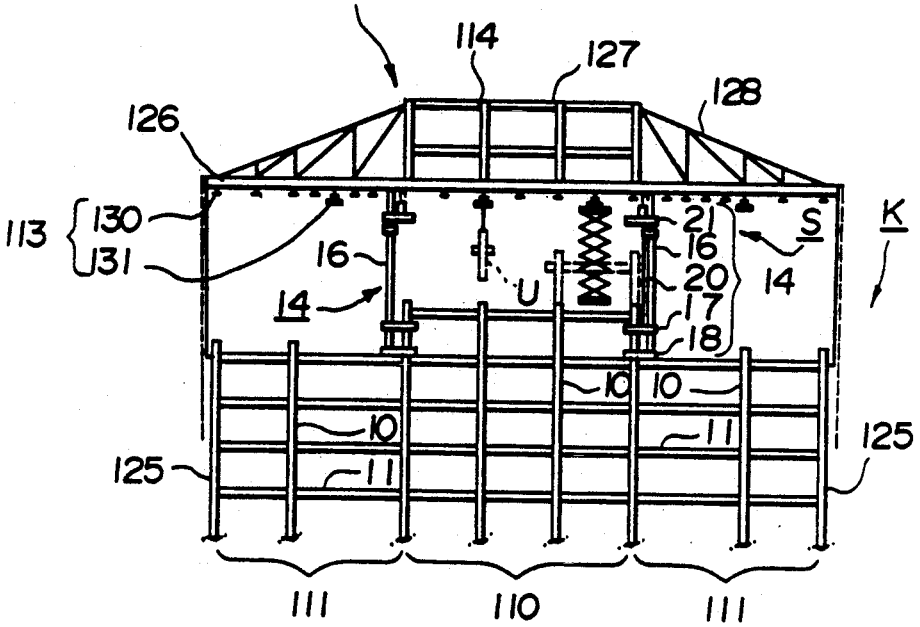
FIG. 16 is a front view of a construction apparatus according to a third embodiment of the present invention which is located on a building under construction.
Figure 17:
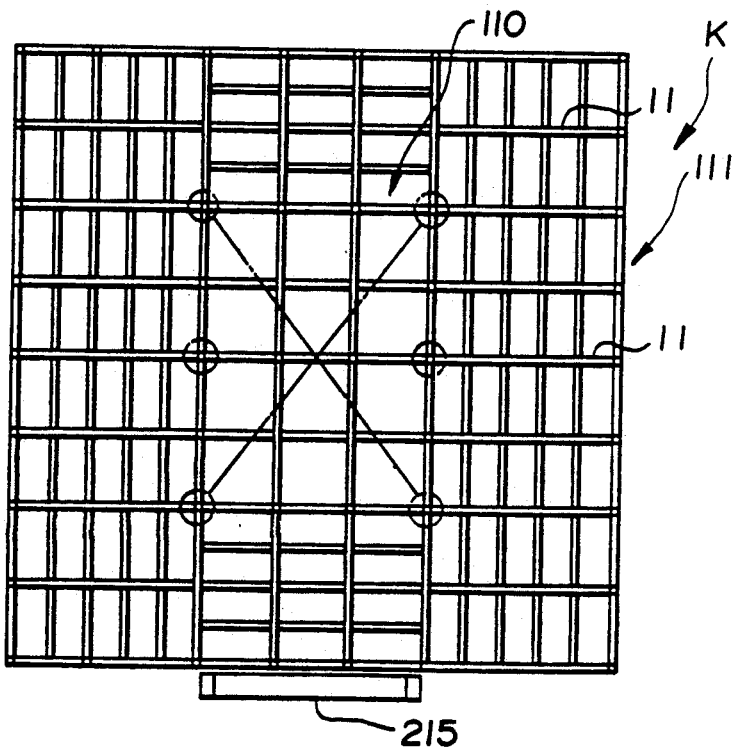
FIG. 17 is an overhead view of the building shown in FIG. 16.
Figure 18:
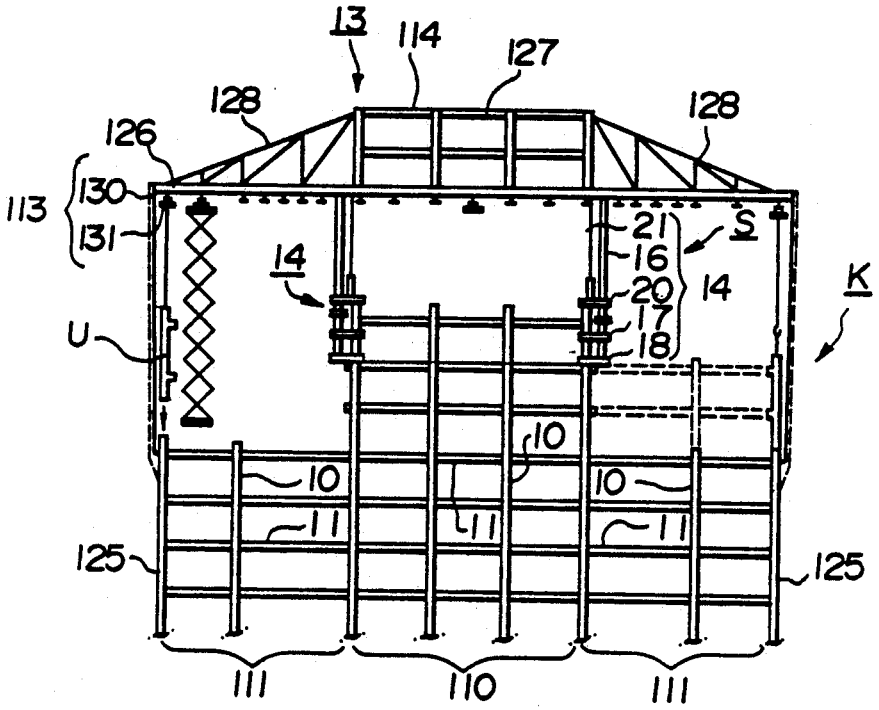
FIG. 18 is a front view of the apparatus shown in FIG. 16 under operation.

As shown in FIGS. 16 through 18, the framework of the building K under construction in accordance with the third embodiment comprises a core portion 110 and peripheral portions 111, similar to the second embodiment. In addition, vertical rails 125 are mounted on the sides of the peripheral portions 111.

Figure 19:
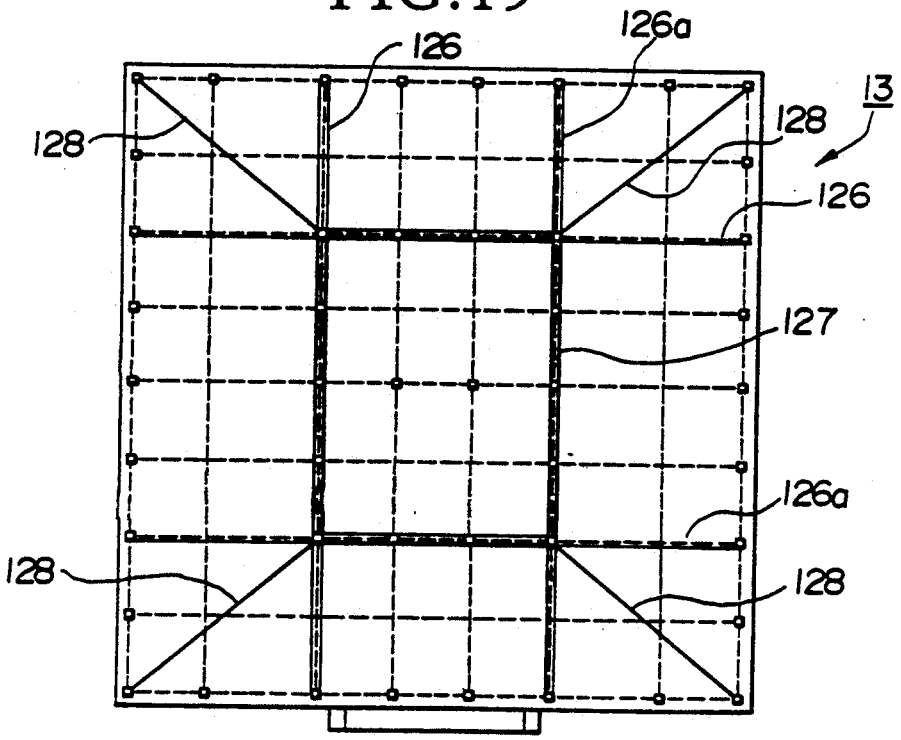
FIG. 19 is an overhead view of the apparatus shown in FIG. 16.

The construction apparatus S according to the third embodiment is located above the core portion 110 of the building K. As shown in FIGS. 16, 18, and 19, the basic structure of the construction apparatus S is the same as that of the second embodiment. That is, the construction apparatus S comprises lifting mechanisms 14 and a horizontal transferring device 113, similar to the second embodiment.

The construction apparatus S further comprises vertical transferring devices 215 at the sides of the building K. The detailed structure of the vertical transferring device 215 is described with reference to FIGS. 20 and 21.

The vertical transferring device 215 comprises a gate unit constituted of a large number of frame units 215*a*, climbing devices 215*b* for climbing the gate unit, a winch 133 disposed at the ground, a hoisting beam 134 for hoisting structural units U, and a cable 135 wound around the winch 133 and supporting the hoisting beam 134. The gate unit may function as a pulley for the cable 135.

For using the vertical transferring device 215, when the temporary framework 13 is lifted up, the climbing devices 215*b* climb the gate unit adding other frame units 215*a* to the lower ends of the gate unit. In this case, the height of the I-beams 130 of the horizontal transferring device 113 should be generally equal to the height of the hoisting beam 134.

Figure 21:
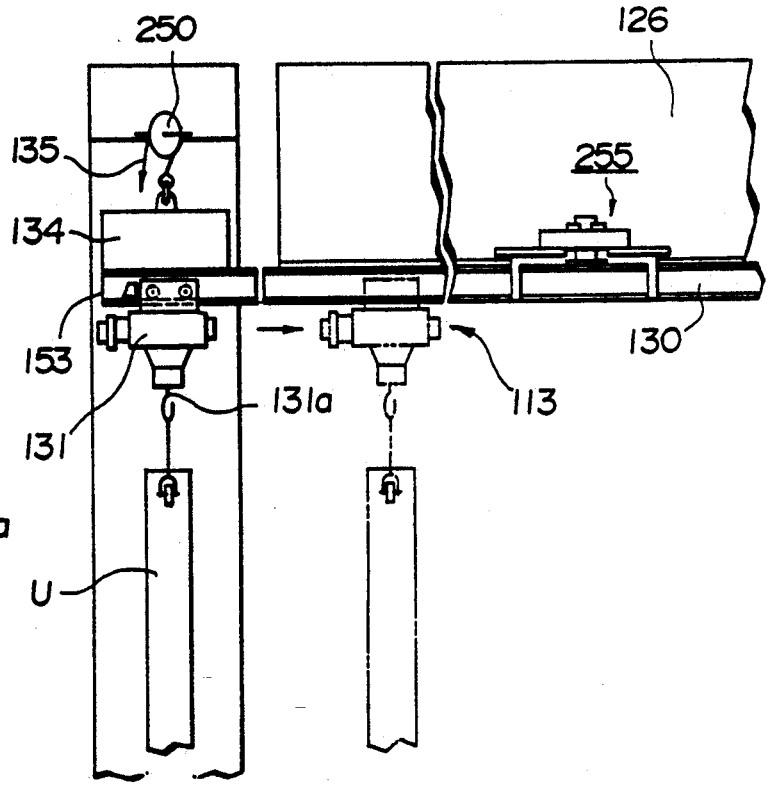
FIG. 21 is a side view of a connection between a vertical transferring device and a horizontal transferring device used in the apparatus shown in FIG. 16.

FIG. 21 depicts the detailed structure in the vicinity of the connection between the girder 126 of the roof 114 and the vertical transferring device 215. The cable 135 is wound around a fixed sheave 250. Auxiliary rails 153 are mounted on the lower surface of the hoisting beam 134 at a regular interval so as to meet with the rails 130. Hoists 131 are suspended from the auxiliary rails 153. A structural element U is suspended from a hook 131*a* of the hoist 131.

Therefore, similar to the second embodiment, the structural elements U can be transferred from the ground through the vertical transferring device 215 to the horizontal transferring device 113.

The horizontal transferring device 113 also comprises the rotation rails 155 and the shift rails 157, illustrated in FIGS. 14 and 15, similar to the second embodiment. Accordingly, the hoist 131 can be optionally transferred to a desired constructing position by the combination of the rails 130, the rotation rails 155, and the shift rails 157.

Figure 22:
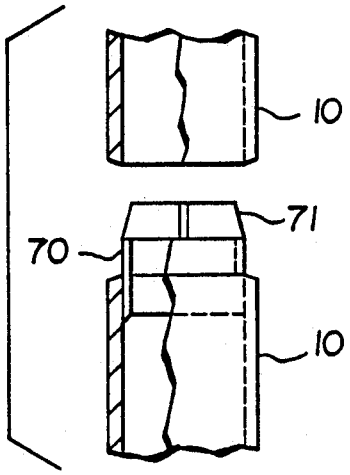
FIG. 22 is a side view of a connection between upper and lower permanent columns of the building shown in FIG. 16.

FIG. 22 depicts an example of the connection between upper and lower permanent columns 10. In this example, a short square tube 70 is inserted into the inner space of the top of the lower column 10 and is welded to the lower column 10. In addition, a cross-shaped guide 71 for the upper column 10 is provided at the top of the short square tube 70, thereby facilitating the connection of the upper and lower columns 10. In this regard, the cross-shaped guide 71 is tapered to the top thereof.

Figure 23:
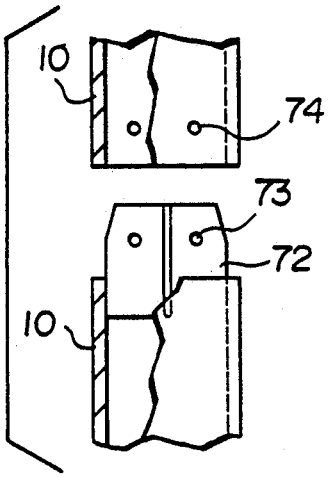
FIG. 23 is a side view of another connection between upper and lower permanent columns of the building shown in FIG. 16.

FIG. 23 depicts another example of the connection between upper and lower permanent columns 10. In this example, a cross-shaped guide 72, which is similar to the cross-shaped guide 71, is inserted into the inner space of the top of the lower column 10 and is welded to the lower column 10. Through-holes 73 are formed at the constituent plates of the guide 72. At the lower end portion of the upper column 10, through-holes 74 are formed. After connecting the upper and lower columns 10, pins may be inserted through the through-holes 73 and 74.

By virtue of the connection structure shown in FIG. 22 or 23, upper columns 10 can be located on the lower columns 10 stably before the welding of the connection of the upper and lower columns 10. Accordingly, when welding, it is unnecessary to utilize the hoists 31, so that the workability of the hoists 31 can be enhanced.

Figure 24:
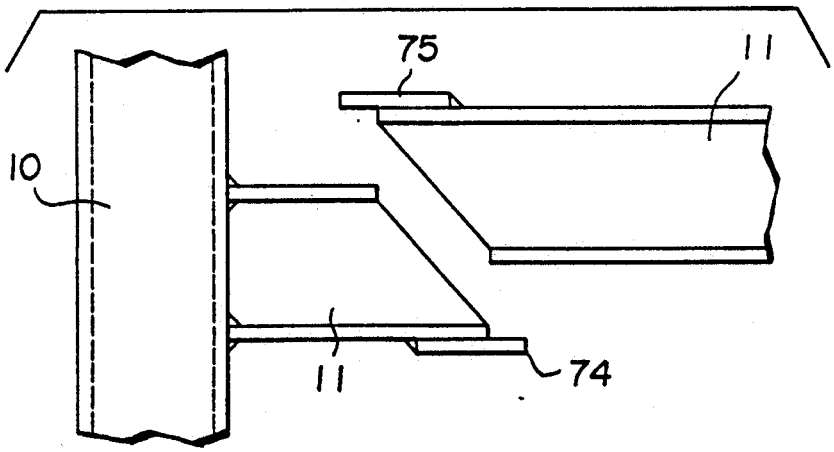
FIG. 24 is a side view of a connection between permanent beams of the building shown in FIG. 16.

FIG. 24 depicts an example of the connection between beams 11 which should be in the same horizontal plane. In the drawing, a shorter beam 11 is welded to one column 10 at one end. The other end of the shorter beam 11 is inclined at an angle. An end of a longer beam 11 is about to be connected to the inclined end of the shorter beam 11. Accordingly, the end of the longer beam 11 is inclined at the same angle of the inclined end of the shorter beam 11. A positioning plate 74 is mounted on the lower surface of the inclined end of the shorter beam 11. Another positioning plate 75 is mounted on the upper surface of the inclined end of the longer beam 11. Mounting the inclined end of the longer beam 11 and the upper positioning plate 75 on the inclined end of the shorter beam 11 and the lower positioning plate 74 creates a temporary connection between the beams 11.

FIGS. 25(*a*) through 25(*d*) illustrate examples of the arrangement of the core portion or core portions 110 of the building K.

In FIG. 25(*a*), the core portion 110 is disposed at the center of the rectangular building K. This arrangement is adopted in the above embodiment. However, as shown in FIGS. 25(*b*) through 25(*d*), other arrangement can be realized. In FIG. 25(*b*), the core portion 110 is disposed along the center line of the building K between opposite sides of the building K. In FIG. 25(*c*), two core portions 110 are disposed at opposite sides of the building K. In FIG. 25(*d*), four core portions 110 are disposed at four corners of the rectangular building K.

The above construction apparatus S is located above the core portion 110 of the building K. The supporting condition of the construction apparatus S is similar to that of the first embodiment. In addition, the method of elevating of the construction apparatus S is similar to that of the first embodiment described with reference to FIGS. 7(*a*) to 7(*f*).

The construction apparatus S according to the third embodiment can achieve the same advantages as that of the first embodiment. Furthermore, the vertical transferring device 215 transfers structural elements U upwardly, and then the horizontal transferring device 113 receives the structural elements U and horizontally transfers the structural elements U to desired positions. Therefore, the workability of the vertical transferring device 215 and the horizontal transferring device 113 can be enhanced. That is, the transfer of the structural elements from the ground to the construction story can be achieved as a flow production. The time required for the transfer, and thus, the time required for construction may be shortened.

In addition, in the third embodiment, the construction apparatus S is supported on the core portion 110 which is taller than the peripheral portions 111 by a height of one or more stories. Structural elements for the peripheral portions 111 can be smoothly transferred. For example, the permanent columns 11 can be assembled to have a length which is equal to the height of the stories.

Next, with reference to FIGS. 26 through 31, a fourth embodiment of the present invention will be described.

The building K under construction for the fourth embodiment comprises a core portion 110 and peripheral portions 111 as similar to that of the second or third embodiment.

A first construction apparatus S1 is located above the core portion 110. Second construction apparatuses S2 are located above the peripheral portions 111, respectively.

Figure 26:
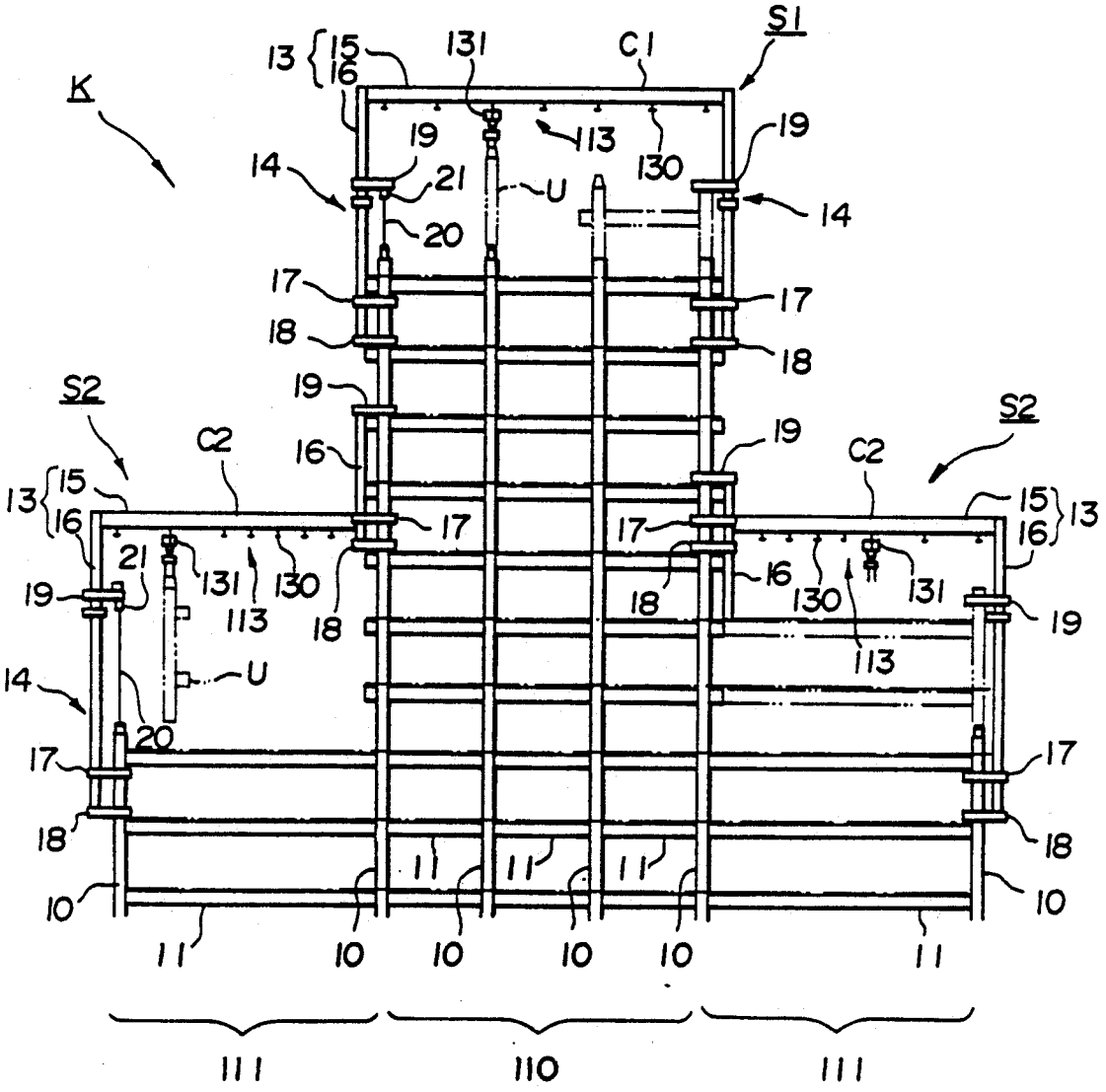
FIG. 26 is a front view of a construction apparatus according to a fourth embodiment of the present invention which is located on a building under construction.

In this embodiment, as shown in FIG. 26, the first construction apparatus S1 is located above the core portion 110. Next, the core portion 110 is constructed to have a certain height using with the first construction apparatus S1. Then, the second construction apparatuses S2 are located above the peripheral portions 111. Next, the peripheral portions 111 are constructed to have a certain height using with the second construction apparatuses S2. This process is repeated so that the building K is progressively constructed.

The first construction apparatus S1 is supported by the permanent beams 11 of the core portion 110. The first construction apparatus S1 comprises temporary framework 13 composing a permanent roof C1 of the building K, a horizontal transferring device 113 attached to the temporary framework 13 for transferring structural elements of the building K, and lifting mechanisms 14 supported on the upper ends of the permanent columns 10 of the core portion 110 for lifting the temporary framework 13.

The temporary framework 13, as shown in FIG. 26, comprises beam-framework 15 having a width which is slightly wider than that of the core portion 110. The beam-framework 15 will become the permanent roof C1 of the building K. The temporary framework further comprises four columns 16 extending downward from the four corners of the beam-framework 15. Each of the columns 16 is disposed outside of the framework of the building K in the direction of the width of the framework of the building K, and is supported by one of the permanent columns 10. The columns 16 are spaced apart from the permanent columns 10 at a regular interval. Each of the columns 16 is also of a square cross section.

Each of the lifting mechanisms 14 comprises upper and lower detachable guides 17 and 18 detachably attached to the lower portion of the respective column 16. At each of the upper ends of the column 16, a bracket 19 is provided so as to project inwardly. A screw rod 20 is provided between the bracket 19 and the upper detachable guide 17 attached to each column 16 so as to be parallel to the column 16. Climbing devices 21 for supporting the corners of the temporary framework 13, thereby raising and lowering the temporary framework 13, are screwed to the screw rods 20, respectively.

The detailed structure of the detachable guides 17 and 18 are the same as those in the first embodiment shown in FIGS. 3 and 4. Also, the detailed structure of the climbing device 21 is the same as that in the first embodiment shown in FIGS. 5 and 6.

Figure 27:
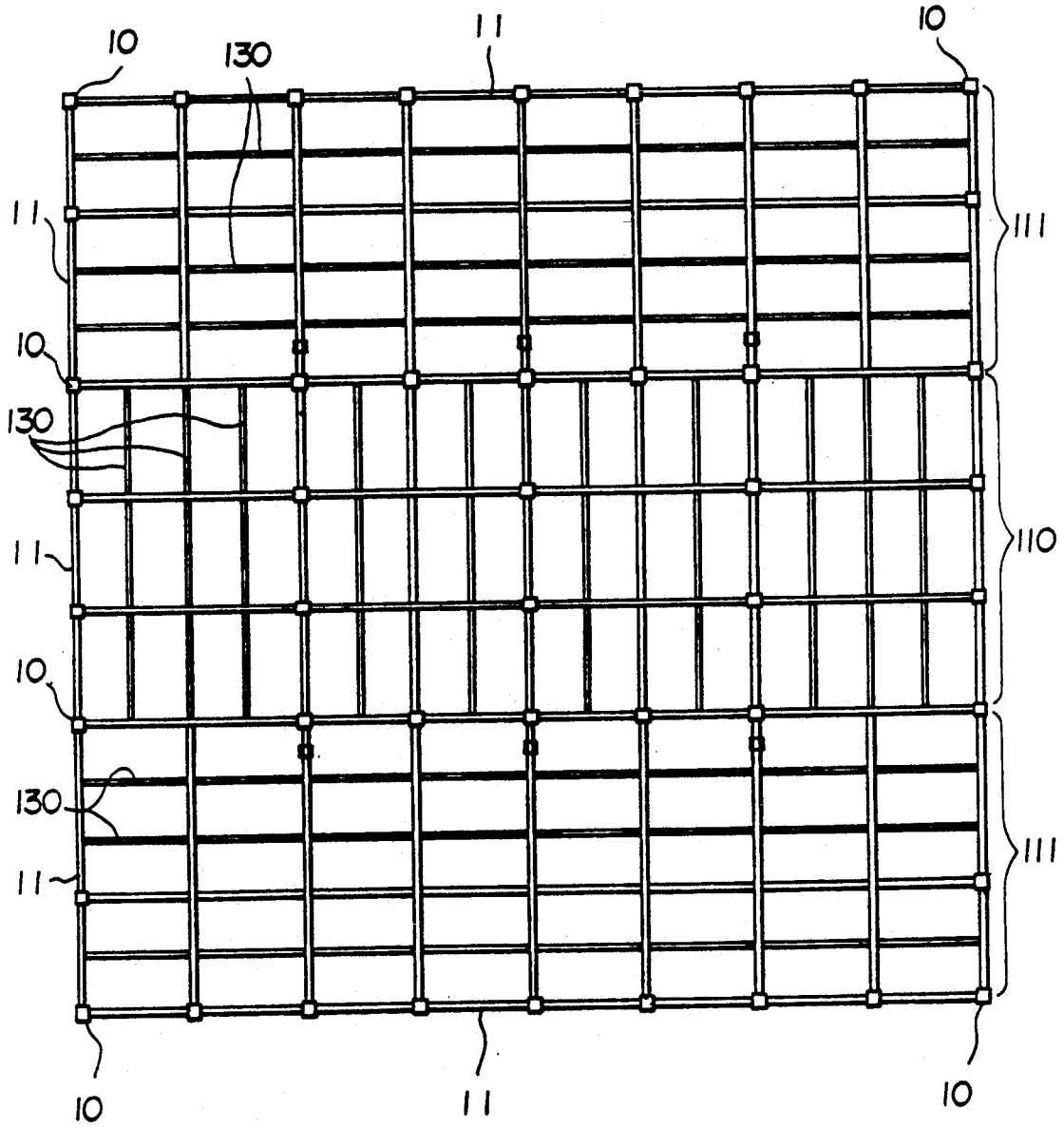
FIG. 27 is an overhead view of the building shown in FIG. 26.
Figure 28:
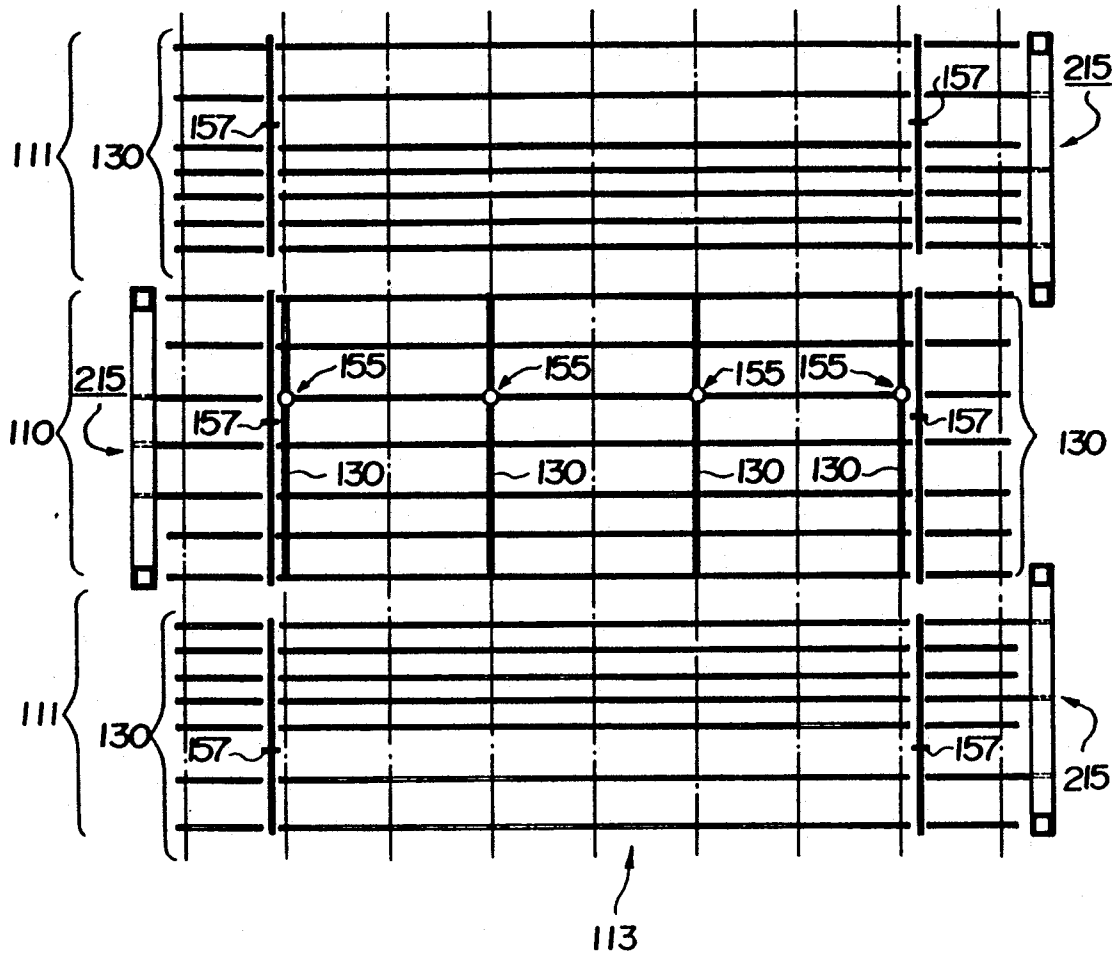
FIG. 28 is a plan view of a horizontal transferring device used in the apparatus shown in FIG. 26.
Figure 29:
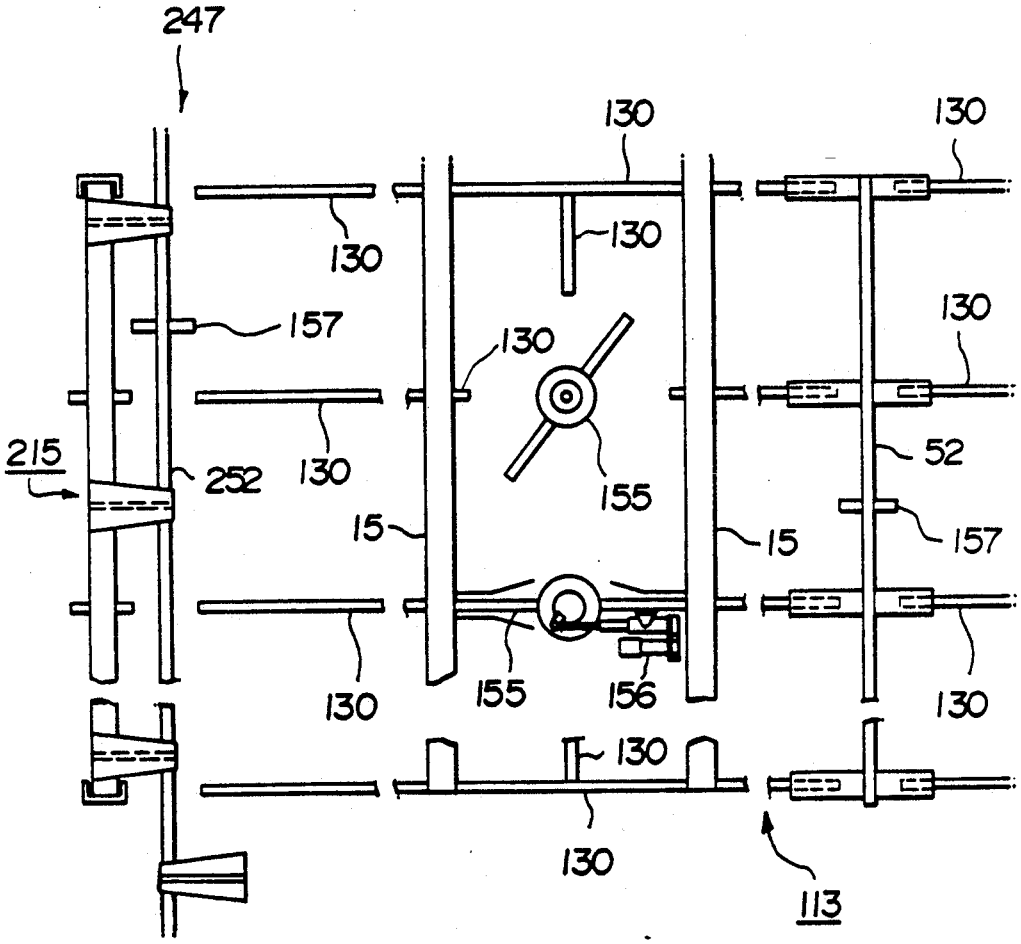
FIG. 29 is an enlarged plan view of the horizontal transferring device shown in FIG. 28.

As best shown in FIGS. 27 and 29, the aforementioned horizontally transferring device 113 comprises a plurality of travelling rails 130. A hoist 131 is slidably suspended from each travelling rail 130 as similar to the third embodiment as shown in FIG. 26. The transferring device 21 also comprises the rotation rails 155 (see FIG. 29) and the shift rails 157 (see FIG. 28) shown in FIGS. 14 and 15 as similar to the second or third embodiment.

Accordingly, the hoist 131 can be optionally transferred to a desired constructing position by the combination of the rails 130, the rotation rails 155, and the shift rails 157.

While the structure of the first construction apparatus S1 is described hereinbefore, the second construction apparatus S2 has a structure similar to the first construction apparatus S1. However, although some of the detachable guides 17 and 18 are supported by the permanent columns 10 of the peripheral portion 111, the other of the detachable guides 17 and 18 are supported by the permanent columns 10 of the core portions 110.

Next, the construction method using the above construction apparatuses S1 and S2 will be described.

First, after building the foundation, the permanent roof C1 (beam-framework 15 of the temporary framework 13) of the core portion 110 is immediately constructed on the ground since the core portion 110 needs more structural elements than each of the peripheral portions 111, and thus more time for construction is needed.

Figure 20:
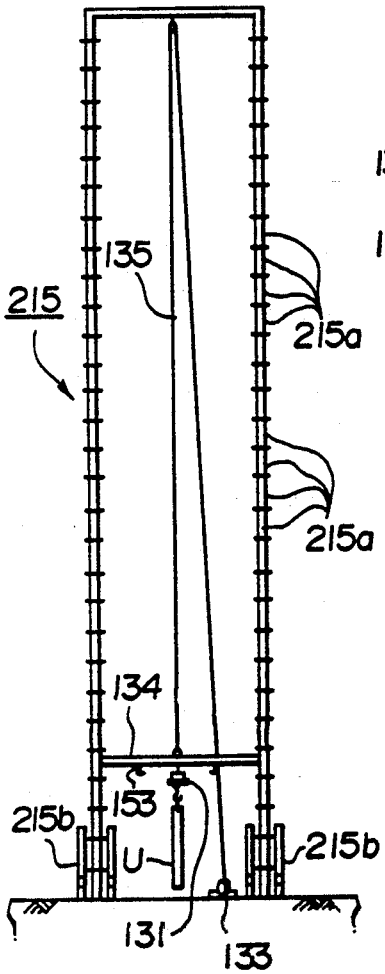
FIG. 20 is a front view of a vertical transferring device used in the apparatus shown in FIG. 16.

The structural element U of the building K is hooked to the hoist 131 on the ground when the hoist 131 is supported by the vertical transferring device 215 shown in FIG. 20.

Then, by means of the vertical transferring device 215, the structural element U is raised to the work story. Once, the height of the auxiliary rails 153 mounted on the hoisting beam 134 is coincident with the height of the rails 130 as shown in FIG. 21, the hoist 131 suspending the structural element U is introduced into the work story.

The hoist 131, suspending the structural element U, is horizontally transferred to a desired position by means of the horizontally transferring device 113 which comprises the rails 130, the rotation rails 155, and the shift rails 157.

Thus, the structural elements U, for example, the permanent columns 10 and permanent beams 11 are assembled to form one story. Then, the first construction apparatus S is moved up. The elevating method and the method of use of the first construction apparatus S1 are similar to those of the first embodiment described with reference to FIGS. 7(*a*) to 7(*f*).

After the core portion 110 reaches a certain height, the peripheral portions 111 are also built. The elevating method and method of use of the second construction apparatuses S2 are similar to those of the first construction apparatus S1. Therefore, the description is omitted.

Then, the constructing of the core portion 110 and the constructing of the peripheral portions 111 progress simultaneously in such a manner that the core portion 110 is always taller than the peripheral portions 111.

According to the fourth embodiment of the present invention, the following advantages are achieved.

The permanent roofs C1 and C2 for the building K can be constructed on the ground safely and efficiently. If the permanent roofs C1 and C2 have large spans due to the requirement of the building, the number of columns 16 of the construction apparatuses S1 and S2 for supporting the roof can be reduced.

The construction of the building K is divided to the construction of the core portion 110 and the construction of the peripheral portions 111. In addition, these constructions are performed sequentially. Therefore, the entire amount of work may be distributed effectively without interruptions. Thus, time required for construction can be shortened.

Since the hoists 131 are provided in pairs, it is possible to transfer and assemble a plurality of structural elements U simultaneously. Thus, time required for construction can be shortened.

Figure 30:
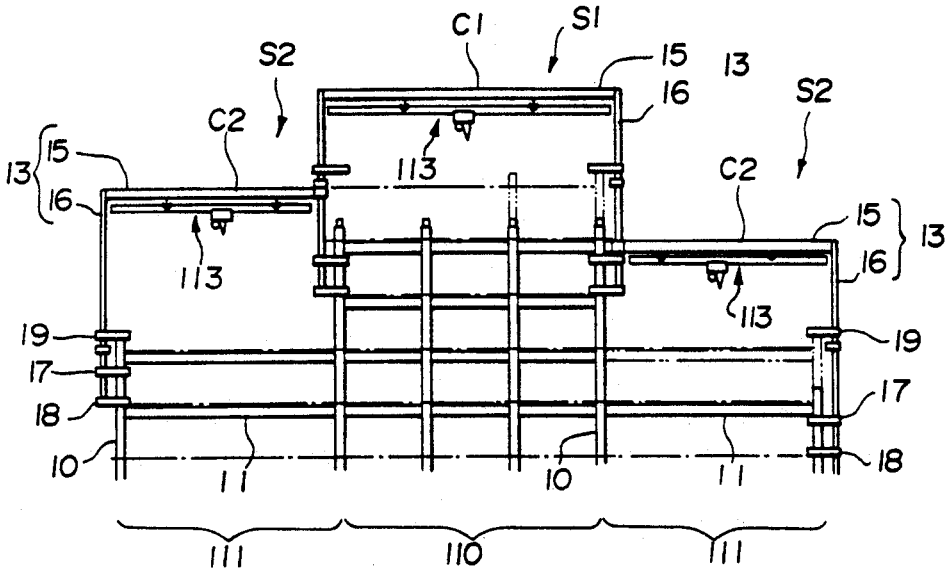
FIG. 30 is a front view of a modification of the fourth embodiment.

FIG. 30 depicts a modification of the fourth embodiment. In this structure, the columns 16 of the first construction apparatus S1 are commonly used for columns of the second construction apparatus S2. Accordingly, at the boundary between the first construction apparatus S1 and the second construction apparatuses S2, the number of the columns 16 can be reduced.

Figure 31:
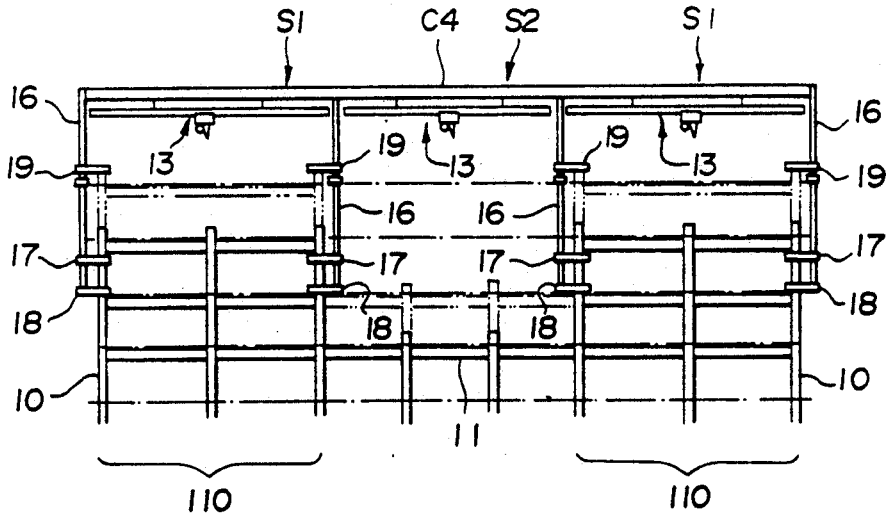
FIG. 31 is a front view of another modification of the fourth embodiment.
Figure 32:
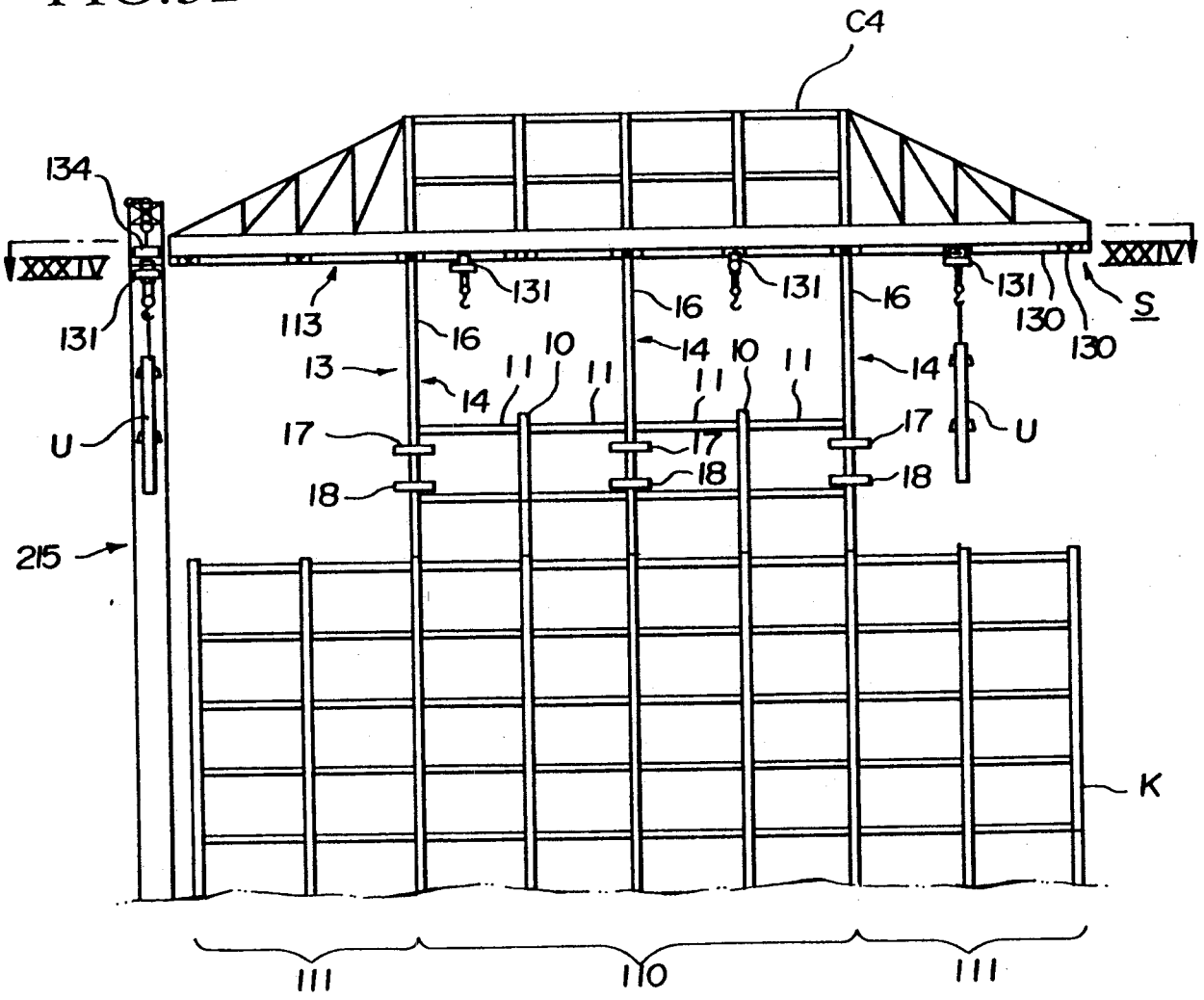
FIG. 32 is a front view of a construction apparatus according to a fifth embodiment of the present invention which is located on a building under construction.
Figure 33:
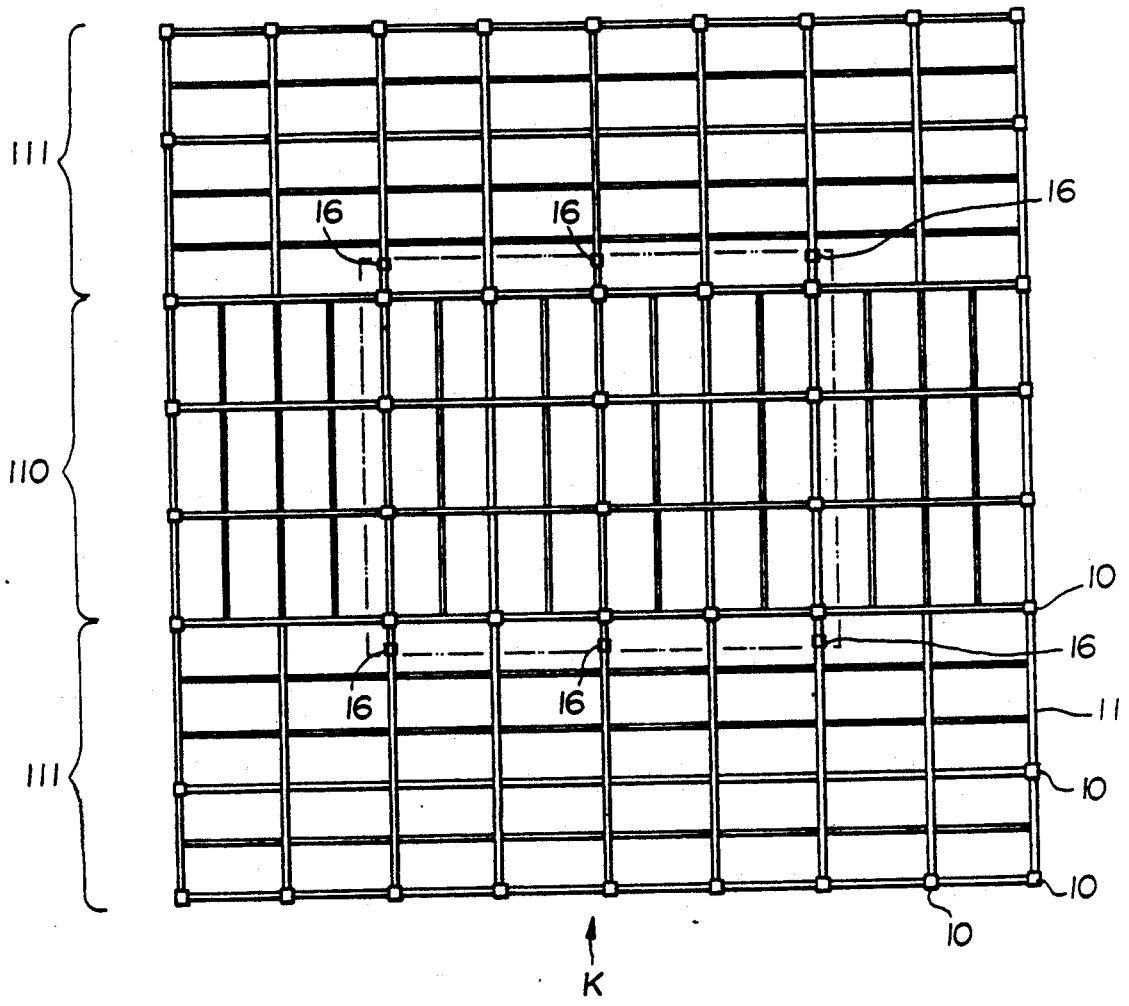
FIG. 33 is an overhead view of the building in FIG. 32.

FIG. 31 depicts another modification of the fourth embodiment. In this case, two core portions 110 are disposed at both sides of the building K. Accordingly, a large scale permanent roof C4 can be assembled as a unitary body on the ground which spans between the core portions 110 at both sides. In addition, the number of columns 16 for supporting the permanent roof C4 can be reduced, and the structures of the construction apparatuses S1 and S2 can be simplified.

Next, with reference to FIGS. 32 through 35, a fifth embodiment of the present invention will be described.

A building K, which is being constructed according to the fifth embodiment, also comprises a core portion 110 and peripheral portions 111. The core portion 110 is taller than the peripheral portions 111 by the height of two stories.

A construction apparatus S according to the fifth embodiment comprises a temporary framework 13 including beam-framework which will become a permanent roof C4 of the building K and a plurality of (in this embodiment six) columns 16 as similar to the preceding embodiments. The aforementioned lifting mechanisms 14 are also applied in this embodiment.

At one side of the building K, the vertical transferring device 215, which has been described with reference to FIGS. 20 and 21, is provided.

Figure 34:
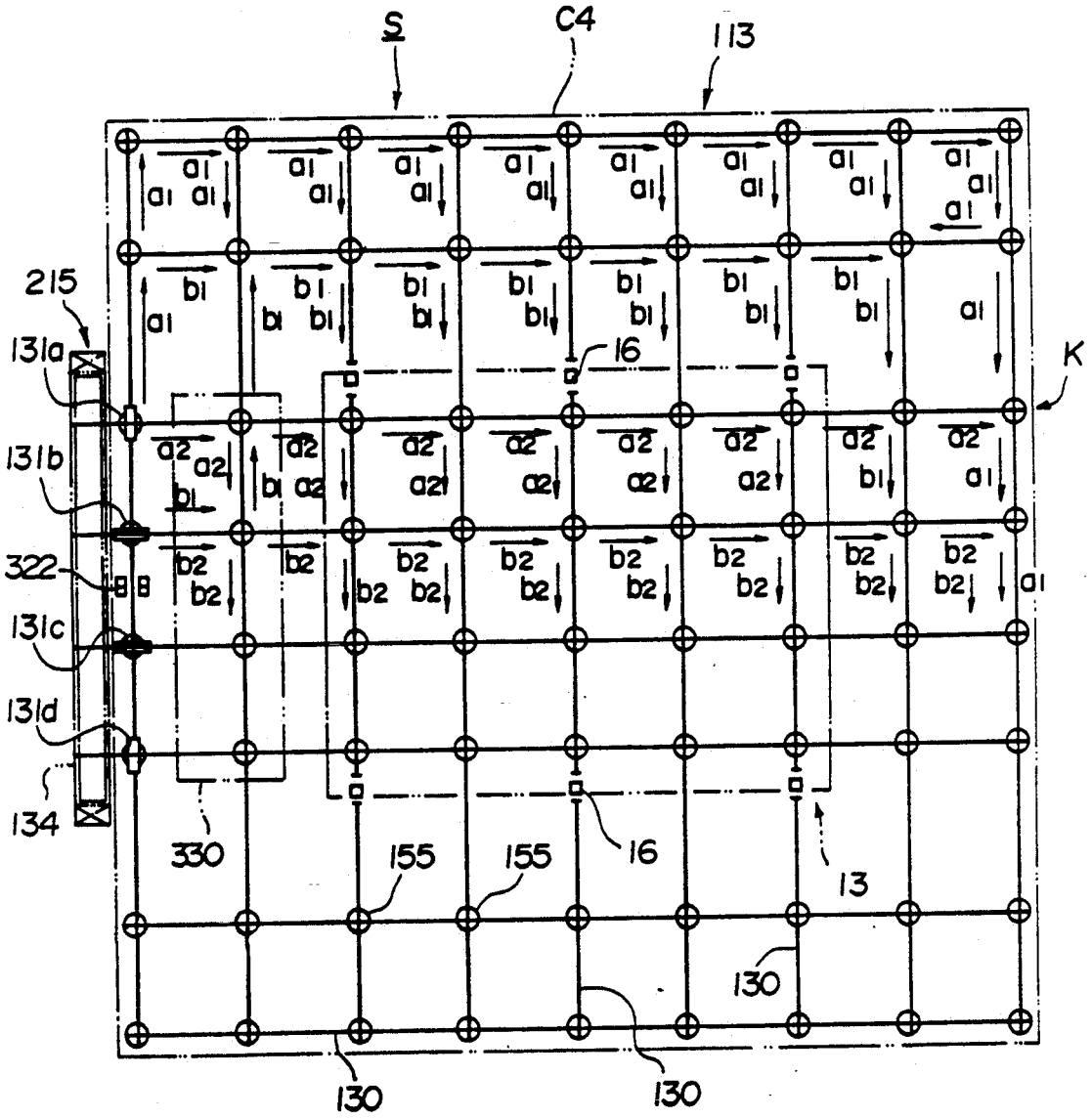
FIG. 34 is a horizontal cross-sectional view of the apparatus shown in FIG. 32 in the horizontal plane which contains lines XXXIV—XXXIV shown in FIG. 32, showing transferring routes of the structural elements.

A horizontal transferring device 113 is located under the permanent roof C4. As shown in FIG. 34, the horizontal transferring device 113 comprises a plurality of rails 130 disposed longitudinally and transversely so as to cover the lower surface of the permanent roof C4 entirely. The rails 130 cross perpendicularly to one another so as to form a grid-like shape. A plurality of hoists 131 (131*a*, 131*b*, 131*c*, and 131*d*) are suspended from the rails 130. At the intersections of the rails 130, rotation rails 155, which have been described with reference to FIG. 14, are disposed, so that the hoists 131 can move toward desired positions.

In this embodiment, first, the first and second stories of the core portion 110 are built on the foundation of the building.

Secondly, the temporary framework 113 is constructed above the second story of the core portion 110 so as to connect with the core portion 110.

Next, the first and second stories of the peripheral portions 111 are constructed using the vertical transferring device 215 and the horizontal transferring device 113 which transfers the structural elements U of the building.

The construction apparatus S is then lifted up in a manner similar to that in the first embodiment described with reference to FIG. 7. At the same time, the other stories are constructed on the second stories. In addition, the lifting of the vertical transferring device 215 is conducted by adding other frame units 215*b*.

The above process is repeated so that the building is progressively constructed.

The horizontal transferring device 113 used in the fifth embodiment will be described in detail. As shown in FIG. 34, the horizontal transferring device 113 comprises nine longitudinal rails 130 disposed parallel to one another, and eight transverse rails 130 disposed parallel one another and perpendicular to the longitudinal rails 130. At each intersection of the longitudinal rails 130 and the transverse rails 130, a rotation rail 155, which has been described with reference to FIG. 14, is provided.

An electric supplying relay 322 is disposed at the intermediate portion of the leftmost longitudinal rail 130. Four hoists 131*a* to 131*d* are suspended from the rail framework and electrically connected to the electric supplying relay 322. The intersections of the leftmost longitudinal rail 130 and four center transverse rails 130 may be the commencing points of the hoists 131*a* to 131*d*.

The connection between the horizontal transferring device 113 and the vertical transferring device 215 is the same as that shown in FIG. 21. In this embodiment, the hoist 131 of the vertical transferring device 215 moves to the horizontal transferring device 113, and then, releases the structural element U at a temporary storage point 330 in FIG. 34. The hoist 131 then returns to the vertical transferring device 215.

The structural element U is received by one of the hoists 131*a* to 131*d* at the temporary storage point 330, and transferred horizontally to a desired position under the permanent roof C4. However, the connection between the horizontal transferring device 113 and the vertical transferring device 215 is not limited to the above manner, and other means may be applied.

Next, the method of use of the horizontal transferring device 113 will be described in detail. In FIG. 34, arrows $a_1$ designate outer transferring routes of a hoist 131*a* from the initial position where the hoist 131*a* is illustrated in FIG. 34, arrows $a_2$ inner transferring routes of the hoist 131*a*, arrows $b_1$ outer transferring routes of a hoist 131*b* from the initial position where the hoist 131*b* is illustrated in FIG. 34, and arrows $b_2$ inner transferring routes of the hoist 131*b*. The remaining hoist 131*c* follows transferring routes symmetric to those of the hoist 131*b*, and hoist 131*d* follows transferring routes symmetric to those of the hoist 131*a*.

As described above, the four hoists 131*a* to 131*d* horizontal transfer the structural elements U, for example, permanent columns or beams in the respective predetermined routes, whereby the structural elements can be distributed effectively. At that time, since it is possible to transfer the hoists 131*a* to 131*d* simultaneously, the efficiency of transfer of the structural elements can be enhanced.

Figure 35:
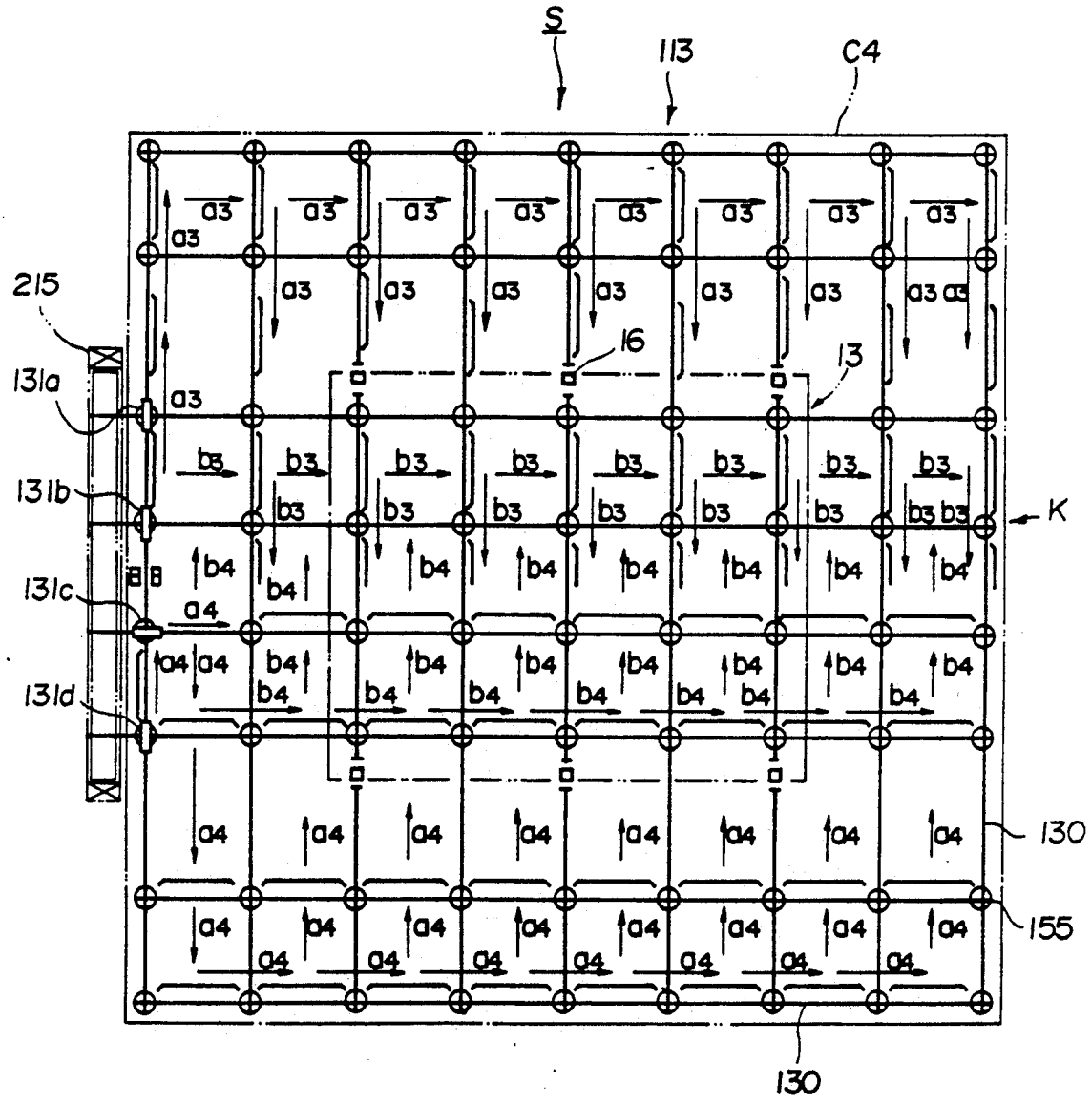
FIG. 35 is a plan view of the apparatus shown in FIG. 34, showing other transferring routes.

FIG. 35 depicts transferring routes for transferring wall blocks and floor blocks, in which a pair of hoists 131*a* and 131*b* (or 131*c* and 131*d*) cooperate to transfer the blocks. The hoists 131*a* and 131*b* transfer the blocks along the longitudinal axis of the building K. In FIG. 35, arrows $a_3$ designates outer transferring routes of the blocks from the initial positions where the hoists 131*a* and 131*b* are illustrated in FIG. 35, and arrows $b_3$ designate inner transferring routes of the blocks.

On the other hand, the hoists 131*c* and 131*d* transfer the block along the transverse axis of the building K. In FIG. 35, arrows $a_4$ designates outer transferring routes of the blocks from the initial positions where the hoists 131*c* and 131*d* are illustrated in FIG. 35, and arrows $b_4$ designate inner transferring routes of the blocks. In this case, a pair of blocks can be transferred simultaneously by means of two pair of hoists.

In the fifth embodiment, if other four hoists are prepared at the rightmost longitudinal rail 130 symmetrically to the hoists 131*a* to 131*d* in FIGS. 34 and 35, and if the structural elements are moved from the hoists 131*a* to 131*d* to the other hoists at intermediate portions of the respective transferring routes, the time required for the cycle of the transferring for the hoists can be reduced. Thus, the transferring efficiency can be enhanced.

In addition, if the building K has a large floor area, another vertical transferring device 215 can be located at the opposite sides of the building K from the illustrated vertical transferring device 215. Alternatively, more vertical transferring devices 215 can be located at the sides of the building K. In these cases, the number of hoists may be increased due to the increase in the vertical transferring device 215. Thus, the transferring efficiency can be enhanced.

Next, with reference to FIGS. 36 through 45, a sixth embodiment of the present invention will be described.

Figure 36:
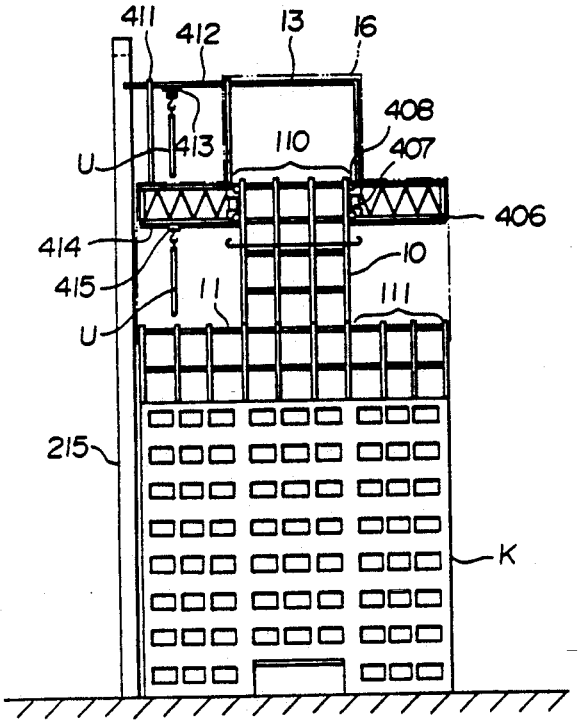
FIG. 36 is a front view of a construction apparatus according to a sixth embodiment of the present invention which is located on a building under construction.
Figure 37:
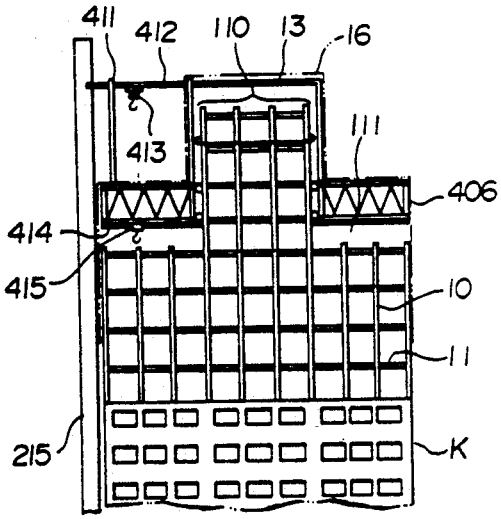
FIG. 37 is a side view of the apparatus and the building shown in FIG. 36.
Figure 38:
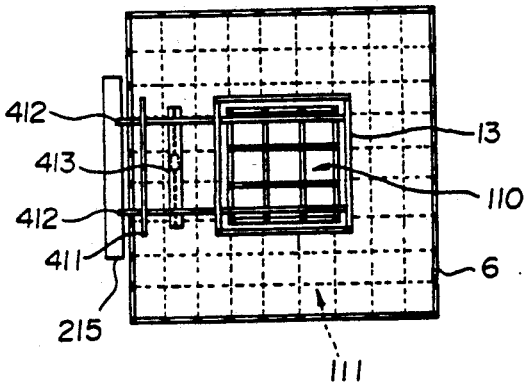
FIG. 38 is an overhead view of the apparatus shown in FIG. 36.

In FIGS. 36 through 38, reference numeral 110 designates a core portion 110 of a building. Around the core portion 110, peripheral portion 111 is built so as to connect with the core portion 110. The core portion 110 and the peripheral portion 111 constitute the framework of a building K.

Also, reference numeral 406 designates an uppermost story portion including the uppermost story and the rooftop for the building K. The uppermost story portion 406 entirely covers over the peripheral portion 111, but does not cover the core portion 110. In addition, the uppermost story portion 406 is supported by the core portion 110 so as to be able to move vertically.

In this embodiment, the uppermost story portion 406 is divided into a plurality of spaces. The spaces will be used for a machinery room, a power supplying room, a control room, a passageway, spaces for electric distribution, and the like. Braces are disposed within the uppermost story portion 406 for reinforcing it.

A plurality of lifting mechanisms 407 mounted on the core portion 110 are attached to the uppermost story portion 406 in order to support and lift the uppermost story portion 406. In addition, a plurality of rollers 408 are mounted on the uppermost story portion 406 so as to roll on the permanent columns 10 of the core portion 110 in order to facilitate the lifting movement of the uppermost story portion 406.

At one side of the building K, a vertical transferring device 215 is erected so as to vertically transfer structural elements U of the building K, for example, permanent columns 10 and permanent beams 11 from the ground. This vertical transferring device 215 may be that shown in FIGS. 20 and 21.

Furthermore, a temporary framework 13 is located above the core portion 110 and the uppermost story portion 406. This temporary framework 13 is supported on the rooftop of the uppermost story portion 406 and spans over the core portion 406. A gate framework 411 is erected on one side of the rooftop of the uppermost story portion 406. A pair of I-beam rails 412 are horizontally disposed parallel to each other and disposed over the temporary framework 13 to the gate framework 411. A crane apparatus 413 is suspended from the rails 412 so as to be able to horizontally travel from the vertical transferring device 215 to the farthest portion of the temporary framework 13.

A plurality of I-beam rails 414 are mounted on the lower surface of the uppermost story portion 406 longitudinally and transversely. A crane apparatus 415 is suspended from the rails 414 so as to be able to horizontally travel from the vertical transferring device 215 to desired portion on the uppermost story portion 406.

During the construction operation of the building K, the temporary framework 13, the uppermost story portion 406, and the sides of the building K are covered with a covering means 16, for example, a vinyl sheet.

Figure 39:
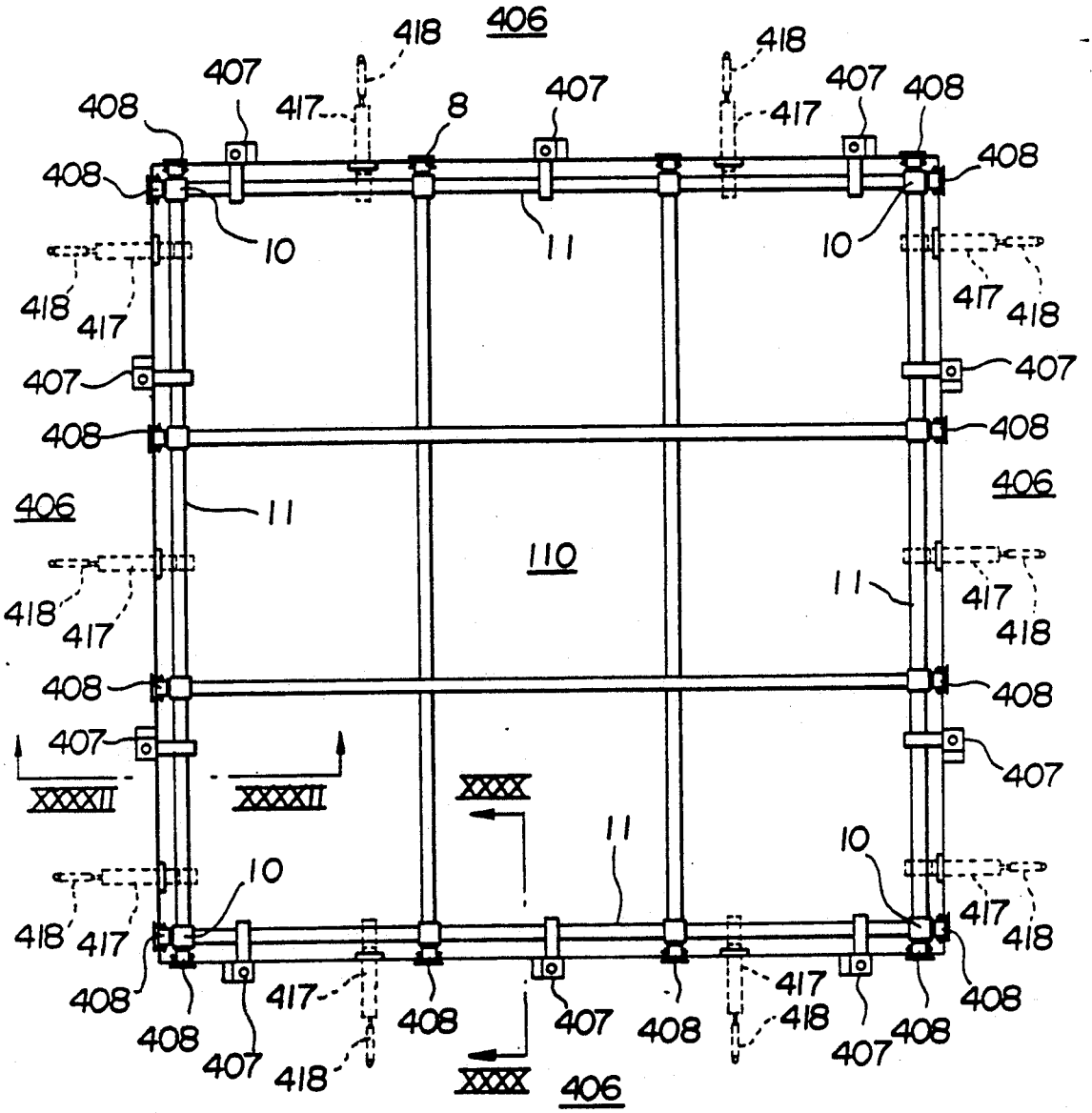
FIG. 39 is an overhead view of a center portion of the apparatus shown in FIG. 36.

FIG. 39 illustrates an example of arrangement of the lifting mechanisms 407 and the rollers 408. In FIG. 34, ten lifting mechanisms 407 are coupled with permanent beams 11 disposed at the sides of the core portion 110 where the inner side of the uppermost story 406 faces. The lifting mechanisms 407 are distributed symmetrically about the longitudinal center axis of the core portion 110, and about the transverse center axis of the core portion 110.

Figure 40:
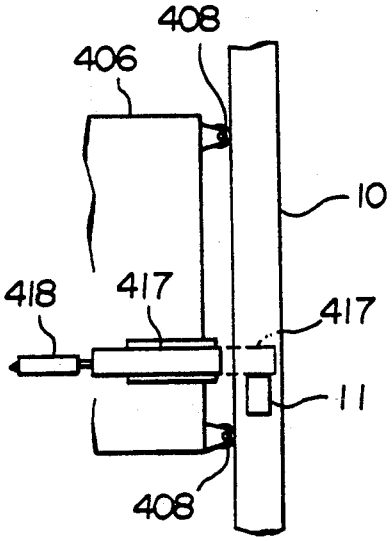
FIG. 40 is a cross sectional view of rollers and an extendable arm used in the apparatus shown in FIG. 36, taken along lines XXXX—XXXX in FIG. 39.
Figure 41:
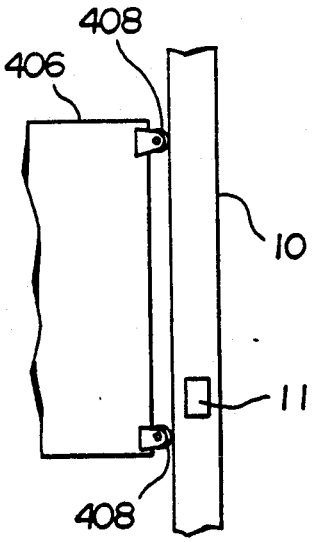
FIG. 41 is a cross sectional view of other rollers used in the apparatus shown in FIG. 36.

The rollers 408 are, as shown in FIGS. 39 to 41, attached to upper and lower portions of the inner side of the uppermost story 406 so as to be in contact with all the permanent columns 407 which are disposed at the sides of the core portion 110.

Additionally, as shown in FIG. 39, ten extendable support arms 417 are disposed within the inner side of the uppermost story portion 406. These support arms 417 can extend by activating actuators 418, which are respectively attached to the rear ends of the support arms 417 as shown by dotted lines in FIG. 39. When the support arms 417 extend, they are located above the permanent beams 11 of the core portion 110, whereby the load of the uppermost story portion 406 can be transmitted to the core portion 110. The extendable support arms are also not only disposed symmetric about the longitudinal center line of the core portion 110, but are disposed symmetrically about the transverse center line of the core portion 110.

Figure 42:
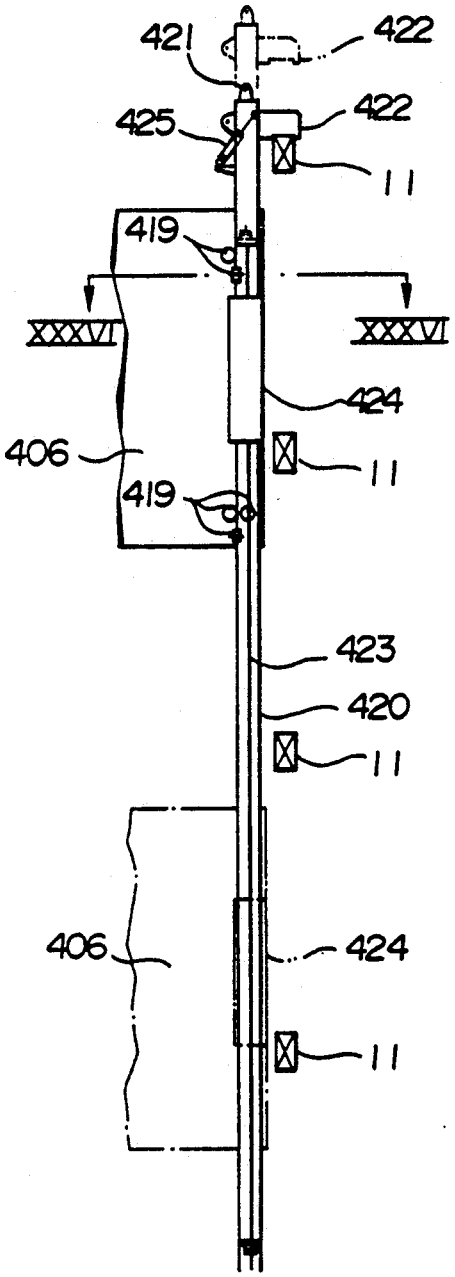
FIG. 42 is a side view of a lifting mechanism used in the apparatus shown in FIG. 36, taken along lines XXXXII—XXXXII in FIG. 39.
Figure 43:
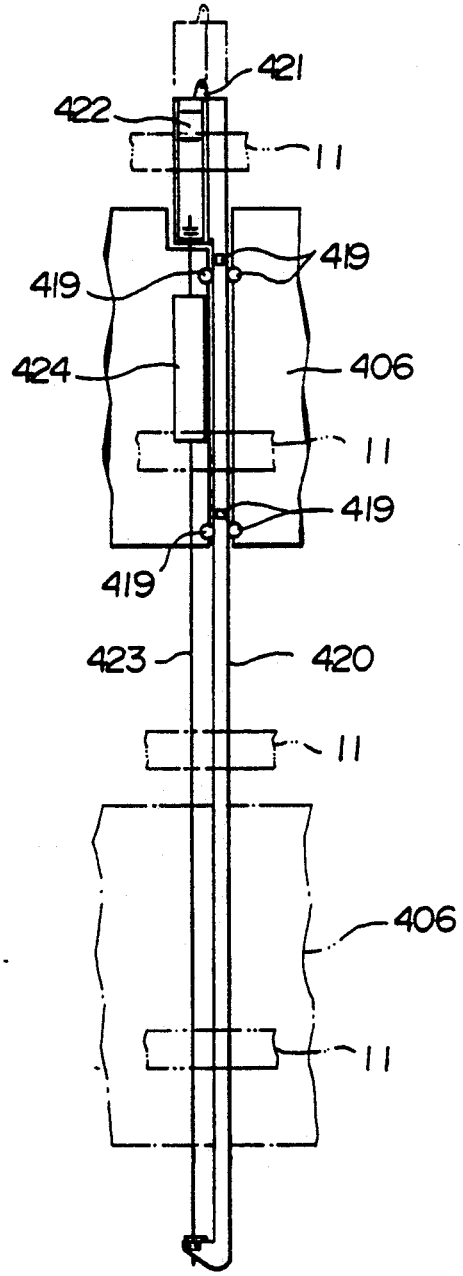
FIG. 43 is a front view of the lifting mechanism shown in FIG. 42.
Figure 44:
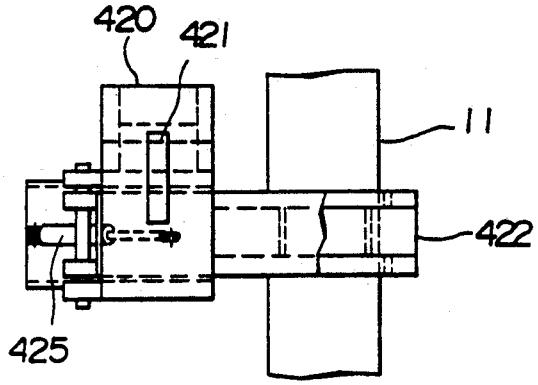
FIG. 44 is an enlarged overhead view of the lifting mechanism shown in FIG. 42.
Figure 46:
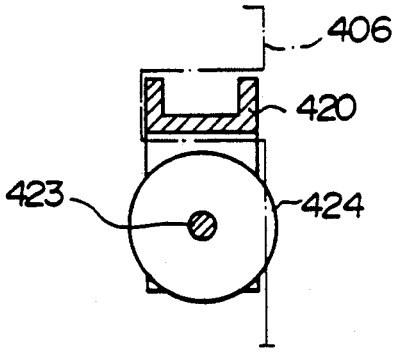
FIG. 46 is a plan view taken along lines XXXXVI—XXXXVI in FIG. 42.

FIGS. 42 and 43 illustrate a specific example of the lifting mechanism 407. Each lifting mechanism 407 comprises an elongated rigid arc-shaped body 420 which is guided upwardly and downwardly along the axial direction thereof and is engaged with guide rollers 419 disposed at upper and lower portions of the uppermost story portion 406; a hook 421 provided unitary with the upper end of the arc-shaped body 420; a detachable arm 422 which is supported rotatably in a vertical orientation by the hook 421 and detachably attached to the permanent beam 11; a screw rod 423 extending along the axial direction of the arc-shaped body 420 and having upper and lower ends which are fixed to the upper and lower ends of the arc-shaped body 420; and a climbing jack 424 fixed to the uppermost story portion 406 and screwed to the screw rod 423.

Figure 45:
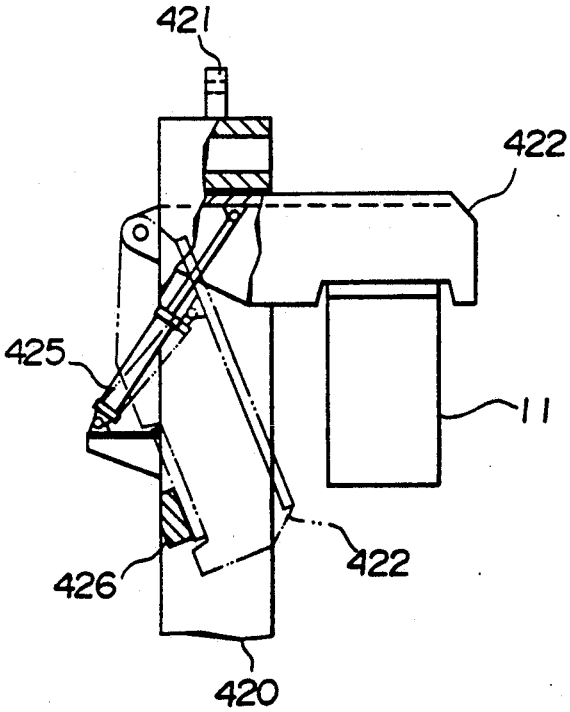
FIG. 45 is an enlarged side view of the upper portion of the lifting mechanism shown in FIG. 42.

The detachable arm 422 is attached to an actuator 425 for rotating the detachable arm 423 in a vertical plane. As shown in FIG. 45, by activating the actuator 425, the detachable arm 422 can rotate in a vertical plane between a stored position shown by the dotted line and an attaching position, shown by the dotted lines, where the detachable arm 422 attaches to the permanent beam 11. In FIG. 45, reference numeral 426 designates a stopper for stopping the detachable arm 422 at the stored position shown by the dotted lines.

Next, the construction of the building K according to the sixth embodiment will be described.

First, the lifting operation of the uppermost story portion 406 is described. In FIG. 42, in order that the uppermost story portion 406 is lifted from the position shown by the dotted line to the position shown by the solid line, all the detachable arms 422 of all the arc-shaped body 420 are attached to the uppermost permanent beams 11 of the core portion 110, whereby all the load of the uppermost story 406 is supported by the core portion 110. Then, all the climbing jacks 424 are synchronously driven so as to extend through rotation of the screw rod 423, so that the uppermost story portion 406 is lifted from the position shown by the dotted line to the position shown by the solid line. At the same time, the rollers 408 facilitate the lifting operation.

After the lifting, the detachable jacks 24 are stopped and locked, whereby the uppermost story 406 is stopped. The extendable arms 417 are then extended over the permanent beams 11 so that the uppermost story portion 406 is supported on the upper end of the core portion 110.

Then, as shown in FIG. 36, using the vertical transferring device 215 and the upper crane apparatus 413, structural elements U for the core portion 110 of the building K are lifted from the ground and added to the core portion 110. At the same time, using the vertical transferring device 215 and the lower crane apparatus 415, structural elements U for the peripheral portion 111 of the building K are lifted from the ground and added to the peripheral portion 111 which is lower than the core portion 110 by the height of two stories. The structural elements U may be single elements, for example, permanent beams or permanent columns, or assembled elements, for example, blocks assembled on the ground.

FIG. 37 illustrates the building K in a condition wherein two stories are additionally constructed in the core portion 110 and the peripheral portion 111, respectively (Compare with FIG. 36). In this state, if the climbing jacks 424 are slowly loosened, the load of the uppermost story 406 is transmitted to the permanent beams 11 through the extendable arms 417. The screw rods 423 are released from the climbing jacks 424 to be freed. At this time, by means of the upper crane apparatus 413, the hooks 421 are hooked and then the arc-shaped bodies 420 are lifted up, whereby the arc-shaped bodies 420 are raised relative to the uppermost story portion 406. Then, actuators 425 are retracted so that the detachable arms 422 are retracted to stored positions shown by the dotted lines in FIG. 45. The arc-shaped bodies 420 are raised by a height which is more than the height of two stories. Then, the actuators 425 are extended to the projecting positions. Furthermore, the arc-shaped bodies 420 are slightly lowered so that the detachable arms 422 are disposed on the uppermost permanent beams 405 of the core portion 110 shown in FIG. 37. Then, the climbing jacks 424 are engaged with the step rods 423 and then raised slightly, so that the uppermost story portion 406 is supported by the core portion 110 via the detachable arms 422.

Next, the extendable arms 417 are retracted. Then, the climbing jacks 424 are raised so that the step rods 424 are raised by a height equal to the height of two stories. Then, the extendable arms 417 are extended so that the building K is prepared again for additional construction as shown in FIG. 36. The above process is repeated so that the building K is progressively built.

During the above construction of the building K, the load of the uppermost story 406 is always supported by the permanent beams 11 through a plurality of points, that is, the detachable arms 422 or the extendable arms 417. In addition, the moment exerted in the uppermost story portion 406 is withstood by the permanent columns 10 of the core portion 110 through a large number of the rollers 408.

In addition, the covering means 16, for example, vinyl sheet may be wrapped around the upper crane apparatus 413, the temporary framework 13, the uppermost story portion 406, and the stories under construction. Accordingly, operation during bad weather and at night can be easily conducted.

In addition, since the machinery room, the power supplying room, the control room, the passageway can be arranged within the uppermost story portion 406, safety during the construction is enhanced.

In the above described embodiment, the uppermost story portion 406 is lifted and two stories of the core portion 110 and the peripheral portion 111 are constructed. However, it is not intended to limit the present invention to the above process. If longer arc-shaped bodies 420 and longer screw rods 423 are used, the uppermost stories 406 can be lifted and the core portion 110, whereby more than two stories of the core portion 110 and the peripheral portion 111 can be constructed.

Furthermore, since the blocks can be transferred and added to the desired positions, the time required for the construction and the lifting can be considerably shortened compared with conventional construction technique.

Next, with reference to FIGS. 47 through 54, a seventh embodiment of the present invention will be described. This embodiment may be preferable for transferring wall blocks or floor blocks to desired position of the building.

In the drawings, reference numeral 110 designates a core portion of a building K which is being constructed. Around the core portion 110, a peripheral portion 111 is built so as to connect with the core portion 110. The core portion 110 and the peripheral portion 111 constitute a framework of the building K. The core portion 110 mainly constitutes a plurality of permanent column 10 and permanent beams 11. The peripheral portion 111 constitutes a plurality of permanent columns 10, permanent beams 11, wall panels, and flooring panels. In this embodiment, the peripheral portion 111 is constructed of a plurality of blocks 530 to 537 which will be described later.

A temporary framework 13 is located above the core portion 110. The temporary framework 13 can climb by jacking-up while supported by the core portion 110.

A swingable crane apparatus 511 is disposed at the top of the temporary framework 13. The crane apparatus 511 has an arm span (swing radius) which reaches the entire periphery of the building K. The temporary framework 13 and the swingable crane apparatus 511 constitute a construction apparatus according to the seventh embodiment.

The detailed structure of the temporary framework 13 is the same as that of the first embodiment. An inner crane apparatus (vertical transferring means) 12 is suspended from the temporary framework 13. The elevating method of the temporary framework 13 is the same as that which has been described with reference to FIGS. 7(*a*) to 7(*f*). During the climbing of the temporary framework 13, the core portion 110 is progressively constructed by adding the structural elements U, for example, permanent beams 11 and permanent columns 10.

Figure 47:
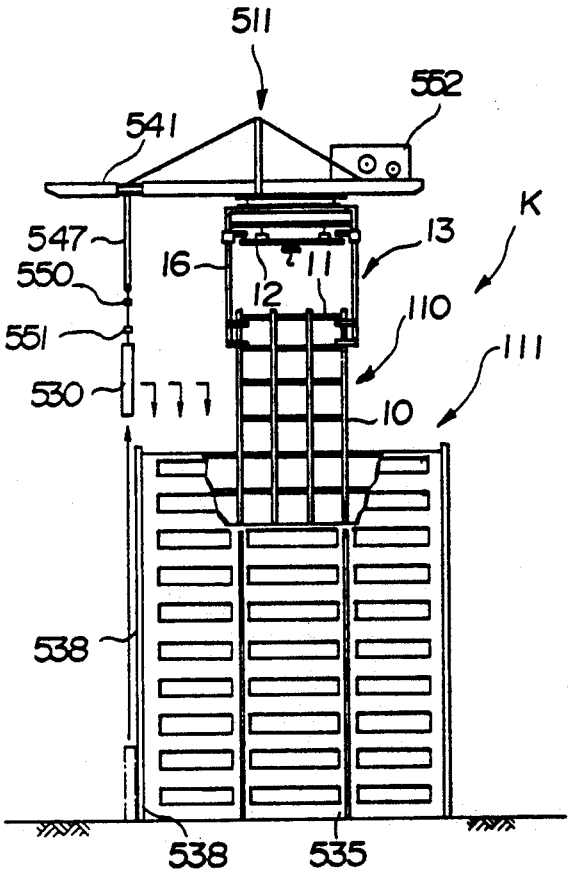
FIG. 47 is a front view of a construction apparatus according to a seventh embodiment of the present invention which is located on a building under construction.
Figure 48:
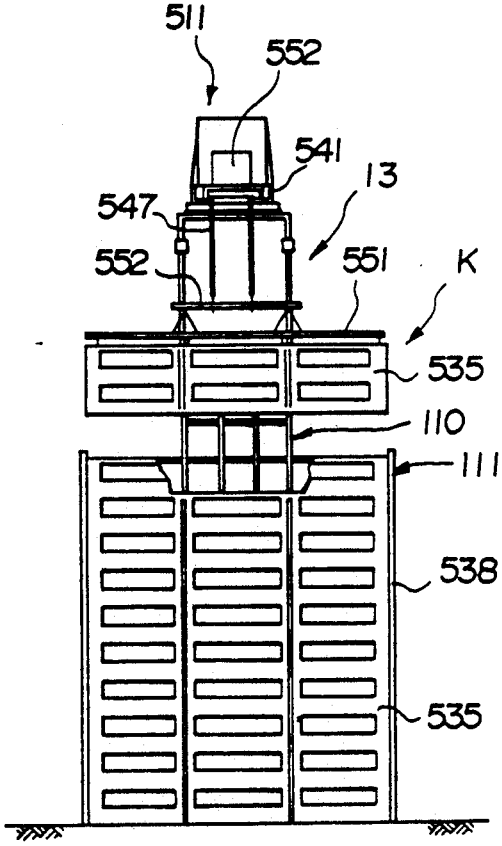
FIG. 48 is a side view of the apparatus and building shown in FIG. 47.
Figure 49:
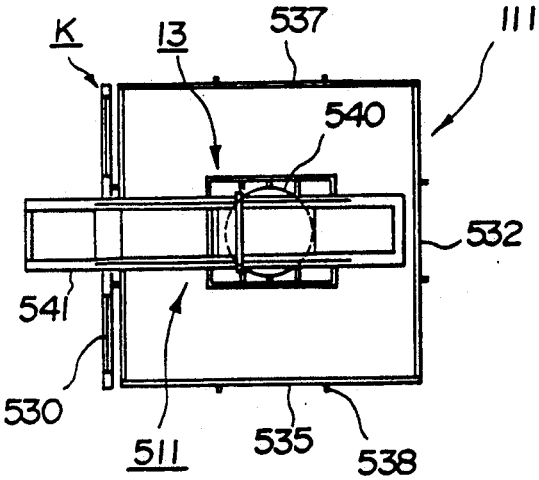
FIG. 49 is an overhead view of the apparatus and building shown in FIG. 47.

In addition, the peripheral portion 111 of the building K is constructed using with the temporary framework 13 and the swingable crane apparatus 511. As shown in FIG. 47, the core portion 110 is constructed so as to be taller than the peripheral portion 111 by the height of four stories. The peripheral portion 111 is then constructed in such a manner that the height of two stories is added thereto. Blocks 530 to 537 which form portions of two stories are assembled on the ground simultaneously with the construction of the core portion 110. Then, the blocks 530 are transferred to desired positions of the peripheral portion 111.

Figure 50:
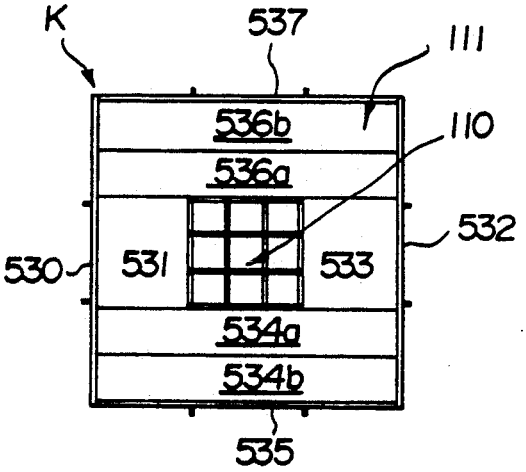
FIG. 50 is an overhead view of an arrangement of structural blocks in the building shown in FIG. 47.

The connection process of the blocks 530 to 537 to the peripheral portion 111 is described with reference to FIG. 50. First, a left wall block 530 and a floor block 531 are connected to the peripheral portion 111. Next, a right wall block 532 and a floor block 533 are connected to the peripheral portion 111. Then, a front wall block 535 and a floor blocks 534*a* and 534*b* are connected. Then, a rear wall block 537 and a floor blocks 536*a* and 536*b* are connected. In this case, when the blocks 530 to 537 are assembled on the ground, the blocks 530 and 531 were located at the left side of the building K. The blocks 532 and 533 were located at the right side of the building K. The blocks 534*a*, 534*b*, and 535 were located in front of the building K. The blocks 536*a*, 536*b*, and 537 were located at the back of the building K. As mentioned above, the assembling of the blocks 530 to 537 is conducted simultaneously with the construction of the core portion 110. The blocks 530 to 537 assembled on the ground are lifted up to the story under construction by means of the swingable crane apparatus 511 and using the guide rails 538 disposed at the side faces of the building K. In this case, the crane apparatus 511 is oriented to the left side, then right side, then front side, lastly rear side. The blocks 530 to 537 which form portions of two stories are connected to the blocks 530 to 537 which have been already constructed.

Figure 51:
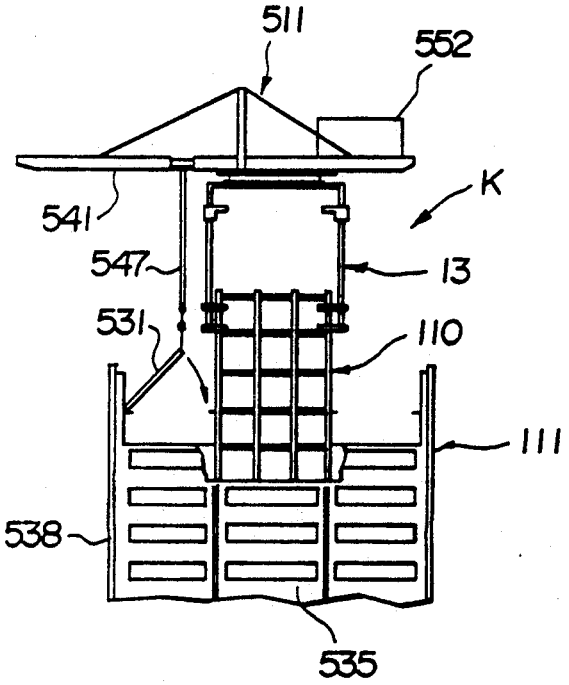
FIG. 51 is a front view of a section of the apparatus shown in FIG. 47 in operation.
Figure 52:
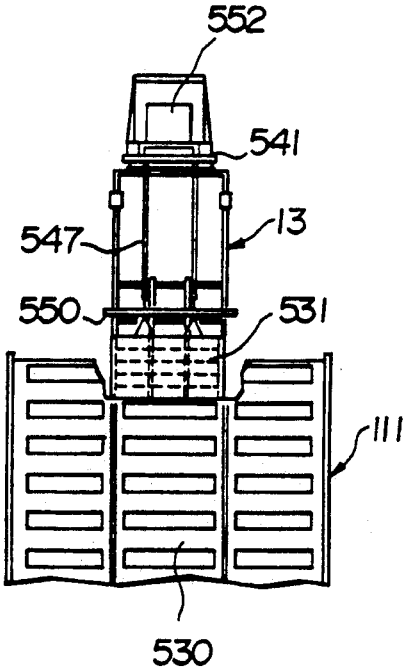
FIG. 52 is a side view of the apparatus shown in FIG. 47 in operation.

As shown in FIGS. 51 and 52, among the blocks 530 to 537, the floor blocks 531, 533, 534*a*, 534*b*, 536*a*, and 536*b* are connected to the building K after the wall blocks 530, 532, 535, and 537 are connected to the building K. For example, with respect to the floor block 531, the swingable crane apparatus 511 lifts the floor block 531 and introduces it to the building K over the wall block 530 at the left side of the building K. Then, the outer end of the floor block 530 is fixed to the wall block 530. The floor block 530 is oriented horizontally. Then, the inner end of the floor block 530 is fixed to the core portion 110.

Figure 53:
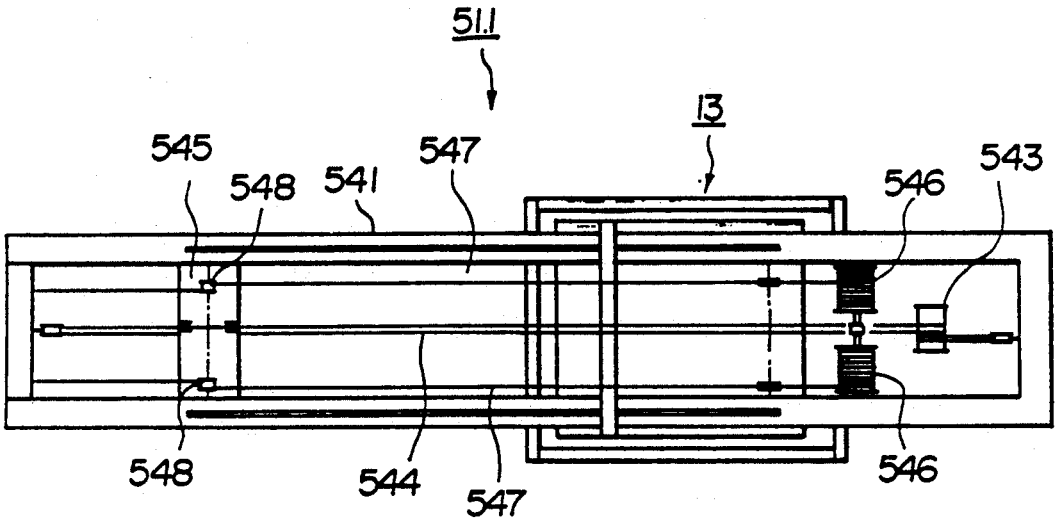
FIG. 53 is an overhead view of a swingable crane apparatus used in the apparatus shown in FIG. 47.
Figure 54:
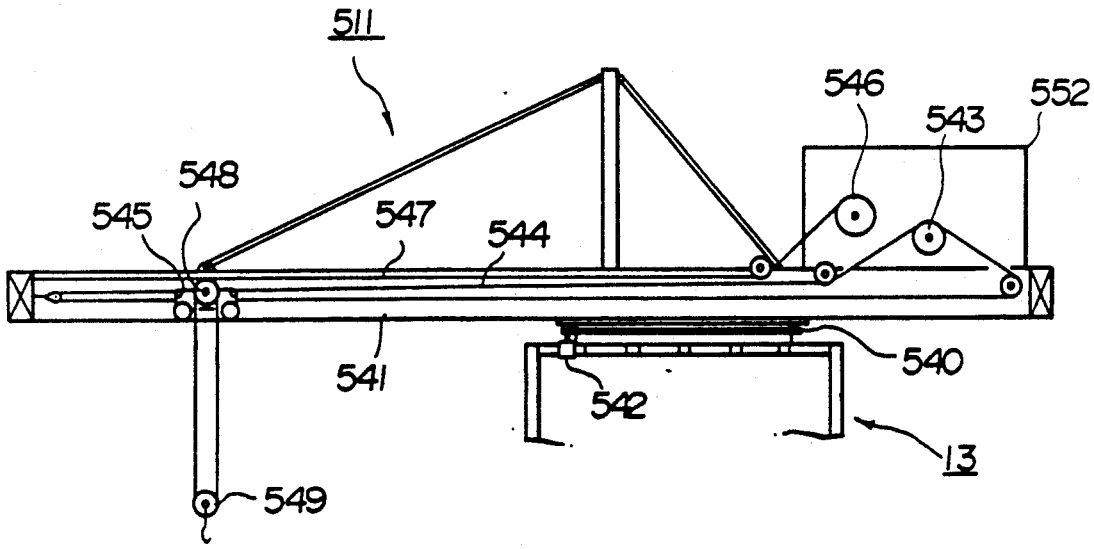
FIG. 54 is a side view of the crane apparatus shown in FIG. 53.

Next, with reference to FIGS. 53 and 54, the structure of the swingable crane apparatus 511 is described. The crane apparatus 511 comprises a turn table 540 mounted on the top of the temporary frame 13, and a main arm 541 rotatably disposed on the turn table 540. The main arm 541 is driven to rotate by a motor 542 disposed under the temporary beam 13. The main arm 541 has a length which can reach the entire periphery of the building K in order to connect the blocks 530 to 537 to the building K.

The main arm 541 is provided with a rope trolley 545 which is pulled in reverse directions by cable 544 wound around a travelling drum 543. In addition, a suspending cable 547 wound around a drum 546 reciprocates between a fixed sheave 548 and a hook sheave block 549 on the trolley 545. An end of the cable 547 is fixed to the front end of the main arm 541 so as to suspend and elevate a suspended beam 550 and an elongated suspended beam 551. The drums 543 and 546 are contained within a machine room 552 on the crane apparatus.

As can be understood from the above description, according to the seventh embodiment, using with the temporary beam 13, the swingable crane apparatus 511, and the inner crane apparatus (vertical transferring means) 12, the additional construction of the core portion 110, the lifting of the temporary framework 13, the lifting of the blocks to the peripheral portion 111, the additional construction of the peripheral portion 111 are simultaneously carried out, whereby the building K is progressively constructed as a whole. At the same time, the blocks 530 to 537 are assembled on the ground. Accordingly, the time for construction of the building K can be shortened.

In addition, since the relatively large blocks are lifted and additionally constructed in the building K, the time required for lifting can be reduced.

Furthermore, since the swingable crane apparatus 511 disposed on the temporary framework 13 supported on the core portion 110 lifts up the blocks 530 to 537, the lifting operation can be carried out at any position.

By virtue of the above described method, the time for vertical transferring the structural elements to elevated sites can be reduced. In addition, the time of assembling the structural elements at hazardous elevated sites can be reduced. Accordingly, the time of the construction can be shortened.

Furthermore, the inner crane apparatus (vertical transferring device) 12 for vertical transferring the structural elements for the core portion 110 and attached to the temporary framework 13 is supported and can be raised on the core portion 110. Accordingly, the number of columns, lifting mechanisms for the inner crane apparatus 12, and winches for the inner crane apparatus can be reduced, which is economically advantageous.

Next, with reference to FIGS. 55 through 60, an eighth embodiment of the present invention will be described.

Figure 55:
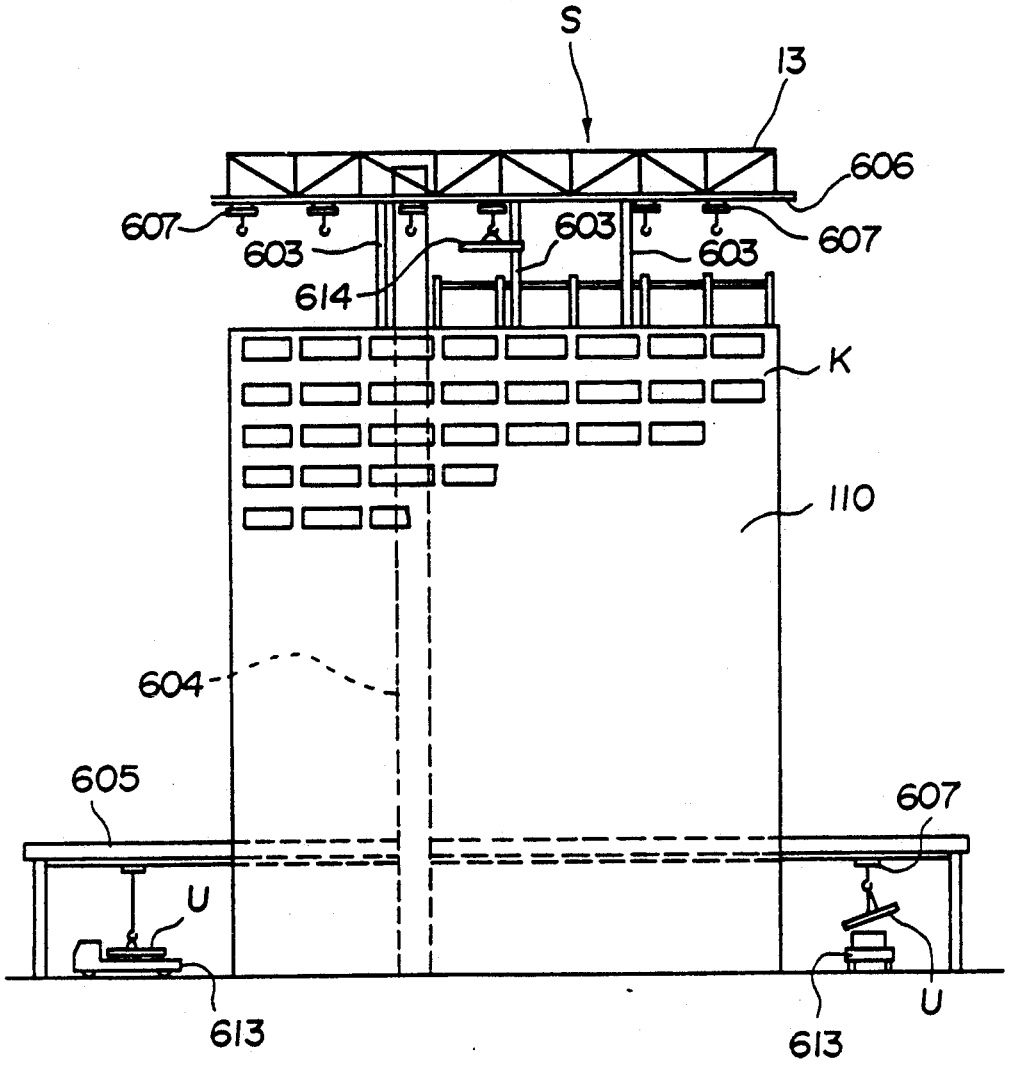
FIG. 55 is a front view of a construction apparatus according to an eighth embodiment of the present invention which is located on a building under construction.

In FIG. 55, reference numeral 110 designates a core portion 110 of a building K to be constructed. A construction apparatus S according to the eighth embodiment comprises a plurality of lifting columns 603, lifting mechanisms (not shown) for lifting the lifting columns 603, a temporary framework 13 supported on the lifting columns 603, a vertical transferring device 604 vertically penetrating a section of the building K from the ground to the top of the building K, a first horizontal transferring device 605 disposed on the ground and communicating with the lower portion of the vertical transferring device 604, a second horizontal transferring device 606 disposed under the temporary framework 13 for communicating with the upper portion of the vertical transferring device 604, and a plurality of movable hoists 607 which can travel along the vertical transferring device 604, the horizontally travelling devices 605 and 606 and which can transfer between the vertical transferring device 604 and the horizontally travelling devices 605 and 606.

The upper ends of the lifting columns 603 are unitarily connected to the temporary framework 13. The lower portions of the lifting columns 603 are coupled with the lifting mechanisms provided at the core portion 110, whereby the temporary framework 13 can be moved upward and downward. In this embodiment, the lifting mechanisms can extend and retract since they are supported on the core portion 110 of the building K, so that the lifting columns 603 are raised and lowered. The description of the specific structure of the lifting mechanism is omitted.

Figure 56:
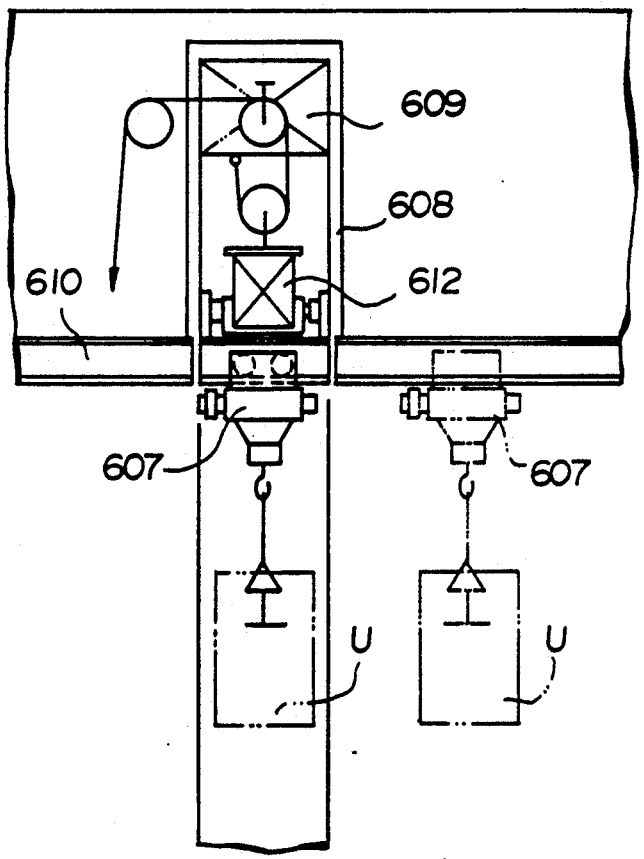
FIG. 56 is a side view of a connection between a vertical transferring device and a horizontal transferring device used in the apparatus shown in FIG. 55.

As shown in FIG. 56, the vertical transferring device 604 comprises a gate-like frame 608, and a suspended rail 610 disposed within the frame 608 which is capable of being elevated by means of a winch (not shown) disposed on the ground for transferring the movable hoist 607. The gate-like frame 608 is provided with a shift mechanism 612 for adjusting the position of the suspended rail 610 along the longitudinal axis thereof. In this embodiment, the vertical transferring device 604 is disposed inside of the building K, however it is possible for the vertical transferring device 604 to be outside of the building K.

The first horizontal transferring device 605 suspends the movable hoists 607. Trucks 613 convey structural elements U and stop below the first horizontal transferring device 605. The movable hoists 607, suspended from the first horizontal transferring device 605, capture the structural elements U on the trucks 613, and transfer to the vertical transferring device 604.

If the trucks 613 can easily move to a position below the vertical transferring device 604, it is possible to omit the provision of the first horizontal transferring device 605.

The second horizontal transferring device 606 comprises a plurality of rails 610 arranged at suitable positions of the lower surface of the temporary framework 13 so as to entirely cover the story under construction beneath the temporary framework 13. The rails 610 are connected to one another via the rotation rails 155 and the shift rails 157 shown in FIGS. 14 and 15.

With such a structure, once a movable hoist 607, suspended from the first horizontal transferring device 605 captures the structural element U from the truck 613 on the ground, the movable hoist 607 transfers to the second horizontal transferring device 606 through the vertical transferring device 604. Therefore, without detaching the structural element U, the hoist 607 can transfer the structural elements U from the ground to a desired position of the uppermost story through the first horizontally travelling device 605, the vertical transferring device 604, and the second horizontally travelling device 606.

During the transferring operation, a plurality of movable hoists 607 can be driven simultaneously. For example, while a movable hoist 607 is used for the additional construction of the structural elements U to the constructing story, empty hoists 607 can be returned to the ground.

Accordingly, the time for transferring the structural elements U can be shortened, and the inactive time of the hoists 607 can be shortened. In this way, the operational efficiency of the transferring and constructing can be enhanced.

Figure 57:
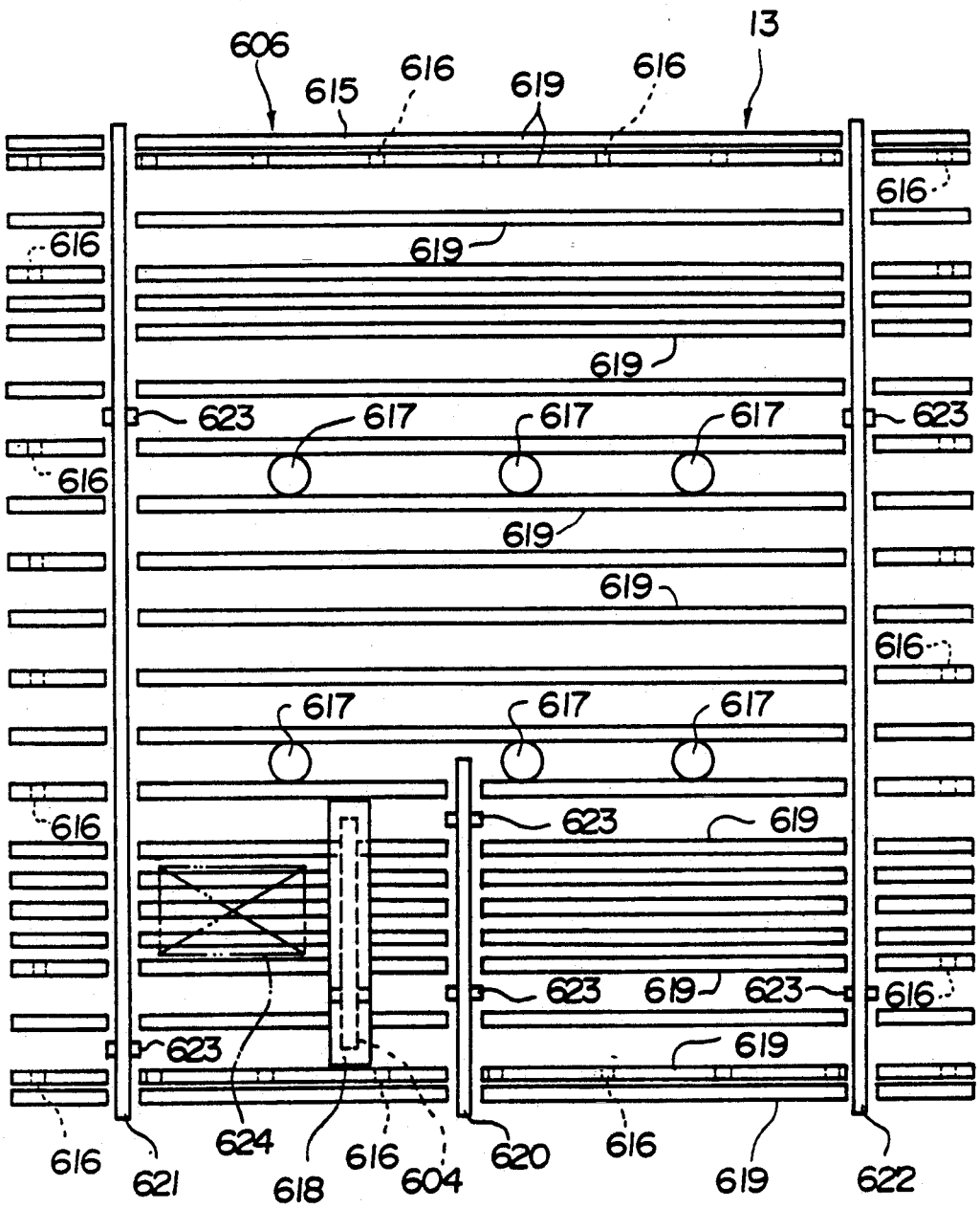
FIG. 57 is a plan view of an example of the horizontal transferring device shown in FIG. 56.

FIG. 57 shows the detailed structure of the second horizontal transferring device 606. According to the horizontal transferring device 606, a plurality of beams 615 are provided parallel to one another under the lower surface of the temporary framework 13. I-beam rails 619 are fixed to the lower surfaces of the beams 615. In this case, it is unnecessary to provide a large number of I-beam rails 619 near positions 616 for the permanent columns and near positions 617 for the lifting columns 603. In contrast, a large number of rails 619 are provided near position 618 for the vertical transferring device 604. Shift I-beam rails 620, 621, and 622 are provided under the lower surface of the temporary framework 13 so as to be perpendicular to the fixed rails 619. Auxiliary rails 623 are suspended from each of the shift rails 620, 621, and 622 movably along the longitudinal axes thereof. Accordingly, the movable hoists 607 can transfer from one of the fixed rails 619 to another fixed rail 619 through the movable auxiliary rails 623.

The fixed rails 619 and the shift rails 620, 621, and 622 protrude slightly outward from the positions 616 for the permanent columns of the building K, so that the hoists 607 can move outward from the positions 616. The arrangement of the auxiliary rails 623 is not intended to be limited as shown in FIG. 57.

According to the above structure, since the position of the rail 611 in the vertical transferring device 604 can be adjusted by the shift mechanism 612 as shown in FIG. 56, the hoist 607 can move from the vertical transferring device 604 to the nearest fixed rail 619 of the second horizontal transferring device 606 shown in FIG. 57. Then, the hoist 607 can move from the rail 619 to a desired rail 619 through the auxiliary rail 623 of one of the shift rails 620, 621, and 622. Thus, the hoists 607 can convey the structural elements U toward the desired position in the story under construction.

After the transfer of the structural element U, the movable hoist 607 move to a waiting point 624 in FIG. 57. Then, the hoist 607 returns to the ground through the vertical transferring device 604.

The above described movement of the hoists 607 may be controlled automatically. In this case, the positions where the structural elements U should be released in the story under construction are input in a control device. The transfer of the hoists 607 by the auxiliary rails 623 is programmed in the control device.

According to the second horizontal transferring device 606, the structural elements U can be quickly moved by means of the hoists 607 which can move to and from the rails 619. Besides, a plurality of hoists 607 can move simultaneously.

Figure 58:
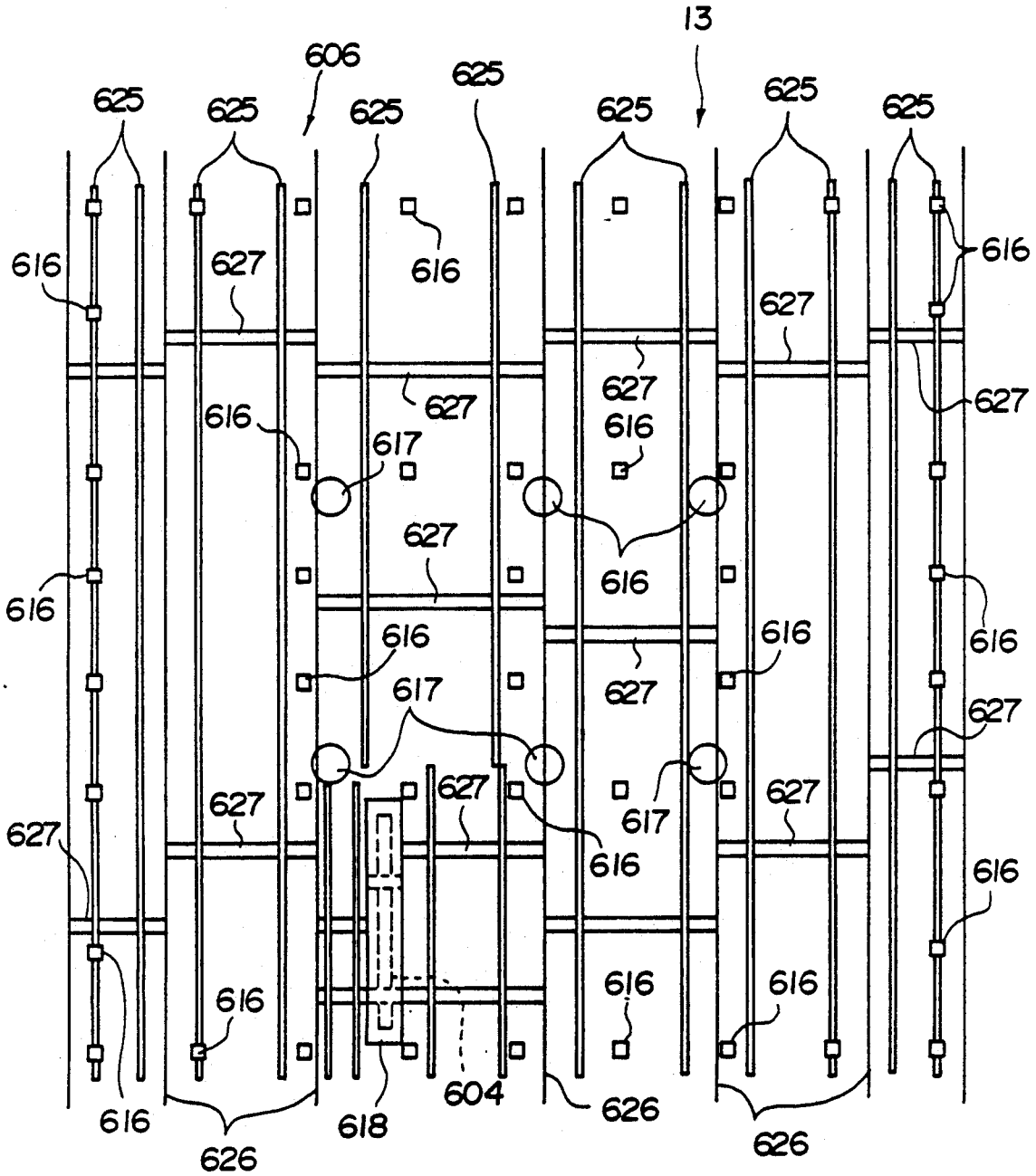
FIG. 58 is a plan view of another example of the horizontal transferring device shown in FIG. 56.
Figure 59:
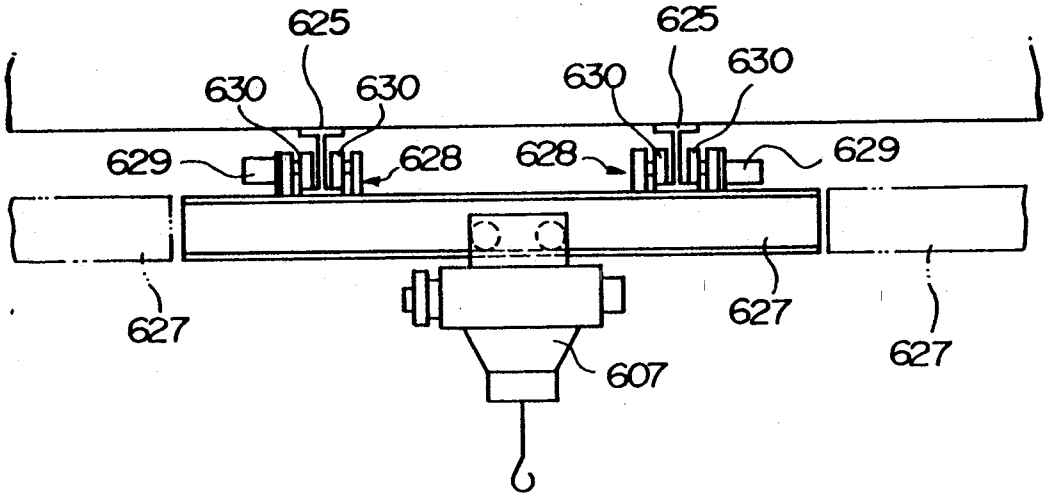
FIG. 59 is a front view of a roller hanger used in the device in FIG. 58.
Figure 60:
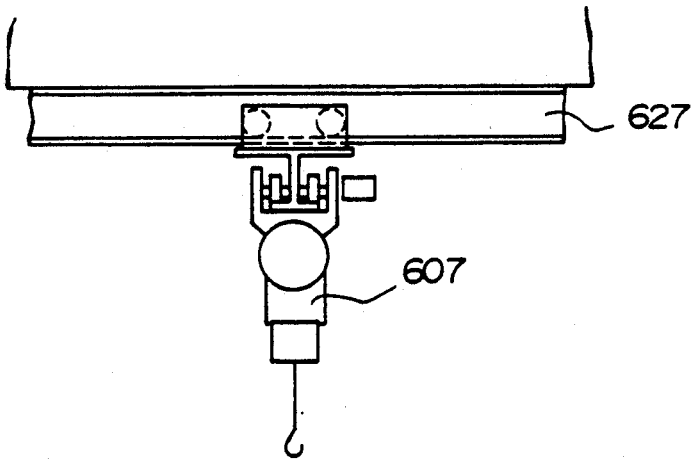
FIG. 60 is a side view of the roller hanger shown in FIG. 59.
Figure 61:
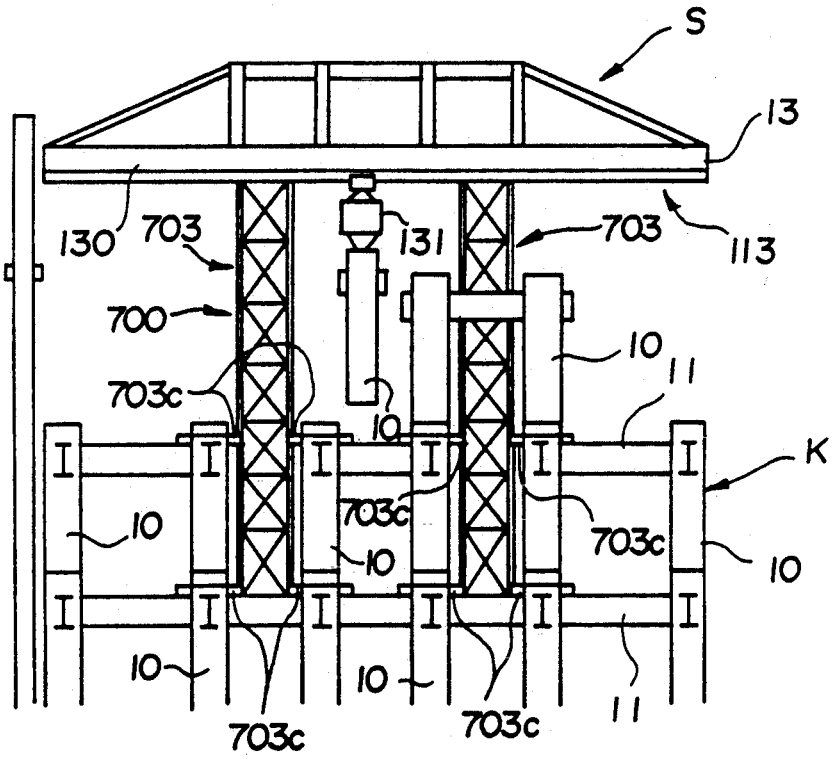
FIG. 61 is a front view of a construction apparatus according to a ninth embodiment of the present invention.

Another example of the arrangement of the second horizontal transferring device 606 is shown in FIGS. 58 to 60. Similar reference numerals indicate components similar to those of the preceding example, so that the description of the components is simplified.

As illustrated in FIG. 58, the second horizontal transferring device 606 in this example comprises a plurality of I-beam shift rails 625 provided parallel to one another under the temporary framework 13. As shown clearly by divisional lines 626 parallel to the shift rails 625, the shift rails 625 are comprised of a plurality of pairs thereof. Auxiliary rails 627 are suspended from each pair of the shift rails 625 movably along the longitudinal axes of the shift rails 625. Accordingly, the movable hoists 607 can move to and from the auxiliary rails 627 suspended from adjoining pairs of the shift rails 625.

As shown in FIGS. 59 and 60, each of the auxiliary rails 627 is suspended from a pair of shift rails 625 via roller hangers 628 mounted on both ends of the auxiliary rail 627. Each roller hanger 628 comprises a motor 629 mounted on the auxiliary rail 627 and rollers 630 driven by the motor 629. The rollers 630 are located at both sides of the web of the shift rail 625 and on the lower flange of the shift rail 625 so as to travel along the web of the shift rail 625.

In accordance with this example, the hoist 607 moves from the vertical transferring device 604 to one of the auxiliary rails 627. Then, the movable hoist 607 move to and from the auxiliary rails 627 suspended from adjoining pairs of the shift rails 625, whereby the hoist 607 with the structural element U reaches a desired position in the story under construction. Some of the empty hoists 607 at the auxiliary rails 627 are used for positioning of the structural element U under construction. Some of the empty hoists 607 are moved to the ground through the vertical transferring device 604.

The above-described movement of the hoists 607 may also be controlled automatically. The dimensions of the shift rails 625 and the number of the auxiliary rails 627 can be selected freely due to the dimensions of the story under construction.

With the above second horizontally transferring device 604, the auxiliary rails 627 can travel over all of the story under construction except for the positions 617 for the lifting columns 603. Accordingly, the stop positions of the hoists 607 for releasing the structural elements U can be determined freely and the positioning can be achieved accurately. The transfer of the structural elements U can be accomplished accurately and effectively.

Next, with reference to FIGS. 61 through 78, a ninth embodiment of the present invention will be described. A construction apparatus S according to the ninth embodiment is constructed and located above a building K under construction. The building K includes a framework constituted of permanent columns 10 and permanent beams 11.

The construction apparatus S comprises a temporary framework 13 constructed and located above the building K, four lifting mechanisms 700 for lifting the temporary framework 13, and a movable hoist 131 for hoisting structural elements, for example, permanent columns 10. A horizontal transferring device 113, which is similar to that of the third embodiment described with reference to FIGS. 26 to 29, is provided under the temporary framework 13, for horizontally transferring the movable hoist 131. As will be described later, each lifting mechanism 700 is able to be supported by the building K, and is able to lift the lifting mechanism 700 itself.

Figure 63:
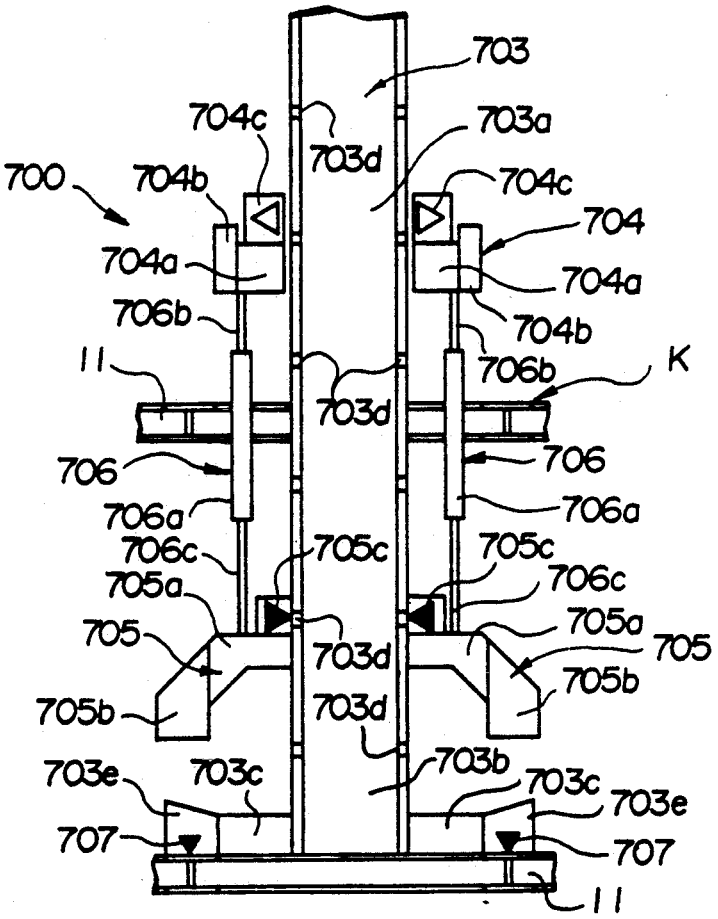
FIG. 63 is a front view of a lifting mechanism used in the construction apparatus shown in FIG. 61, when hydraulic actuators of the lifting mechanism are extended.
Figure 64:
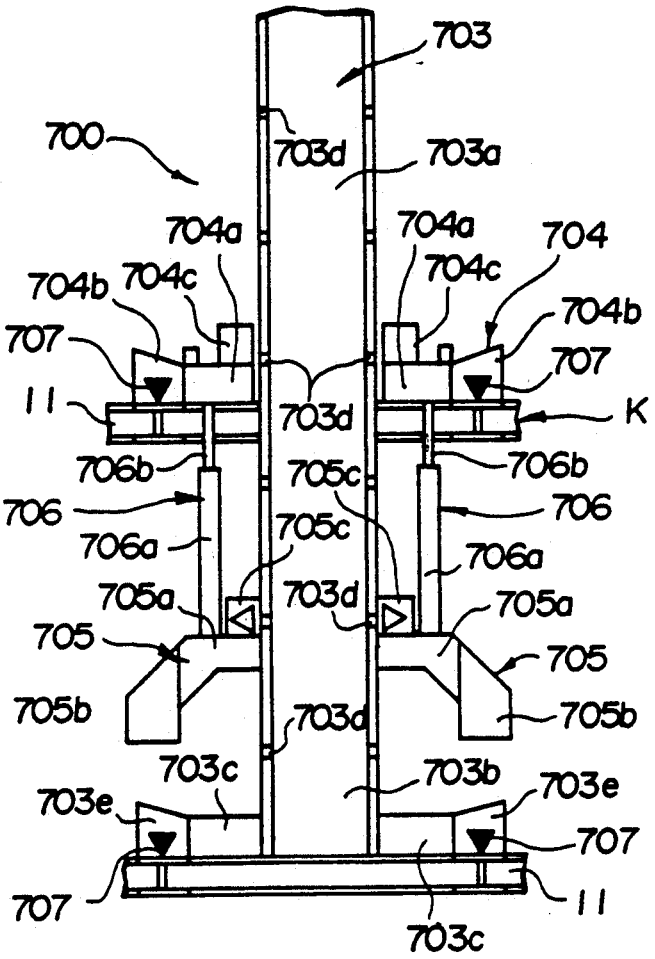
FIG. 64 is a front view of the lifting mechanism shown in FIG. 63, when hydraulic actuators of the lifting mechanism are retracted.

As best shown in FIGS. 63 and 64, the lifting mechanism 700 comprises a temporary column (mast) 703 erected on a permanent beam 11 of the building K; upper and lower lifting frames 704 and 705 which are detachably attached to the temporary column 703; and hydraulic actuators 706 extending between the upper and lower lifting frames 704 and 705.

Figure 62:
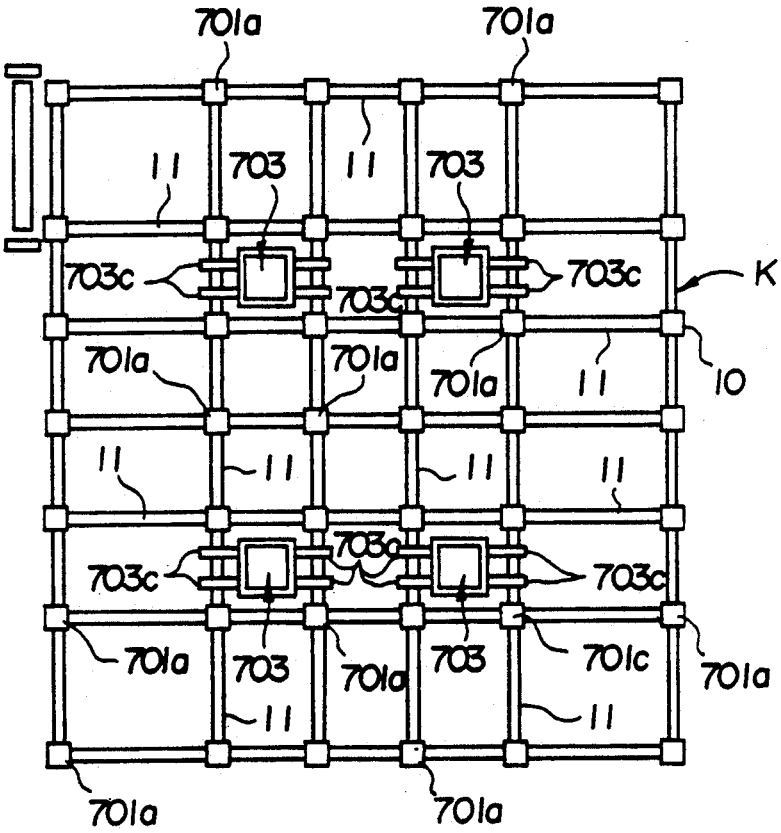
FIG. 62 is an overhead view of the construction apparatus shown in FIG. 61.

Each of the temporary framework 703 comprises a column-like mast body **703*a* of a square cross section and two pairs of mast bases 703*c* mounted on the lower end 703*b* of the mast body 703*a* (see FIG. 62). A plurality of pin-holes (through-holes) 703*d* are formed at the side walls of the mast body 703*a* and spaced at a regular interval. Two pairs of mast bases 703*c* are attached to the lower end 703*b* of the mast body 703*a* rotatably about the longitudinal axis of the mast body 703*a*. Each of the mast bases 703*c* is a plate disposed in a horizontal plane. The bottom surface of the mast base 703*c* is flush with the lower end of the mast body 703*a*. A first load-support 703*e* is connected to the outer end of each of the mast bases 703*c*** so as to be folded in a horizontal plane where the mast base is disposed.

As shown in FIGS. 63 and 64, the upper lifting frame 704 comprises frame members **704*a* of which the inner ends are into contact with the mast body 703*a*, and second load-supports 704*b* connected to the outer ends of the frame members 704*a* so as to be folded in a horizontal plane where the frame members 704*a* are disposed. Each of the frame members 704*a* is of a rectangular shape in side view. Upper lock-pin devices 704*c* are provided at the tops of the frame members 704*a*, respectively, so as to be into contact with the mast body 703*a*. The lock-pin devices 704*c* are detachably attached to the pin-holes 703*d* of the mast body 703*a***.

As shown in FIGS. 63 and 64, the lower lifting frame 705 comprises frame members 705a of which the inner ends are into contact with the mast body 703a, and legs 705b extending downward from the outer ends of the frame members 705a. Each of the frame members 705a is of a generally L-shape, and the outer end thereof extends downward. Lower lock-pin devices 705c are provided at the tops of the frame members 705a, respectively, so as to be into contact with the mast body 703a. The lock-pin devices 704c are detachably attached to the pin-holes 703d of the mast body 703a. The legs 705b are disposed on the first load-supports 703e and cooperate to encase the load-supports 703e.

Each of the hydraulic actuators 706 comprises a cylinder body 706a oriented vertically, an upper rod 706b extending upward from the cylinder body 706a, and a lower rod 706c extending downward from the cylinder body 706a. The upper rod 706b can extend and retract along the cylinder body 706a, and the upper end of the upper rod 706b is attached to the upper frame member 704a. The lower rod 706c can extend and retract along the cylinder body 706a, and the lower end of the lower rod 706c is attached to the lower frame member 705a.

The upper and lower frames 704 and 705 and the hydraulic actuators 706, as a whole, can rotate about the longitudinal axis of the mast body 703a. The first load-supports 703e, the second load-supports 704b, and the legs 705b are provided with beam-lock-pin devices 707 which is detachably attached to the permanent beams 11 of the building K.

Figure 65:
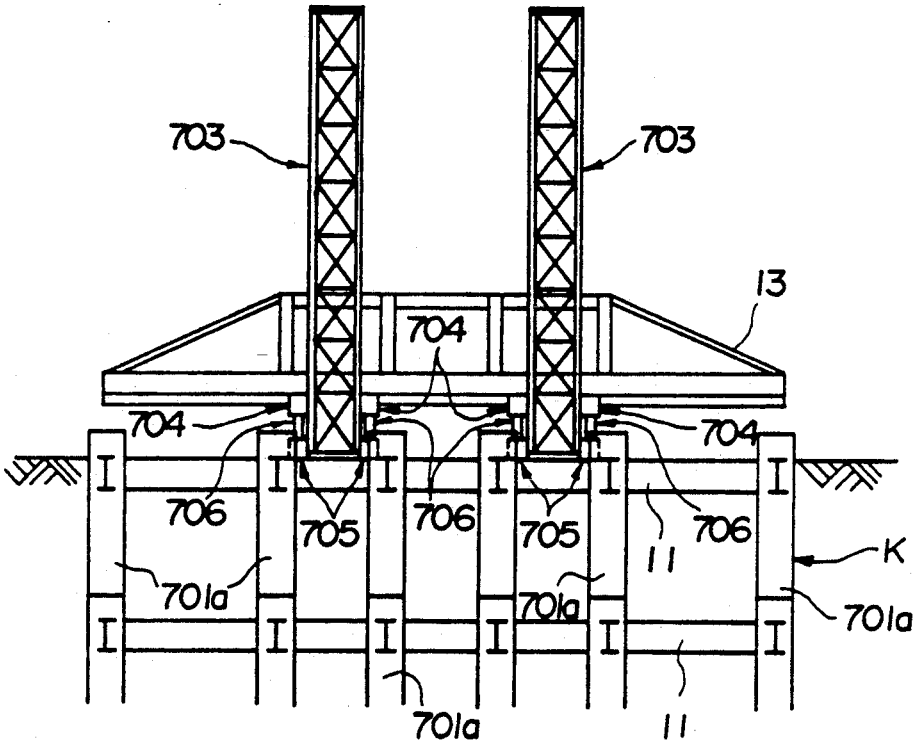
FIG. 65 is a front view of the construction apparatus shown in FIG. 61, showing a construction process for the construction apparatus.
Figure 67:
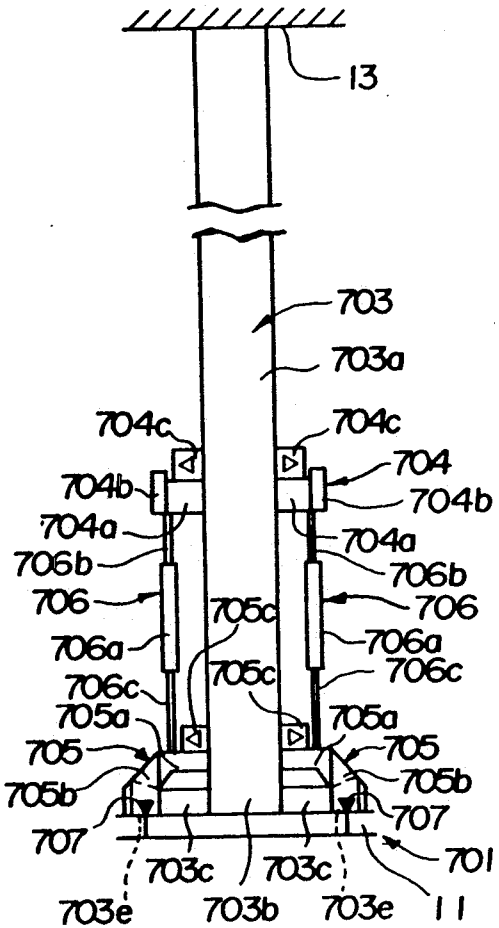
FIG. 67 is a front view of the lifting mechanism shown in FIG. 63, showing an initial step of a method of lifting of the lifting mechanism.

Next, the method of use of the construction apparatus, especially, the method of use of the lifting mechanisms 700 will be described. First, as shown in FIG. 65, the framework of the basement of the building K is constructed underground. The temporary columns 703 are erected on the framework underground. The mast bodies 703a of the temporary columns 703 are constituted of a large number of small pieces. Next, the above-described lifting mechanisms 700 are constructed on the mast bases 703c of the temporary columns 703 as shown in FIG. 67.

After the construction of the lifting mechanisms 700, as shown in FIG. 65, the temporary framework 13 is constructed so as to be supported on the frame members 704a of the upper frames 704 of the lifting mechanisms 700. In this case, the lower portion of the temporary framework 13 is located on the frame members whereby the load of the temporary framework 13 is supported on the upper frames 704.

Figure 66:
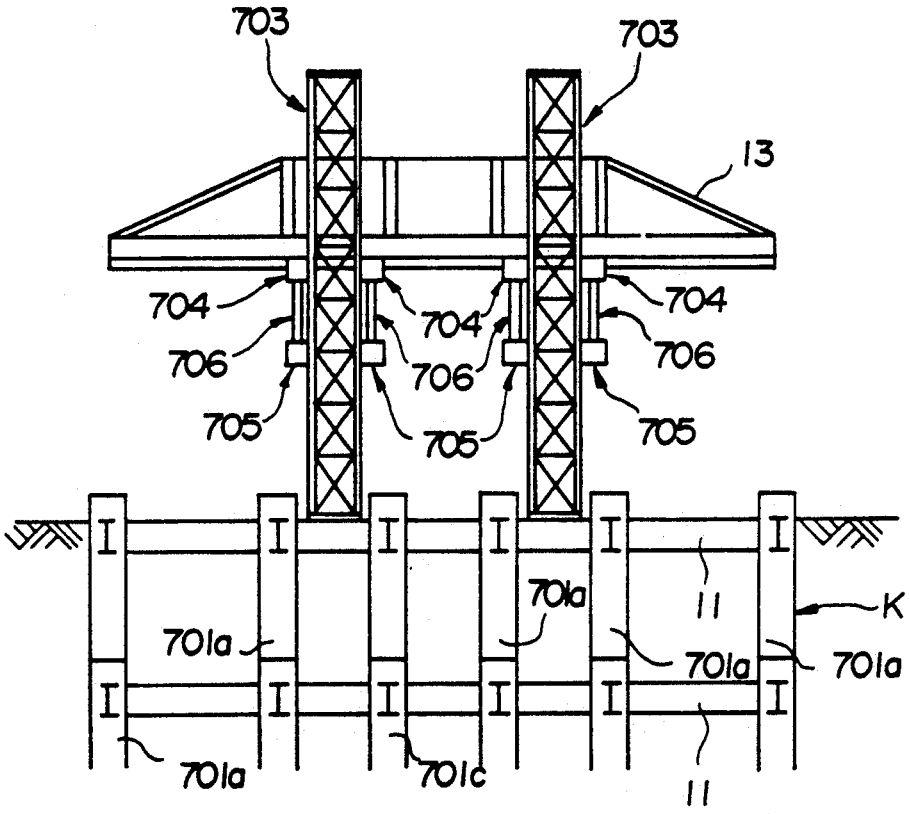
FIG. 66 is a front view of the construction apparatus shown in FIG. 61, showing the next step of FIG. 65.

After the construction of the temporary framework 13, as shown in FIG. 66, the frame members 704a of the upper frames 704 are driven so that the temporary framework 13 is elevated. Once the temporary framework 13 reaches the upper ends of the temporary columns 703, the lifting of the temporary framework 13 is stopped. Then, the temporary framework 13 and the temporary columns 703 are coupled together, so that the construction apparatus S is assembled.

The method of use of the lifting mechanisms 700 is as follows:

First, as shown in FIG. 67, the legs 705b of the lower frame 705 are located on the first load-supports 703e of the temporary column 703. In this case, the beam-lock-pin devices 707 provided at the first load-supports 703e are locked to the permanent beam 11 of the building K, whereby the first load-supports 703e are fastened to the permanent beam 11, and the other beam-lock-pin devices 707 are not locked.

Figure 68:
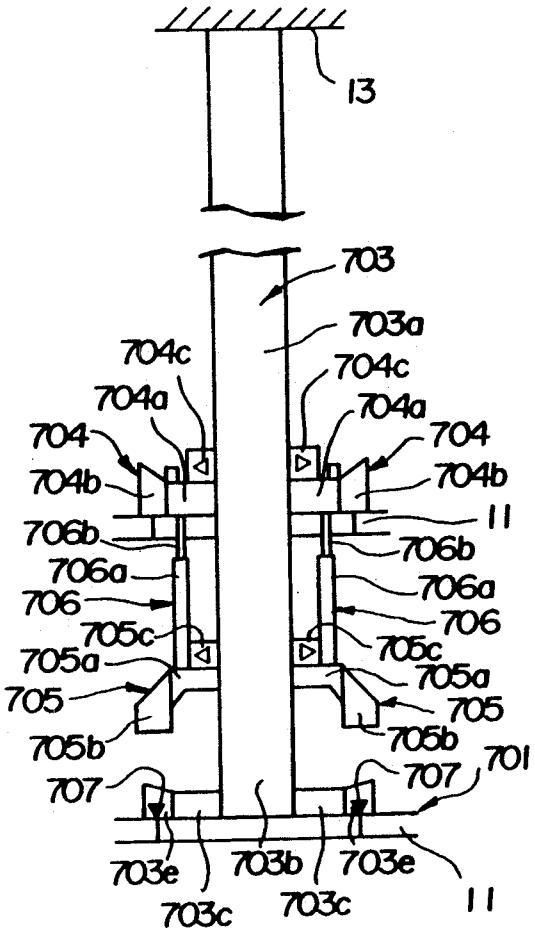
FIG. 68 is a front view showing the next step of FIG. 67.

Then, as shown in FIG. 68, the beam-lock-pin devices 707 provided at the second load-supports 704b of the upper frame 704 are locked to the upper permanent beam 11, whereby the upper frame 704 is fastened to the upper permanent beam 11. Next, the lower rods 706c of the hydraulic actuators 706 are retracted so that the lower lifting frame 705 is raised.

Figure 69:
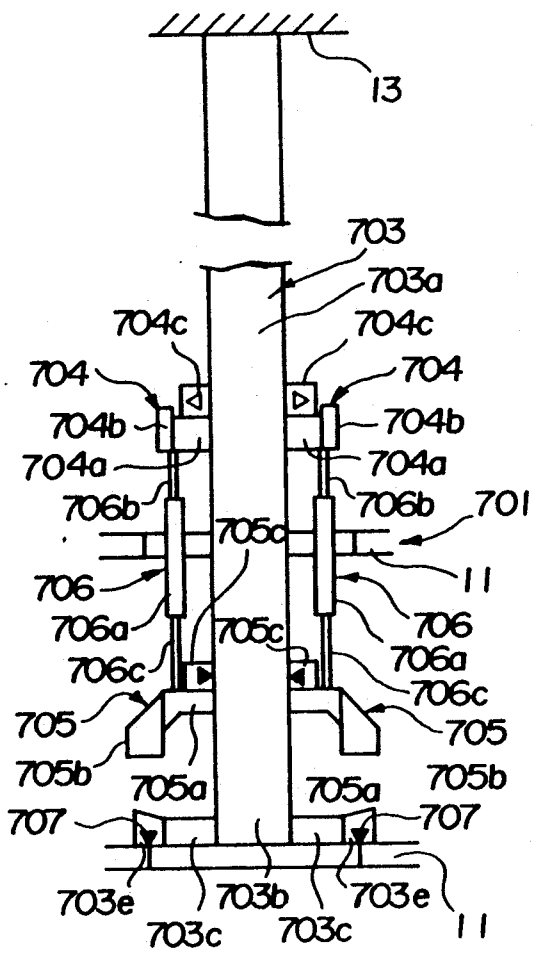
FIG. 69 is a front view showing the next step of FIG. 68.

Then, as shown in FIG. 69, the lower lock-pin devices 705c of the lower frame 705 are fixed to the pin-holes 703d of the temporary column 703. Next, the lower rods 706c are extended, so that the upper lifting frame 704 is raised.

Figure 70:
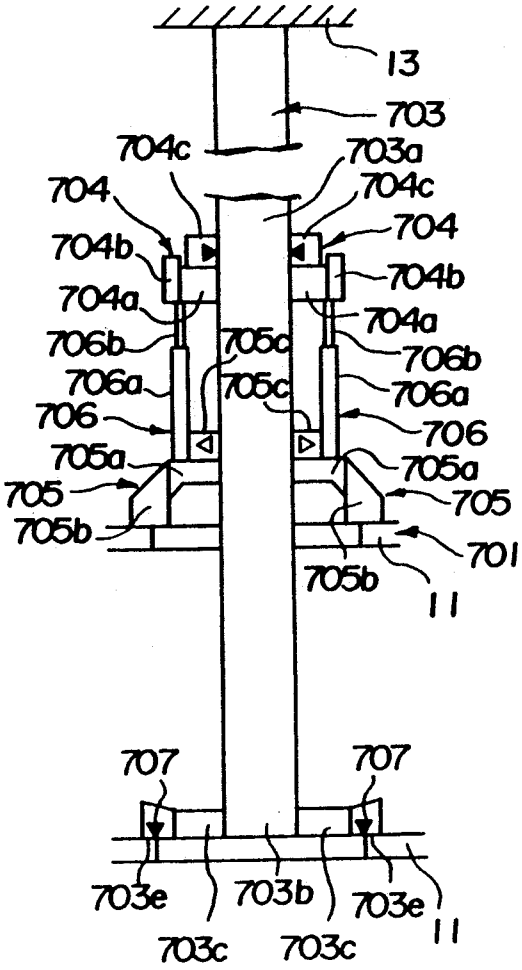
FIG. 70 is a front view showing the next step of FIG. 69.

Then, as shown in FIG. 70, the upper lock-pin devices 704c of the upper frame 704 are fixed to the pin-holes 703d of the temporary column 703. Next, the lower rods 706c are retracted, so that the lower lifting frame 705 is raised to reach the upper permanent beam 11. The legs 705b of the lower frame 705 are fixed to this upper permanent beam 11 by means of the beam-lock-pin devices 707 provided at the legs 707. Accordingly, the upper and lower lifting frame 704 and 705, and the hydraulic actuators 706 are moved from the lower permanent beam 11 to the upper permanent beam 11.

Figure 71:
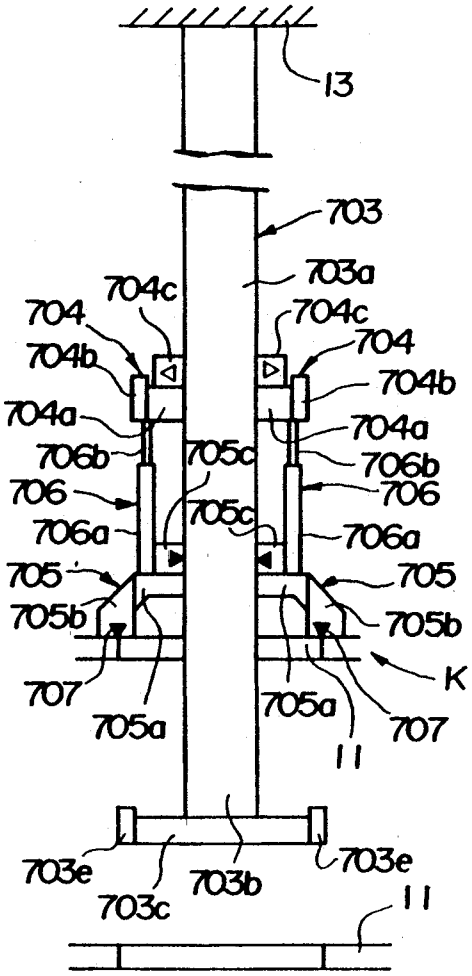
FIG. 71 is a front view showing the next step of FIG. 70.

Sequentially, as shown in FIG. 71, the legs 705b and the lower lock-pin devices 705c of the lower lifting frame 705 are locked together, so that the lower lifting frame 705 supports the load of the temporary column 703. Then, the first load-supports 703e are released, and the lower rods 706c of the hydraulic actuators 706 are retracted, whereby the temporary column 703 are lifted. After the first load-supports 703e are released, the first load-supports 703e are folded.

Figure 72:
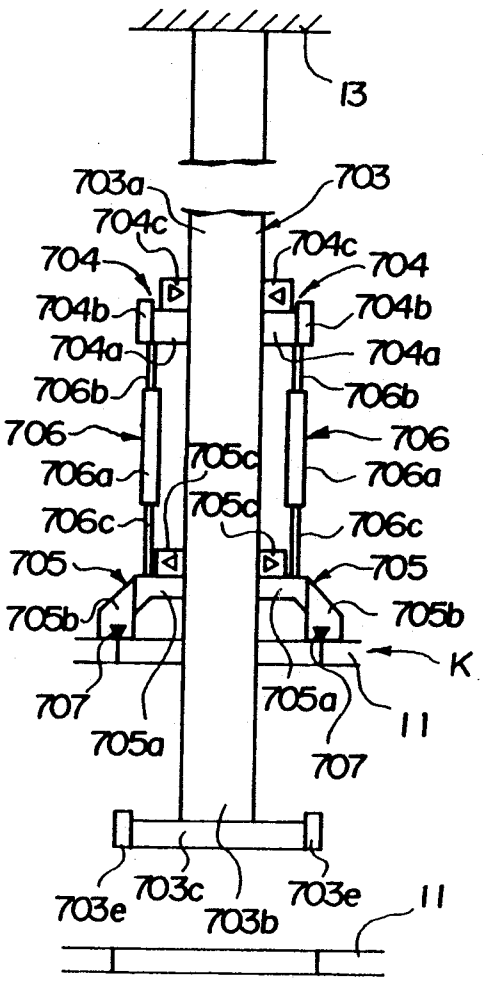
FIG. 72 is a front view showing the next step of FIG. 71.
Figure 73:
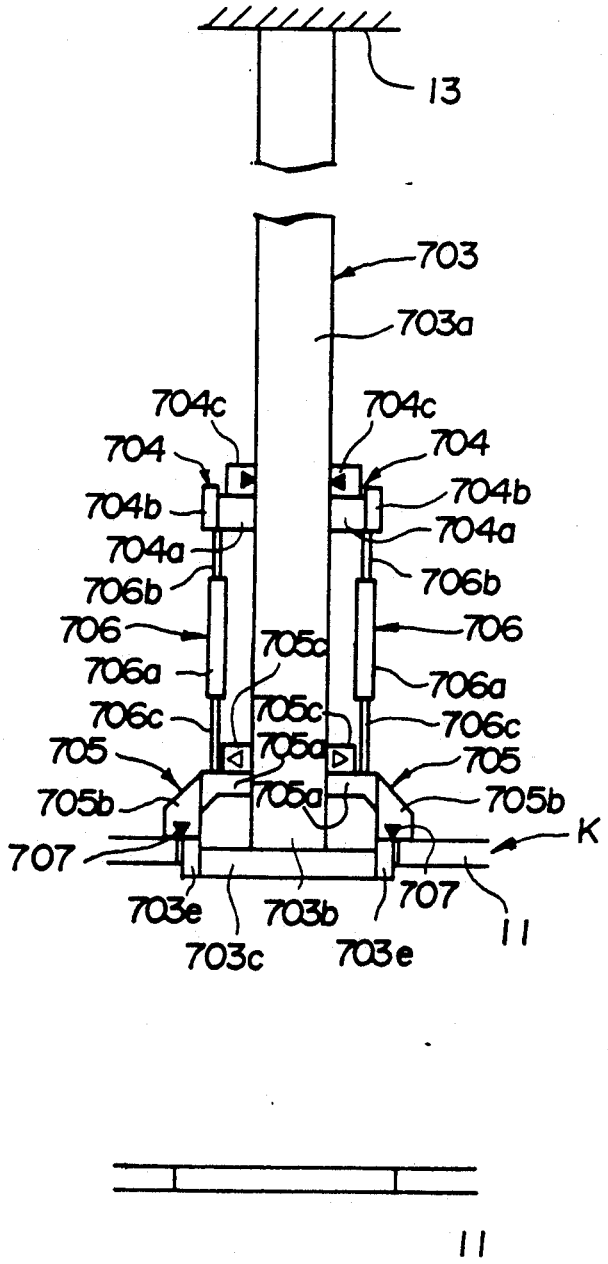
FIG. 73 is a front view showing the next step of FIG. 72.

After the lifting of the temporary column 703, as shown in FIG. 72, the upper lock-pin devices 704c are released, and the lower rods 706c are extended so that the upper lifting frame 704 is set at an upper position. Then, as shown in FIG. 73, the lower lock-pin devices 705c are released and the lower rods 706c of the hydraulic actuators 706 so that the temporary column 703 is raised to the upper permanent beam 11. The first load-supports 703e are opened, so that the entire load is supported on the upper permanent beam 11.

The above-described process is repeated, so that the temporary column 703 is raised to desirable elevation. During the above-described process, interference between the mast base 703c and the framework of the building K can be avoided by the rotation of the mast bases 703c. In addition, interference between the upper and lower lifting frames 704 and 705 and the framework of the building K can be avoided by the rotation of the second load-supports 704b and the legs 705b.

Figure 75:
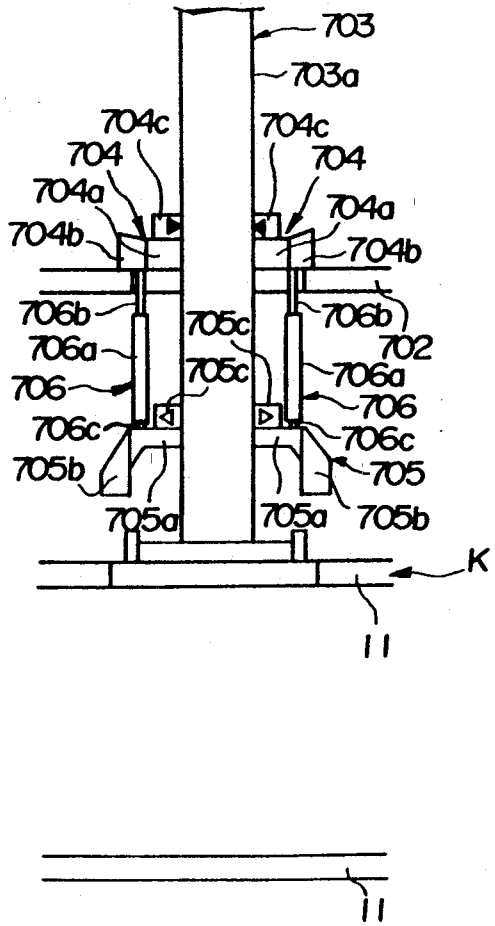
FIG. 75 is a front view showing the next step of FIG. 74.
Figure 74:
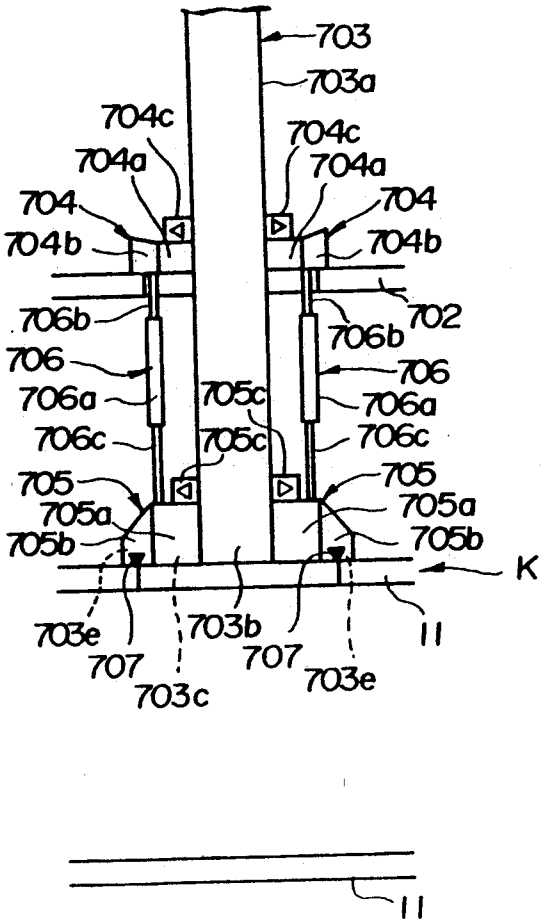
FIG. 74 is a front view of the lifting mechanism shown in FIG. 63, showing an initial step of a method of lowering of the lifting mechanism.

On the contrary, lowering of the temporary column 703 by means of the lifting mechanism 700 is achieved as follows:

First, as shown in FIG. 74, the upper lock-pin devices 704c of the upper frame 704 are released. Then, the upper frame members 704a are locked, and the lower rods 706c of the hydraulic actuators 706 are retracted, so that the lower lifting frame 705 is elevated as shown in FIG. 75.

Figure 77:
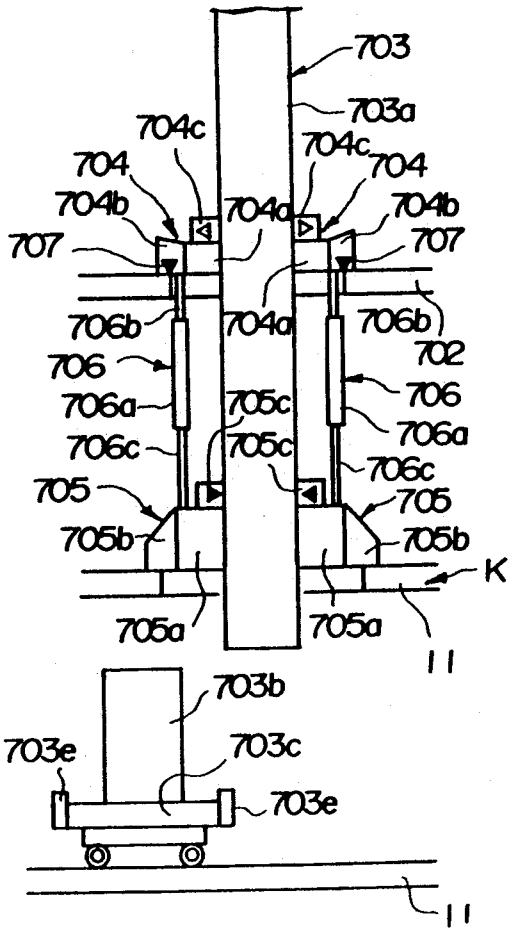
FIG. 77 is a front view of the lifting mechanism shown in FIG. 63, showing the method of disassembling of temporary column of the lifting mechanism.
Figure 76:
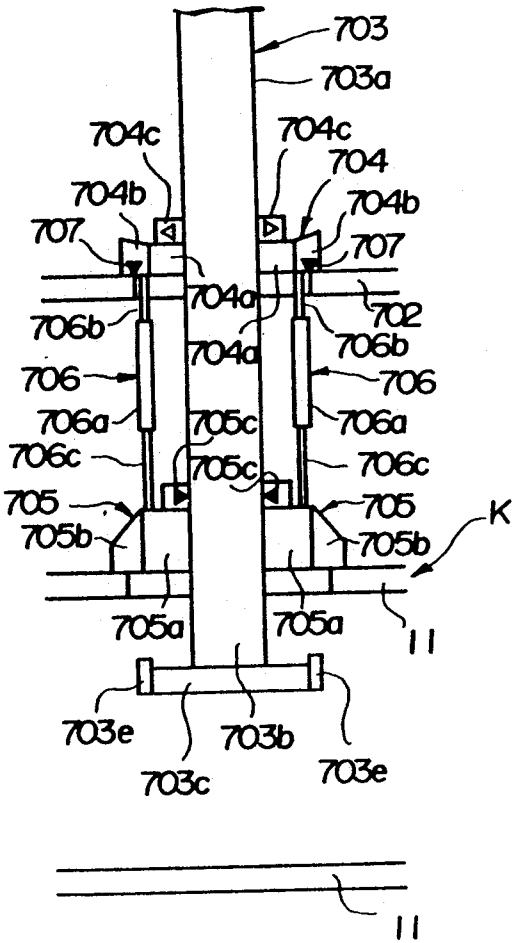
FIG. 76 is a front view showing the next step of FIG. 75.
Figure 78:
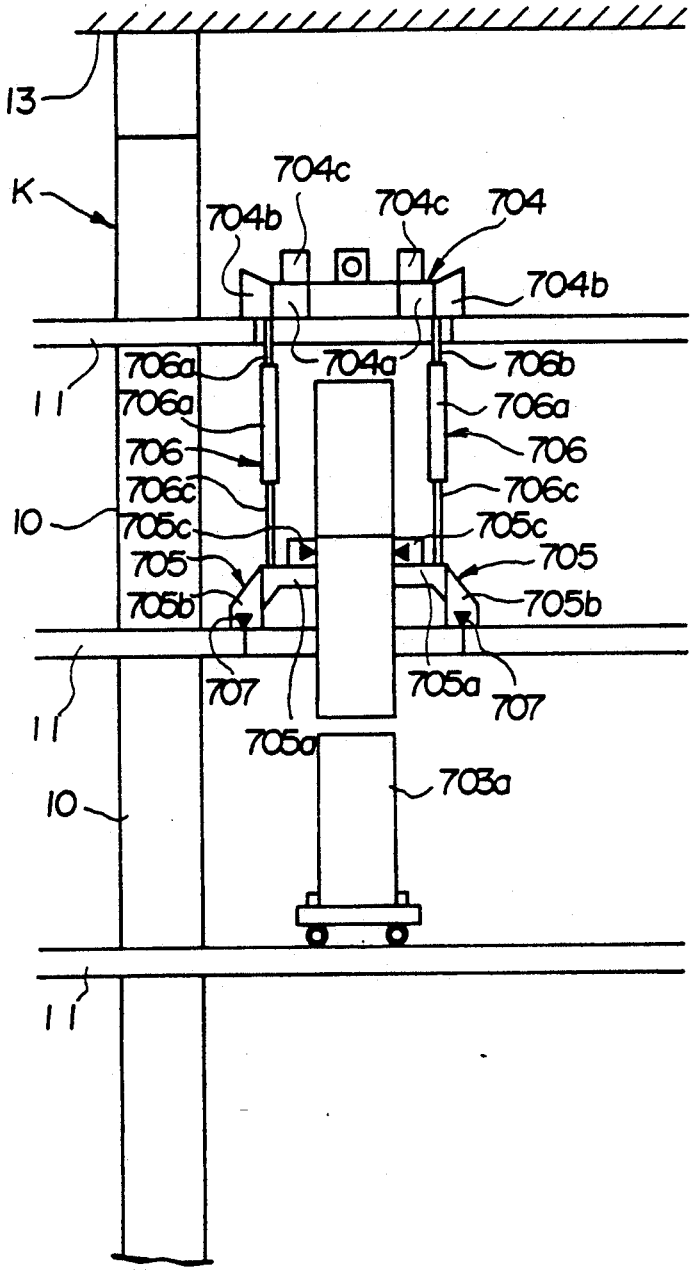
FIG. 78 is a front view showing the next step of FIG. 77.

Next, as shown in FIG. 76, the second load-supports 704b and the lower lock-pin devices 705c are locked and the upper frame members 704a are released. The lower rods 706c of the hydraulic actuators 706 are extended, so that the lower lifting frame 705 with the temporary column 705 is lowered. Then, as shown in FIG. 77, the lower end 703b of the mast body 703a of the temporary column 705 is removed from the mast body 703a. The removal of the lower end of the mast body 703*a* and the lowering of the temporary column 703 are repeated so that the mast body 703*a* is progressively disassembled as shown in FIG. 78.

According to the above-described lifting mechanisms 700, the lifting mechanisms 700 can be readily assembled in the area of the building K. In addition, the since the first and second load-supports 703*c* and 704*b* can be folded, the interference against the permanent structure of the building K or the temporary framework 13 can be avoided. Consequently, the building K and the temporary framework 13 can be designed freely without limitations by the shape of the lifting mechanisms 700. Furthermore, the structures of the lifting mechanisms 700 are so simple that the lifting mechanisms 700 can be easily assembled and disassembled. Therefore, the workability may be enhanced. Moreover, since the lifting mechanisms 700 can support the entire load transmitted from the temporary columns 703 at a suitable elevation, the temporary columns 703 can be disassembled safely.

Although preferred embodiments of the present invention have been disclosed for illustrative purpose, those skilled in the art will appreciate that various modifications, additions, and substitutions are possible, without departing from the scope and spirit of the invention as stated in the accompanying claims.

What is claimed is:

1. A method for constructing a building, the building including a framework of permanent columns and permanent beams, the method comprising the steps of:

assembling a construction apparatus including a temporary framework located above the building under construction;

providing at least one lifting means for lifting the temporary framework;

supporting each lifting means by at least two of the permanent beams of the building;

clamping the lifting means to the building under construction at an intersection between at least one of the permanent columns and at least two of the permanent beams;

providing at least one hoisting means for vertically hoisting from the ground structural elements for the building, the structural elements including the permanent columns and the permanent beams;

horizontally transferring the structural elements to desired positions in one story of the building under construction by means of the hoisting means;

constructing the one story of the building under construction using the transferred structural elements;

supporting the construction apparatus on the building while raising the lifting means; and lifting the temporary framework by means for the lifting means supported by the building.

2. A method according to claim 1, further comprising the step of:

assembling the structural elements on the ground.

3. A method according to claim 1, wherein the building comprises a core portion and a peripheral portion, the core portion being taller than the peripheral portion, the construction apparatus being constructed and located above the core portion, the method further including the steps of:

further constructing the core portion during construction of the peripheral portion; and lifting the temporary framework by the lifting means supported by the core portion.

4. A method according to claim 1, further comprising the steps of:

preparing at least one vertical transferring means for vertically transferring the hoisting means from the ground to the temporary framework;

assembling a horizontal transferring means under the temporary framework for horizontally transferring the hoisting means; and transferring the hoisting means with the structural elements from the vertical transferring means to the horizontal transferring means to transfer the structural elements to desired positions in the one story of the building under construction.

5. A method according to claim 1, wherein the building comprises a core portion and a peripheral portion, the core portion being taller than the peripheral portion, the method further including the steps of:

constructing and locating a first construction apparatus above the core portion;

constructing and locating a second construction apparatus above the peripheral portion;

constructing the peripheral portion with the second construction apparatus;

further constructing the core portion with the first construction apparatus;

maintaining the core portion at an elevation taller than the peripheral portion; and lifting the first and second construction apparatuses with the lifting means.

6. A method according to claim 1, wherein the building comprises a core portion and a peripheral portion with the core portion being taller than the peripheral portion, further comprising the steps of:

constructing an uppermost story portion and maintaining the uppermost story portion at a higher elevation in relation to the core portion;

providing the uppermost story portion with hoisting means;

assembling the construction apparatus above the uppermost story portion;

constructing the core portion with the construction apparatus; and constructing the peripheral portion using the hoisting means of the uppermost story portion, wherein lifting of the temporary framework is achieved by lifting the uppermost story portion.

7. A method according to claim 1, wherein:

lifting the temporary framework is performed hydraulically.

8. A method for constructing a building having a plurality of stories, the building including a periphery enclosing a core portion defining a core area and a peripheral portion defining a peripheral area wherein the peripheral area is greater than the core area, the method comprising the steps of:

movably connecting a construction apparatus to the core portion of a highest completed story, the construction apparatus defining a construction area at least coextensive with the peripheral area;

supporting the construction apparatus on the core portion;

vertically elevating the construction apparatus to a height at least one story above the highest completed story to define a story under construction;

vertically hoisting structural elements, at a location adjacent the periphery, to a height of the construction apparatus;

horizontally transferring the structural elements to the construction apparatus;

horizontally moving the structural elements to predetermined locations within the periphery;

vertically lowering the structural elements into position at the predetermined locations;

incorporating the structural elements into the story under construction at the predetermined locations in the story under construction; and completing the story under construction to form a subsequent highest completed story having a cross-sectional area greater than or equal to the core area but less than or equal to the peripheral area.

9. The method of claim 8, wherein:

the core portion is maintained at a higher elevation than the peripheral portion.

10. The method of claim 8, wherein:

the construction apparatus includes an uppermost story portion which becomes an uppermost story of the building upon completion.

11. The method of claim 8, further comprising the step of:

removably securing the construction to the core portion.

12. The method of claim 10, wherein the construction apparatus is vertically elevated by lifting means and the lifting means is removably supported by the core portion, further comprising the steps of:

clamping the lifting means to the core portion.

13. The method of claim 8, wherein:

vertically elevating the construction apparatus is performed hydraulically.

14. A method for constructing a building, the building including a framework of permanent columns and permanent beams, the method comprising the steps of:

assembling a construction apparatus including a temporary framework located above the building under construction;

providing at least one lifting means for lifting the temporary framework, the lifting means comprising a temporary column erected on a permanent beam of the building, upper and lower lifting frames which are detachably attached to the temporary column, and a hydraulic actuator for extending or shortening a distance between the upper and lower lifting frames, wherein the upper and lower ends of the hydraulic actuator are attached to the upper and lower lifting frames respectively;

supporting the lifting means by at least one permanent beam of the building;

providing at least one hoisting means for vertically hoisting structural elements for the building, the structural elements including the permanent columns and the permanent beams;

horizontally transferring the structural elements to desired positions in one story of the building under construction by means of the hoisting means;

constructing the one story of the building under construction using the transferred structural elements;

clamping the temporary column with one of the upper and lower lifting frames; and operating the hydraulic actuator to extend or shorten the distance between the upper and lower lifting frames, so that the temporary column is lifted together with the temporary framework.

15. A method according to claim 14, further comprising the steps of:

operating the hydraulic actuator to extend or shorten the distance between the upper and lower lifting frames so that the temporary column is lowered, after formation of a permanent column in the uppermost story.

16. A method according to claim 14, further comprising the steps of:

assembling the structural elements on the ground.

* * * * *